US006065830A

United States Patent [19]

Hiramatsu et al.

[11] Patent Number: 6,065,830

[45] **Date of Patent: *May 23, 2000**

[54] RECORDING APPARATUS FOR RECORDING AT DIFFERENT RECORDING SPEEDS

[75] Inventors: Soichi Hiramatsu, Hachioji; Tetsuo Suzuki; Masahiro Taniguro, both of Yokohama; Kazuhiro Nakata, Inagi; Hiroyuki Saito, Yokohama; Haruyuki Yanagi, Machida; Takashi Nojima, Tokyo; Kiichiro Takahashi, Kawasaki; Satoshi Saikawa, Inagi; Hiroyuki Kinoshita, Kawasaki; Hideaki Kawakami, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/120,346

[22] Filed: Sep. 14, 1993

[30] Foreign Application Priority Data

| | | | |
|---|---|---|---|
| Sep. 18, 1992 | [JP] | Japan | 4-249712 |
| Sep. 30, 1992 | [JP] | Japan | 4-260904 |
| Oct. 19, 1992 | [JP] | Japan | 4-280103 |

[51] Int. Cl.[7] ..... B41J 2/01

[52] U.S. Cl. ..... 347/104

[58] Field of Search ..... 347/16, 104, 14, 347/5, 23, 19, 37, 15, 215, 47, 218; 400/582, 583.4, 322, 279, 903; 395/105; 358/423, 424

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 4,864,328 | 9/1989 | Fischbeck | 347/40 |
| 5,043,748 | 8/1991 | Katayama et al. . | |
| 5,126,765 | 6/1992 | Nakamura . | |
| 5,223,937 | 6/1993 | Moriguchi et al. | 347/14 |
| 5,280,310 | 1/1994 | Otsuka et al. . | |
| 5,469,197 | 11/1995 | Hiramatsu . | |

FOREIGN PATENT DOCUMENTS

| | | |
|---|---|---|
| 0159402 | 10/1985 | European Pat. Off. . |
| 0476947 | 3/1992 | European Pat. Off. . |
| 0485992 | 5/1992 | European Pat. Off. . |
| 0518670 | 12/1992 | European Pat. Off. . |
| 59-123670 | 7/1984 | Japan . |
| 59-138461 | 8/1984 | Japan . |

*Primary Examiner*—N. Le
*Assistant Examiner*—Thien Tran
*Attorney, Agent, or Firm*—Fitzpatrick, Cella, Harper & Scinto

[57] ABSTRACT

In a serial recording apparatus having three recording modes, i.e., normal, high-quality, and high-speed recording modes, sheet feed control satisfying requirements in these modes is performed. More specifically, high-speed sheet feed control is performed in the normal or high-speed recording mode, and low-noise sheet feed control with improved precision is performed in the high-quality recording mode, although the speed is low. The apparatus can include a sheet feeder, a designator, a selector and a controller. The sheet feeder feeds a recording sheet relative to a recording head. The designator designates one of the recording modes. The selector selects one of a plurality of patterns for driving the sheet feeder in accordance with the designated recording mode. The controller controls a moving speed of the sheet feeder in accordance with the selected pattern for driving the sheet feeder.

58 Claims, 46 Drawing Sheets

NORMAL SHEET FEED (SHQ MODE)

| | RAMP UP | | | RAMP DOWN | | |
|---|---|---|---|---|---|---|
| STEP (PULSE) | TIME (μs) | T. TIME (μs) | SPEED (pps) | TIME (μs) | T. TIME (μs) | SPEED (pps) |
| 0 | 500 | 500 | 2000 | | | |
| 1 | 2800 | 3300 | 358 | 1471 | 1471 | 680 |
| 2 | 1850 | 5150 | 541 | 1471 | 2942 | 680 |
| 3 | 1510 | 6660 | 663 | 1471 | 4413 | 680 |
| 4 | 1471 | 8131 | 680 | 1471 | 5884 | 680 |
| 5 | 1471 | 9602 | 680 | 1471 | 7355 | 680 |
| 6 | 1471 | 11073 | 680 | 1471 | 8826 | 680 |
| 7 | 1471 | 12544 | 680 | 1471 | 10297 | 680 |
| 8 | 1471 | 14015 | 680 | 1471 | 11768 | 680 |
| 9 | 1471 | 15486 | 680 | 1471 | 13239 | 680 |
| 10 | 1471 | 16957 | 680 | 1471 | 14710 | 680 |
| 11 | 1471 | 18428 | 680 | 1471 | 16181 | 680 |
| 12 | 1471 | 19899 | 680 | 1471 | 17652 | 680 |
| 13 | 1471 | 21370 | 680 | 1471 | 19123 | 680 |
| 14 | 1471 | 22841 | 680 | 1528 | 20651 | 655 |
| 15 | 1471 | 24312 | 680 | 1665 | 22316 | 601 |
| 16 | 1471 | 25783 | 680 | 1848 | 24164 | 542 |
| 17 | 1471 | 27254 | 680 | 2108 | 26272 | 475 |
| 18 | 1471 | 28725 | 680 | 2523 | 28795 | 397 |
| 19 | 1471 | 30196 | 680 | 3369 | 32164 | 297 |
| 20 | 1471 | 31667 | 680 | 4167 | 36331 | 240 |

CURVE A (1-2 PHASE EXCITING)

NORMAL SHEET FEED (SHQ MODE)

| | RAMP UP | | | RAMP DOWN | | |
|---|---|---|---|---|---|---|
| STEP (PULSE) | TIME (μs) | T. TIME (μs) | SPEED (pps) | TIME (μs) | T. TIME (μs) | SPEED (pps) |
| 0 | 500 | 500 | 2000 | | | |
| 1 | 3490 | 3990 | 287 | 1471 | 1471 | 680 |
| 2 | 2370 | 6360 | 422 | 1479 | 2950 | 677 |
| 3 | 1975 | 8335 | 507 | 1501 | 4451 | 677 |
| 4 | 1760 | 10095 | 569 | 1533 | 5984 | 653 |
| 5 | 1625 | 11720 | 616 | 1580 | 7564 | 633 |
| 6 | 1534 | 13254 | 652 | 1653 | 9217 | 605 |
| 7 | 1475 | 14729 | 678 | 1778 | 10995 | 563 |
| 8 | 1471 | 16200 | 680 | 2025 | 13020 | 494 |
| 9 | 1471 | 17671 | 680 | 2830 | 15850 | 354 |
| 10 | 1471 | 19142 | 680 | 4167 | 20017 | 240 |

CURVE B (2-2 PHASE EXCITING)

FINE SHEET FEED (LESS THAN 20 PULSES)

| | RAMP UP | | | RAMP DOWN | | |
|---|---|---|---|---|---|---|
| STEP (PULSE) | TIME (μs) | T. TIME (μs) | SPEED (pps) | TIME (μs) | T. TIME (μs) | SPEED (pps) |
| 0 | 3490 | 3490 | 287 | | | |
| 1 | 3490 | 6980 | 287 | 1471 | 1471 | 680 |
| 2 | 2370 | 9350 | 422 | 1471 | 2942 | 680 |
| 3 | 1975 | 11325 | 507 | 1475 | 4417 | 678 |
| 4 | 1760 | 13085 | 569 | 1534 | 5951 | 652 |
| 5 | 1625 | 14710 | 616 | 1625 | 7576 | 616 |
| 6 | 1534 | 16244 | 652 | 1760 | 9336 | 569 |
| 7 | 1475 | 17719 | 678 | 1975 | 11311 | 507 |
| 8 | 1471 | 19190 | 680 | 2370 | 13681 | 422 |
| 9 | 1471 | 20661 | 680 | 3490 | 17171 | 287 |
| 10 | 1471 | 22132 | 680 | 15000 | 32171 | 67 |

CURVE C (2-2 PHASE EXCITING)

ONE-WAY PRINT IN HQ MODE

ONE-WAY PRINT IN SHQ MODE

FIG. 34

| AMBIENT TEMP | TARGET TEMP | AMBIENT TEMP | TARGET TEMP | AMBIENT TEMP | TARGET TEMP | AMBIENT TEMP | TARGET TEMP |
|---|---|---|---|---|---|---|---|
| 0.0℃ | 35.5℃ | 17.5℃ | 26.0℃ | 35.0℃ | 15.0℃ | 52.5℃ | 15.0℃ |
| 0.5℃ | 35.5℃ | 18.0℃ | 26.0℃ | 35.5℃ | 15.0℃ | 53.0℃ | 15.0℃ |
| 1.0℃ | 35.5℃ | 18.5℃ | 25.5℃ | 36.0℃ | 15.0℃ | 53.5℃ | 15.0℃ |
| 1.5℃ | 35.5℃ | 19.0℃ | 25.5℃ | 36.5℃ | 15.0℃ | 54.0℃ | 15.0℃ |
| 2.0℃ | 35.5℃ | 19.5℃ | 25.0℃ | 37.0℃ | 15.0℃ | 54.5℃ | 15.0℃ |
| 2.5℃ | 35.5℃ | 20.0℃ | 24.5℃ | 37.5℃ | 15.0℃ | 55.0℃ | 15.0℃ |
| 3.0℃ | 35.5℃ | 20.5℃ | 24.5℃ | 38.0℃ | 15.0℃ | 55.5℃ | 15.0℃ |
| 3.5℃ | 35.5℃ | 21.0℃ | 24.0℃ | 38.5℃ | 15.0℃ | 56.0℃ | 15.0℃ |
| 4.0℃ | 35.5℃ | 21.5℃ | 24.0℃ | 39.0℃ | 15.0℃ | 56.5℃ | 15.0℃ |
| 4.5℃ | 35.5℃ | 22.0℃ | 23.5℃ | 39.5℃ | 15.0℃ | 57.0℃ | 15.0℃ |
| 5.0℃ | 35.5℃ | 22.5℃ | 23.5℃ | 40.0℃ | 15.0℃ | 57.5℃ | 15.0℃ |
| 5.5℃ | 35.0℃ | 23.0℃ | 23.0℃ | 40.5℃ | 15.0℃ | 58.0℃ | 15.0℃ |
| 6.0℃ | 34.5℃ | 23.5℃ | 22.5℃ | 41.0℃ | 15.0℃ | 58.5℃ | 15.0℃ |
| 6.5℃ | 34.0℃ | 24.0℃ | 22.5℃ | 41.5℃ | 15.0℃ | 59.0℃ | 15.0℃ |
| 7.0℃ | 34.0℃ | 24.5℃ | 22.0℃ | 42.0℃ | 15.0℃ | 59.5℃ | 15.0℃ |
| 7.5℃ | 33.5℃ | 25.0℃ | 21.5℃ | 42.5℃ | 15.0℃ | 60.0℃ | 15.0℃ |
| 8.0℃ | 33.0℃ | 25.5℃ | 21.5℃ | 43.0℃ | 15.0℃ | 60.5℃ | 15.0℃ |
| 8.5℃ | 32.5℃ | 26.0℃ | 21.0℃ | 43.5℃ | 15.0℃ | 61.0℃ | 15.0℃ |
| 9.0℃ | 32.0℃ | 26.5℃ | 20.5℃ | 44.0℃ | 15.0℃ | 61.5℃ | 15.0℃ |
| 9.5℃ | 32.0℃ | 27.0℃ | 20.5℃ | 44.5℃ | 15.0℃ | 62.0℃ | 15.0℃ |
| 10.0℃ | 31.5℃ | 27.5℃ | 20.0℃ | 45.0℃ | 15.0℃ | 62.5℃ | 15.0℃ |
| 10.5℃ | 31.0℃ | 28.0℃ | 19.5℃ | 45.5℃ | 15.0℃ | 63.0℃ | 15.0℃ |
| 11.0℃ | 30.5℃ | 28.5℃ | 19.0℃ | 46.0℃ | 15.0℃ | 63.5℃ | 15.0℃ |
| 11.5℃ | 30.5℃ | 29.0℃ | 19.0℃ | 46.5℃ | 15.0℃ | 64.0℃ | 15.0℃ |
| 12.0℃ | 30.0℃ | 29.5℃ | 18.5℃ | 47.0℃ | 15.0℃ | 64.5℃ | 15.0℃ |
| 12.5℃ | 29.5℃ | 30.0℃ | 18.0℃ | 47.5℃ | 15.0℃ | 65.0℃ | 15.0℃ |
| 13.0℃ | 29.0℃ | 30.5℃ | 18.0℃ | 48.0℃ | 15.0℃ | 65.5℃ | 15.0℃ |
| 13.5℃ | 28.5℃ | 31.0℃ | 17.5℃ | 48.5℃ | 15.0℃ | 66.0℃ | 15.0℃ |
| 14.0℃ | 28.5℃ | 31.5℃ | 17.0℃ | 49.0℃ | 15.0℃ | 66.5℃ | 15.0℃ |
| 14.5℃ | 28.0℃ | 32.0℃ | 17.0℃ | 49.5℃ | 15.0℃ | 67.0℃ | 15.0℃ |
| 15.0℃ | 27.5℃ | 32.5℃ | 16.5℃ | 50.0℃ | 15.0℃ | 67.5℃ | 15.0℃ |
| 15.5℃ | 27.0℃ | 33.0℃ | 16.0℃ | 50.5℃ | 15.0℃ | 68.0℃ | 15.0℃ |
| 16.0℃ | 27.0℃ | 33.5℃ | 16.0℃ | 51.0℃ | 15.0℃ | 68.5℃ | 15.0℃ |
| 16.5℃ | 26.5℃ | 34.0℃ | 15.5℃ | 51.5℃ | 15.0℃ | 69.0℃ | 15.0℃ |
| 17.0℃ | 26.5℃ | 34.5℃ | 15.0℃ | 52.0℃ | 15.0℃ | 69.5℃ | 15.0℃ |

FIG. 37

| HEAT SOURCE / THERMAL TIME CONSTANT | EJECTION HEATER | | SUB-HEATER | |
|---|---|---|---|---|
| | SHORT | LONG | SHORT | LONG |
| REQUIRED CALCULATION INTERVAL | 0.05sec | 1.00sec | 0.05sec | 1.00sec |
| DATA HOLD TIME | 0.80sec | 512sec | 0.80sec | 512sec |

FIG. 38

| | 0.0%~ | 2.5%~ | 5.0%~ | 7.5%~ | 10.0%~ | 12.5%~ | 87.5%~ | 90.0%~ | 92.5%~ | 95.0%~ | 97.5%~ |
|---|---|---|---|---|---|---|---|---|---|---|---|
| 0.05sec~ | 0.00 | 0.89 | 1.56 | 2.22 | 2.89 | 3.66 | 14.11 | 14.21 | 14.32 | 14.42 | 14.53 |
| 0.10sec~ | 0.00 | 0.43 | 0.62 | 0.41 | 1.01 | 1.24 | 4.89 | 4.93 | 4.97 | 5.00 | 5.04 |
| 0.15sec~ | 0.00 | 0.20 | 0.25 | 0.30 | 0.35 | 0.42 | 1.70 | 1.71 | 1.72 | 1.74 | 1.75 |
| 0.20sec~ | 0.00 | 0.09 | 0.10 | 0.11 | 0.12 | 0.14 | 0.59 | 0.59 | 0.60 | 0.60 | 0.61 |
| 0.25sec~ | 0.00 | 0.04 | 0.05 | 0.07 | 0.08 | 0.09 | 0.17 | 0.17 | 0.17 | 0.17 | 0.17 |
| 0.30sec~ | 0.00 | 0.04 | 0.05 | 0.07 | 0.08 | 0.09 | 0.17 | 0.17 | 0.17 | 0.17 | 0.17 |
| 0.35sec~ | 0.00 | 0.04 | 0.05 | 0.07 | 0.08 | 0.09 | 0.17 | 0.17 | 0.17 | 0.17 | 0.17 |
| 0.40sec~ | 0.00 | 0.04 | 0.05 | 0.07 | 0.08 | 0.09 | 0.17 | 0.17 | 0.17 | 0.17 | 0.17 |
| 0.45sec~ | 0.00 | 0.04 | 0.05 | 0.07 | 0.08 | 0.09 | 0.17 | 0.17 | 0.17 | 0.17 | 0.17 |
| 0.50sec~ | 0.00 | 0.04 | 0.05 | 0.07 | 0.08 | 0.09 | 0.17 | 0.17 | 0.17 | 0.17 | 0.17 |
| 0.55sec~ | 0.00 | 0.04 | 0.05 | 0.07 | 0.08 | 0.09 | 0.17 | 0.17 | 0.17 | 0.17 | 0.17 |
| 0.60sec~ | 0.00 | 0.04 | 0.05 | 0.07 | 0.08 | 0.09 | 0.17 | 0.17 | 0.17 | 0.17 | 0.17 |
| 0.65sec~ | 0.00 | 0.04 | 0.05 | 0.07 | 0.08 | 0.09 | 0.17 | 0.17 | 0.17 | 0.17 | 0.17 |
| 0.70sec~ | 0.00 | 0.04 | 0.05 | 0.07 | 0.08 | 0.09 | 0.17 | 0.17 | 0.17 | 0.17 | 0.17 |
| 0.75sec~ | 0.00 | 0.04 | 0.05 | 0.07 | 0.08 | 0.09 | 0.17 | 0.17 | 0.17 | 0.17 | 0.17 |
| 0.80sec~ | 0.00 | 0.04 | 0.05 | 0.07 | 0.08 | 0.09 | 0.17 | 0.17 | 0.17 | 0.17 | 0.17 |
| 0.85sec~ | 0.00 | 0.00 | 0.00 | 0.00 | 0.00 | 0.00 | 0.00 | 0.00 | 0.00 | 0.00 | 0.00 |

FIG. 39

| | 0.0%~ | 2.5%~ | 5.0%~ | 7.5%~ | 10.0%~ | 12.5%~ | ~ | 87.5%~ | 90.0%~ | 92.5%~ | 95.0%~ | 97.5%~ |
|---|---|---|---|---|---|---|---|---|---|---|---|---|
| 1sec~ | 0.00 | 0.15 | 0.27 | 0.39 | 0.52 | 0.62 | ~ | 2.65 | 2.68 | 2.75 | 2.75 | 2.79 |
| 3sec~ | 0.00 | 0.08 | 0.18 | 0.24 | 0.32 | 0.37 | | 0.79 | 0.80 | 0.81 | 0.81 | 0.82 |
| 5sec~ | 0.00 | 0.07 | 0.09 | 0.11 | 0.13 | 0.17 | | 0.48 | 0.49 | 0.49 | 0.50 | 0.50 |
| 7sec~ | 0.00 | 0.12 | 0.14 | 0.16 | 0.18 | 0.20 | | 0.70 | 0.70 | 0.71 | 0.71 | 0.72 |
| 9sec~ | 0.00 | 0.06 | 0.11 | 0.15 | 0.20 | 0.22 | | 0.43 | 0.43 | 0.43 | 0.44 | 0.44 |
| 11sec~ | 0.00 | 0.05 | 0.07 | 0.09 | 0.11 | 0.13 | | 0.38 | 0.39 | 0.39 | 0.39 | 0.40 |
| 21sec~ | 0.00 | 0.04 | 0.05 | 0.06 | 0.07 | 0.08 | ~ | 0.17 | 0.17 | 0.17 | 0.17 | 0.17 |
| 41sec~ | 0.00 | 0.03 | 0.04 | 0.05 | 0.06 | 0.06 | | 0.17 | 0.17 | 0.17 | 0.17 | 0.17 |
| 61sec~ | 0.00 | 0.02 | 0.03 | 0.04 | 0.05 | 0.05 | | 0.10 | 0.10 | 0.10 | 0.11 | 0.11 |
| 81sec~ | 0.00 | 0.01 | 0.02 | 0.03 | 0.04 | 0.04 | | 0.06 | 0.06 | 0.06 | 0.06 | 0.06 |
| 101sec~ | 0.00 | 0.02 | 0.02 | 0.02 | 0.03 | 0.03 | | 0.06 | 0.06 | 0.06 | 0.06 | 0.06 |
| 151sec~ | 0.00 | 0.01 | 0.01 | 0.01 | 0.02 | 0.02 | | 0.30 | 0.30 | 0.30 | 0.30 | 0.30 |
| 301sec~ | 0.00 | 0.01 | 0.01 | 0.01 | 0.01 | 0.01 | | 0.02 | 0.02 | 0.02 | 0.02 | 0.02 |
| 512sec~ | 0.00 | 0.00 | 0.00 | 0.00 | 0.00 | 0.00 | ~ | 0.00 | 0.00 | 0.00 | 0.00 | 0.00 |

FIG. 40

| | 0.0%~ | 20.0%~ | 40.0%~ | 60.0%~ | 80.0%~ |
|---|---|---|---|---|---|
| 0.05sec~ | 3.57 | 7.00 | 6.26 | 10.10 | 11.64 |
| 0.10sec~ | 2.25 | 4.20 | 4.10 | 6.24 | 7.16 |
| 0.15sec~ | 1.45 | 2.52 | 2.69 | 3.85 | 4.40 |
| 0.20sec~ | 0.93 | 1.51 | 1.76 | 2.38 | 2.71 |
| 0.25sec~ | 0.10 | 0.23 | 0.06 | 2.14 | 2.10 |
| 0.30sec~ | 0.15 | 0.24 | 0.24 | 0.55 | 0.68 |
| 0.35sec~ | 0.00 | 0.24 | 0.24 | 0.55 | 0.68 |
| 0.40sec~ | 0.00 | 0.24 | 0.24 | 0.55 | 0.68 |
| 0.45sec~ | 0.00 | 0.24 | 0.24 | 0.55 | 0.68 |
| 0.50sec~ | 0.00 | 0.24 | 0.24 | 0.55 | 0.68 |
| 0.55sec~ | 0.00 | 0.24 | 0.24 | 0.55 | 0.68 |
| 0.60sec~ | 0.00 | 0.24 | 0.24 | 0.55 | 0.68 |
| 0.65sec~ | 0.00 | 0.24 | 0.24 | 0.55 | 0.68 |
| 0.70sec~ | 0.00 | 0.24 | 0.24 | 0.55 | 0.68 |
| 0.75sec~ | 0.00 | 0.24 | 0.24 | 0.55 | 0.68 |
| 0.80sec~ | 0.00 | 0.24 | 0.24 | 0.55 | 0.68 |
| 0.85sec~ | 0.00 | 0.00 | 0.00 | 0.00 | 0.00 |

FIG. 41

| | 0.0%~ | 2.5%~ | 5.0%~ | 7.5%~ | 10.0%~ | 12.5%~ | 15.5%~ | 87.5%~ | 90.0%~ | 92.5%~ | 95.0%~ | 97.5%~ |
|---|---|---|---|---|---|---|---|---|---|---|---|---|
| 1sec~ | 0.00 | 0.11 | 0.14 | 0.18 | 0.21 | 0.27 | 0.33 | 1.74 | 1.83 | 1.91 | 2.00 | 2.08 |
| 3sec~ | 0.00 | 0.14 | 0.13 | 0.12 | 0.12 | 0.16 | 0.20 | 0.66 | 0.67 | 0.67 | 0.68 | 0.68 |
| 5sec~ | 0.00 | 0.02 | 0.04 | 0.06 | 0.08 | 0.09 | 0.10 | 0.40 | 0.41 | 0.41 | 0.41 | 0.42 |
| 7sec~ | 0.00 | 0.03 | 0.07 | 0.10 | 0.13 | 0.14 | 0.15 | 0.51 | 0.54 | 0.56 | 0.58 | 0.60 |
| 9sec~ | 0.00 | 0.06 | 0.07 | 0.08 | 0.08 | 0.11 | 0.13 | 0.35 | 0.36 | 0.36 | 0.36 | 0.37 |
| 11sec~ | 0.00 | 0.04 | 0.04 | 0.05 | 0.06 | 0.07 | 0.08 | 0.30 | 0.31 | 0.32 | 0.32 | 0.33 |
| 21sec~ | 0.00 | 0.02 | 0.03 | 0.04 | 0.04 | 0.05 | 0.06 | 0.14 | 0.14 | 0.14 | 0.14 | 0.14 |
| 41sec~ | 0.00 | 0.02 | 0.02 | 0.03 | 0.04 | 0.04 | 0.04 | 0.13 | 0.13 | 0.13 | 0.14 | 0.14 |
| 61sec~ | 0.00 | 0.02 | 0.02 | 0.02 | 0.03 | 0.03 | 0.04 | 0.08 | 0.08 | 0.09 | 0.09 | 0.09 |
| 81sec~ | 0.00 | 0.01 | 0.01 | 0.02 | 0.02 | 0.02 | 0.03 | 0.06 | 0.05 | 0.05 | 0.05 | 0.05 |
| 101sec~ | 0.00 | 0.01 | 0.01 | 0.02 | 0.02 | 0.02 | 0.02 | 0.04 | 0.04 | 0.05 | 0.05 | 0.05 |
| 151sec~ | 0.00 | 0.01 | 0.01 | 0.01 | 0.01 | 0.01 | 0.01 | 0.02 | 0.02 | 0.02 | 0.02 | 0.02 |
| 301sec~ | 0.00 | 0.00 | 0.00 | 0.01 | 0.01 | 0.01 | 0.01 | 0.01 | 0.01 | 0.01 | 0.01 | 0.01 |
| 512sec~ | 0.00 | 0.00 | 0.00 | 0.00 | 0.00 | 0.00 | 0.00 | 0.00 | 0.00 | 0.00 | 0.00 | 0.00 |

$P_1$ : PRE-HEAT PULSE ($=T_1$) [EXECUTE PWM]
$P_2$ : INTERVAL ($=T_2-T_1$)
$P_3$ : MAIN HEAT PULSE ($=T_3-T_2$)
Vop : DRIVE VOLTAGE

FIG. 47

| TEMP DIFFERENCE | SET-UP | PRE-HEAT | INTERVAL | MAIN | WEIGHTING |
|---|---|---|---|---|---|
| -52.5℃~ | 0.905μs | 0.000μs | 0.000μs | 4.525μs | 60% |
| -49.5℃~ | 0.905μs | 0.000μs | 0.000μs | 4.525μs | 60% |
| -46.5℃~ | 0.905μs | 0.000μs | 0.000μs | 4.525μs | 60% |
| -43.5℃~ | 0.905μs | 0.000μs | 0.000μs | 4.525μs | 60% |
| -40.5℃~ | 0.905μs | 0.000μs | 0.000μs | 4.525μs | 60% |
| -37.5℃~ | 0.905μs | 0.000μs | 0.000μs | 4.525μs | 60% |
| -34.5℃~ | 0.905μs | 0.000μs | 0.000μs | 4.525μs | 60% |
| -31.5℃~ | 0.905μs | 0.000μs | 0.000μs | 4.525μs | 60% |
| -28.5℃~ | 0.905μs | 0.000μs | 0.000μs | 4.887μs | 64% |
| -25.5℃~ | 0.905μs | 0.000μs | 0.000μs | 5.068μs | 68% |
| -22.5℃~ | 0.905μs | 0.000μs | 0.000μs | 5.249μs | 72% |
| -19.5℃~ | 0.905μs | 0.000μs | 0.000μs | 5.611μs | 76% |
| -16.5℃~ | 0.905μs | 0.000μs | 0.000μs | 5.972μs | 80% |
| -13.5℃~ | 0.905μs | 0.000μs | 0.000μs | 5.973μs | 84% |
| -10.5℃~ | 0.905μs | 0.000μs | 0.000μs | 6.335μs | 88% |
| -7.5℃~ | 0.905μs | 0.000μs | 0.000μs | 6.516μs | 92% |
| -4.5℃~ | 0.905μs | 0.000μs | 0.000μs | 6.697μs | 96% |
| -1.5℃~ | 0.905μs | 0.000μs | 0.000μs | 7.059μs | 100% |
| 1.5℃~ | 0.905μs | 1.991μs | 0.543μs | 5.068μs | 100% |
| 4.5℃~ | 0.905μs | 1.991μs | 0.905μs | 5.068μs | 100% |
| 7.5℃~ | 0.905μs | 1.991μs | 1.448μs | 5.068μs | 100% |
| 10.5℃~ | 0.905μs | 1.991μs | 1.991μs | 5.068μs | 100% |
| 13.5℃~ | 0.905μs | 1.991μs | 1.991μs | 5.068μs | 100% |
| 16.5℃~ | 0.905μs | 1.991μs | 1.991μs | 5.068μs | 100% |
| 19.5℃~ | 0.905μs | 1.991μs | 1.991μs | 5.068μs | 100% |
| 22.5℃~ | 0.905μs | 1.991μs | 1.991μs | 5.068μs | 100% |
| 25.5℃~ | 0.905μs | 1.991μs | 1.991μs | 5.068μs | 100% |
| 28.5℃~ | 0.905μs | 1.991μs | 1.991μs | 5.068μs | 100% |
| 31.5℃~ | 0.905μs | 1.991μs | 1.991μs | 5.068μs | 100% |
| 34.5℃~ | 0.905μs | 1.991μs | 1.991μs | 5.068μs | 100% |
| 37.5℃~ | 0.905μs | 1.991μs | 1.991μs | 5.068μs | 100% |

FIG. 49

| TEMP DIFFERENCE | LONG | SHORT |
|---|---|---|
| 0℃ | 0.0sec | 0ms |
| 1℃ | 0.0sec | 0ms |
| 2℃ | 0.0sec | 0ms |
| 3℃ | 0.0sec | 0ms |
| 4℃ | 0.0sec | 0ms |
| 5℃ | 0.0sec | 0ms |
| 6℃ | 0.0sec | 0ms |
| 7℃ | 0.0sec | 0ms |
| 8℃ | 0.0sec | 0ms |
| 9℃ | 0.0sec | 0ms |
| 10℃ | 0.0sec | 0ms |
| 11℃ | 0.0sec | 0ms |
| 12℃ | 0.0sec | 0ms |
| 13℃ | 0.0sec | 0ms |
| 14℃ | 0.1sec | 10ms |
| 15℃ | 0.2sec | 20ms |
| 16℃ | 0.4sec | 40ms |
| 17℃ | 0.5sec | 50ms |
| 18℃ | 0.6sec | 60ms |
| 19℃ | 0.7sec | 70ms |
| 20℃ | 0.8sec | 80ms |
| 21℃ | 0.9sec | 90ms |
| 22℃ | 1.1sec | 110ms |
| 23℃ | 1.2sec | 120ms |
| 24℃ | 1.3sec | 130ms |
| 25℃ | 1.4sec | 140ms |
| 26℃ | 1.5sec | 150ms |
| 27℃ | 1.7sec | 160ms |
| 28℃ | 1.8sec | 180ms |
| 29℃ | 1.9sec | 190ms |
| 30℃ | 2.0sec | 200ms |
| 31℃ | 2.0sec | 200ms |
| 32℃ | 2.0sec | 200ms |
| 33℃ | 2.0sec | 200ms |
| 34℃ | 2.0sec | 200ms |
| 35℃ | 2.0sec | 200ms |
| 36℃ | 2.0sec | 200ms |
| 37℃ | 2.0sec | 200ms |
| 38℃ | 2.0sec | 200ms |
| 39℃ | 2.0sec | 200ms |

RECORDING APPARATUS FOR RECORDING AT DIFFERENT RECORDING SPEEDS

BACKGROUND OF THE INVENTION

The present invention relates to a recording apparatus capable of recording an image on a recording medium in a plurality of recording modes.

In one of general arrangements for conveying a recording paper sheet in a recording apparatus, a recording paper sheet is fed by rotating conveyance rollers while urging the recording paper sheet against the conveyance rollers. A predetermined recording operation is performed on the fed recording paper sheet (recording sheet) using a recording head. The conveyance rollers are driven by transmitting the drive force of, e.g., a stepping motor via a gear train or the like.

In an arrangement for moving a carriage which carries the recording head, for example, a portion of a timing belt is attached to the carriage, and the belt is driven by, e.g., a stepping motor, thereby moving the recording head, as is well known. With these arrangements, the recording head is scanned with respect to the recording sheet, and a recording operation is performed during the scanning operation using the recording head. Every time a scanning operation is completed, the recording sheet is fed by the recording width of the recording sheet. In this manner, a recording operation for a single recording sheet is performed.

On the other hand, recent recording apparatuses, in particular, the ink-jet recording apparatus, are required to record fine images. As a general arrangement therefor, recording elements in a recording head, e.g., ink ejection orifices in an ink-jet system, are arranged at a high density.

In addition to such a recent tendency, recording apparatuses are required to reduce noise generated upon execution of a recording operation, and to have a high recording speed or to be able to select one of a plurality of recording speeds in accordance with an image to be recorded, so as to improve the values of their commodities.

In order to meet the above-mentioned fine, low-noise, and high-speed recording requirements, the recording sheet conveyance arrangement and the recording head scanning arrangement are improved variously.

However, the conventional recording sheet conveyance arrangement and recording head scanning arrangement responding to various requirements in the recording apparatus suffer from some problems as follows.

1) First, in a conventional recording apparatus, the conveyance speed of a recording sheet remains the same in either a high-speed recording mode for scanning a recording head at a high speed or a normal recording mode for scanning the recording head at a normal scanning speed.

In the high-speed recording mode, in general, an image is formed by thinning out dots constituting the image (draft mode). For this reason, in consideration of an application of such a thinned-out image, the conveyance precision of a recording sheet is not so important, but the speed is rather important.

On the other hand, in the normal recording mode, it is important to improve the conveyance precision so as to record a high-definition image, and to achieve a low-noise arrangement.

However, as described above, in the conventional recording apparatus, the recording sheet conveyance speed remains the same in either the high-speed recording mode or the normal recording mode. For this reason, for example, if the high-speed recording mode is executed at a relatively low conveyance speed to place an importance on, e.g., conveyance precision and low noise, a low-speed recording sheet conveyance operation, which does not match with the high scanning speed of the recording head, is undesirably performed. Conversely, if a relatively high conveyance speed is set in correspondence with the high-speed recording mode, and the normal recording mode is executed, since the conveyance precision is lowered, a fine image cannot be recorded even by a high-density recording head.

2) Second, when a fine-image recording operation is achieved by increasing the density of recording elements of the recording head, the conveyance precision of a recording sheet is required to be improved accordingly. Also, various other requirements for the conveyance speed, and noise upon execution of the conveyance operation must be satisfied.

In a normal recording sheet conveyance operation, if the conveyance amount of the recording sheet is, e.g., "⅙ inch", the drive operation of a stepping motor associated with the conveyance operation is controlled in correspondence with a drive curve having the number of steps of the stepping motor according to the conveyance amount. However, in addition to the normally used conveyance amount, a conveyance operation may often be performed with a still smaller conveyance amount so as to attain, e.g., fine-image recording. In such a case, as one of conventional arrangements, a conveyance operation is performed with the number of steps smaller than that of the above-mentioned drive curve, and the stepping motor is driven at a predetermined pulse rate, i.e., at a predetermined drive speed in correspondence with the smaller number of steps. However, when the drive operation is performed at the predetermined pulse rate (self-start drive without ramp up/down), the drive speed is low, and noise becomes relatively high.

In place of such a drive operation, an arrangement for setting a drive curve according to even a small conveyance amount, and performing a drive operation for conveying a recording sheet in accordance with the set drive curve is known. However, if there are a large number of kinds of such small conveyance amounts, drive curves must be prepared in correspondence with these conveyance amounts, and a control arrangement is complicated very much. Thus, such an arrangement is not practical in consideration of the processing time.

Furthermore, in the above-mentioned arrangement using a drive curve for a small conveyance amount, in order to solve a problem about noise upon execution of the conveyance operation by a small conveyance amount, the drive curve is designed to have symmetrical rising and falling curve patterns, and various conveyance amounts partially use the same rising and falling curve patterns. A constant-speed drive curve having a length according to each conveyance amount is connected between these rising and falling curve patterns.

In this case, a conveyance operation exceeding a predetermined length is controlled based on a drive curve constituted by the entire rising curve pattern, a constant-speed curve pattern, and the entire falling curve pattern. However, since the symmetrical rising and falling curve patterns corresponding to a conveyance operation for a predetermined amount or less are used, the noise, speed, and precision requirements for the recording sheet conveyance operation cannot be sufficiently satisfied in a normal conveyance operation exceeding the predetermined amount.

3) Third, as for the drive operation of the carriage motor for scanning the recording head, the same problem as that described in item 2) above is posed. More specifically, a problem in a short-distance carriage drive operation is posed.

In order to increase the recording speed, a so-called skip operation for scanning the carriage on a blank portion within a line at a higher speed than that in a recording mode is performed. Also, when the carriage is returned, a so-called high-speed return operation for scanning the carriage at a high speed is similarly performed.

With the above-mentioned control, although the recording speed can be increased, sliding noise increases, and recording precision is lowered since the carriage moves at a high speed. In this manner, such control poses a problem in a high-quality mode.

4) Fourth, when an ink-jet system is adopted as a recording system, a capping operation for protecting an ink-jet recording head in a non-recording state, and a wiping operation for maintaining a recording state are performed.

At this time, if a wiping operation is performed scanning the carriage at a high speed, moving noise in the wiping operation is increased, and it is not preferable in some recording modes. On the other hand, if a wiping operation is performed at a low speed, the overall throughput is lowered, and it is not preferable in the high-speed recording mode.

5) Similarly, when an ink-jet system is adopted as a recording system, since the temperature rise rate of the recording head changes depending on the drive state of the ink-jet recording head, in particular, in the high-speed recording mode, the ejection amount of an ink varies, resulting in a density nonuniformity. In addition, the refill time required for refilling an ejected ink in nozzles (ejection portions) cannot be sufficiently assured in the high-speed recording mode.

On the other hand, in a high-quality recording mode, it is demanded to obtain a recording image with a higher density.

SUMMARY OF THE INVENTION

The present invention has been made in consideration of the above situation, and has as its object to provide an improved recording apparatus.

It is another object of the present invention to provide a recording apparatus, which has a plurality of recording modes, and can perform recording under a proper recording condition.

It is still another object of the present invention to provide a recording apparatus, which has a plurality of recording modes, and can perform proper conveyance control of a recording medium in correspondence with the recording modes.

It is still another object of the present invention to provide a recording apparatus, which has a plurality of recording modes, and can perform proper moving control of a recording head in correspondence with the recording modes.

It is still another object of the present invention to provide a recording apparatus, which has a plurality of recording modes, and can perform proper wiping control of a recording head in correspondence with the recording modes.

It is still another object of the present invention to provide a recording apparatus, which has a plurality of recording modes, and can perform proper drive control of a recording head in correspondence with the recording modes.

The above and other objects of the present invention will become apparent from the following description taken in conjunction with the accompanying drawings.

BRIEF DESCRIPTION OF THE DRAWINGS

FIG. 34 shows a target temperature table used in the seventh embodiment;

FIG. 37 shows a table showing a required calculation interval and a data holding time upon execution of a temperature calculation;

FIG. 38 shows a calculation table obtained when an ejection heater is used as a heat source, and a short-range member group is used as a time constant;

FIG. 39 shows a calculation table obtained when the ejection heater is used as a heat source, and a long-range member group is used as a time constant;

FIG. 40 shows a calculation table obtained when a sub-heater is used as a heat source, and a short-range member group is used as a time constant;

FIG. 41 shows a calculation table obtained when the sub-heater is used as a heat source, and a long-range member group is used as a time constant;

FIG. 47 shows a PWM table showing pulse widths corresponding to the temperature differences between target temperature and head temperatures;

FIG. 49 shows a table showing the sub-heater drive control times corresponding to the temperature differences between target temperatures and head temperatures;

DETAILED DESCRIPTION OF THE PREFERRED EMBODIMENTS

Figure 1:
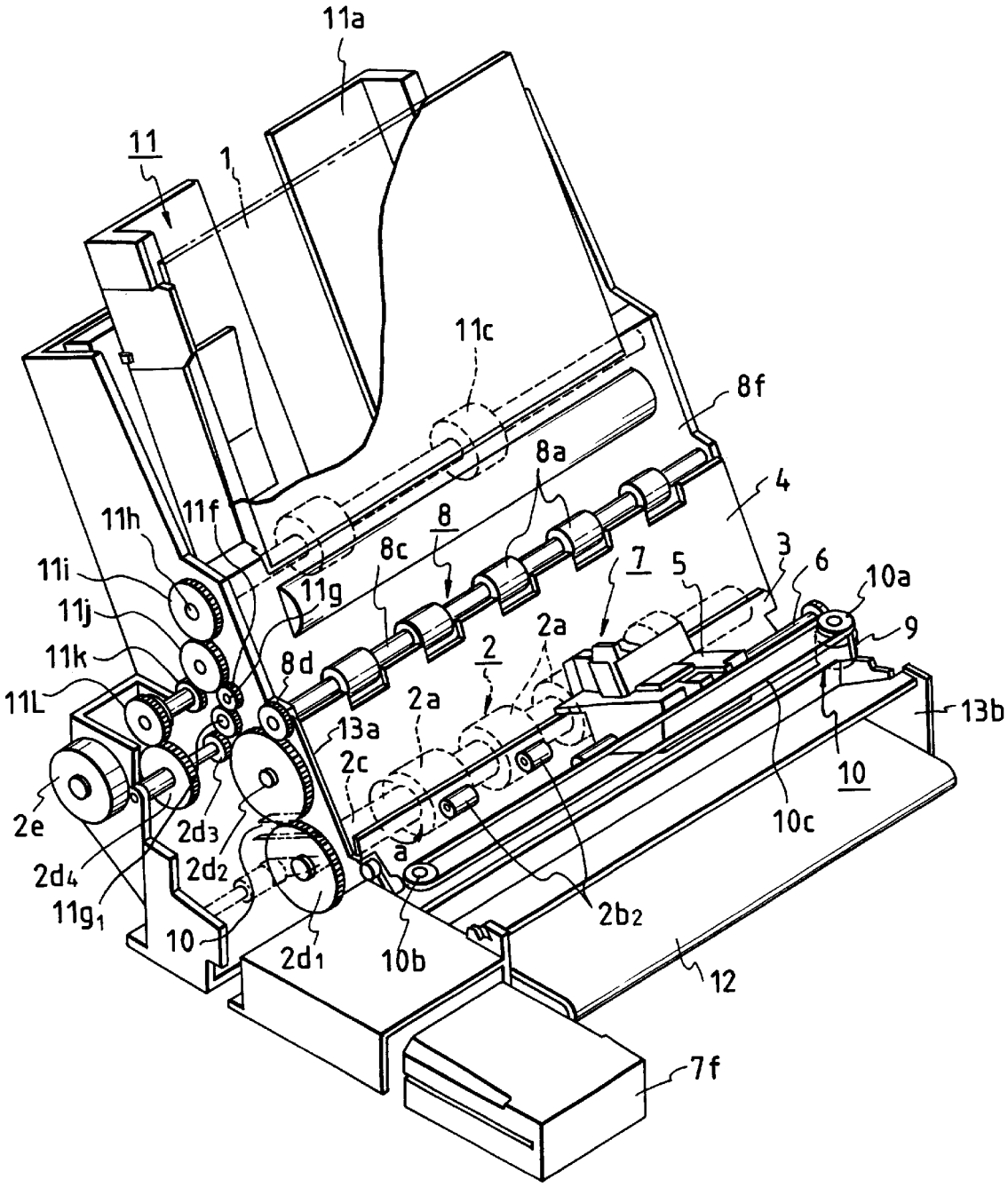
FIG. 1 is a perspective view showing an ink-jet recording apparatus according to the first embodiment of the present invention.

The preferred embodiments of the present invention will now be described in detail with reference to the accompanying drawings.

First Embodiment

<Overall Arrangement>

The overall arrangement of an ink-jet recording apparatus according to an embodiment of the present invention will be described below with reference to FIG. 1. A recording sheet 1 as a recording medium is fed by a sheet conveyance means 2. At this time, the recording sheet 1 is pressed against conveyance rollers 2*a* by a sheet pressing member 3 so as not to float from a platen 4.

When the recording sheet 1 is fed, a carriage 5 is reciprocally moved along a guide rail 6, and a recording means 7 is driven to record an image on the recording sheet 1. The sheet 1 recorded with the image is exhausted by an exhaust means 8.

The carriage 5 is reciprocally moved upon reception of the drive force of a carriage motor 9 as a drive source via a timing belt 10*c* constituting a transmission means 10.

The arrangements of the respective units of the ink-jet recording apparatus of this embodiment will be described in detail below.

<Sheet Conveyance Means>

The sheet conveyance means 2 is used for conveying a recording sheet 1 to the recording position of the recording means, and conveys a recording sheet fed from an ASF (Auto Sheet Feeder) 11 detachable from the apparatus main body or a recording sheet inserted from a manual insertion port 12, in this embodiment.

The sheet conveyance means 2 of this embodiment rotates the conveyance rollers 2*a* in the direction of an arrow a, and conveys the recording sheet 1 by front and rear pinch rollers $2b_1$ (not shown) and $2b_2$ driven by the rollers 2*a*.

The conveyance rollers 2*a* are divisionally fitted on a roller shaft 2*c*, the two ends of which are pivotally supported by right and left side walls 13*b* and 13*a* of an apparatus frame, respectively.

The drive force from a conveyance motor 2*e* is transmitted to the roller shaft 2*c* via the above-mentioned drive transmission structure including a gear train. More specifically, a conveyance gear $2d_1$ is attached to the roller shaft 2*c*, and is meshed with an idler gear $2d_2$. The idler gear $2d_2$ is meshed with a first transmission gear $2d_3$.

A second transmission gear $2d_4$ is attached to the shaft of the first transmission gear $2d_3$. The drive force from the conveyance motor 2*e* is selectively transmitted to the first and second transmission gears $2d_3$ and $2d_4$ by a clutch mechanism (not shown).

Therefore, when the drive force of the conveyance motor 2*e* is transmitted to the first transmission gear $2d_3$, the rotational force of the gear $2d_3$ is transmitted to the conveyance gear $2d_1$ via the idler gear $2d_2$, thereby rotating the conveyance rollers 2*a*.

Note that the pinch rollers $2b_1$ and $2b_2$ are pressed against the surface of each conveyance roller 2*a* by springs (not shown) or the like, and are driven by the rotation of the conveyance roller 2*a*. Therefore, the recording sheet 1 obtains its conveyance force while being nipped by the rotating conveyance rollers 2*a* and the pinch rollers $2b_1$ and $2b_2$.

A paper pan (not shown) curved along the circumferential surfaces of the conveyance rollers 2*a* is mounted below the conveyance rollers 2*a*. The paper pan extends to the manual insertion port 12, and serves as a lower guide of a manually inserted recording sheet 1.

Furthermore, an upper guide plate is mounted above the paper pan to be separated by a predetermined interval therefrom, thus constituting a conveyance path of the recording sheet 1.

In the above-mentioned arrangement, when the conveyance motor 2*e* is driven to rotate the conveyance rollers 2*a* in the direction of the arrow a in FIG. 1, the recording sheet 1 fed from the ASF 11 is nipped by the front pinch rollers $2b_1$ and the conveyance rollers 2*a*, and is fed along the circumferential surfaces of the conveyance rollers 2*a* in a U-turn manner. The recording sheet 1 is then nipped by the rear pinch rollers $2b_2$ and the conveyance rollers 2*a*, and is fed to the recording position located above the rollers.

On the other hand, the recording sheet 1 fed from the manual insertion port 12 is nipped by the conveyance rollers 2*a* and the rear pinch rollers $2b_2$, and is fed to the recording position.

The ASF 11 for automatically feeding recording sheets 1 to the conveyance means 2 will be briefly described below.

The ASF 11 is detachable from the recording apparatus. The uppermost one of recording sheets 1 stored in a cassette 11*a* is pressed against separation rollers 11*c* by a pressing spring. When the separation rollers 11*c* are rotated, the uppermost sheet is separated and fed, and is brought into contact with a nip portion between a registration roller arranged at the downstream side of the separation rollers, and an upper roller contacting the registration roller. When the registration roller is rotated, the recording sheet 1 is nipped by the registration roller and the upper roller driven by the registration roller, and is fed to the sheet conveyance means 2.

In a drive force transmission arrangement to the registration roller, a registration gear 11*g* is attached to a roller shaft 11*f* on which the registration roller is fitted, and is meshed with the idler gear $2d_2$ via an idler gear $11g_1$.

On the other hand, in a drive force transmission arrangement to the separation rollers 11*c*, a separation gear 11*i* is attached to a roller shaft 11*h* on which the separation rollers 11*c* are fitted, and is meshed with idler gears 11*j* and 11*k* in turn. Furthermore, a gear 11*l* attached coaxially with the gear 11*k* is meshed with the second transmission gear $2d_4$.

Therefore, when the conveyance motor 2*e* is driven to transmit a drive force via the gear train, the separation rollers 11*c* or the registration roller is rotated.

<Sheet Pressing Member>

The sheet pressing member 3 presses the recording sheet 1 fed by the conveyance means 2 against the conveyance rollers 2*a* so as to prevent the sheet 1 from floating from the platen 4.

The sheet pressing member 3 comprises a single planar member having a width larger than the moving range of the carriage 5, so as to press the entire width region of the recording sheet 1. The sheet pressing member 3 is pressed against the conveyance rollers 2*a* by a pressing means such as a spring (not shown).

The distal end of the sheet pressing member 3 is located below the recording position of the recording means 7, and the fed recording sheet 1 is pressed against the conveyance rollers 2*a* by the sheet pressing member 3. As a result, the recording sheet 1 at the recording position can be prevented from floating from the platen 4.

<Carriage>

The carriage 5 is arranged for reciprocally moving the recording means 7 in the widthwise direction of the recording sheet 1.

The carriage 5 is slidably attached to the guide rail 6, the two ends of which are fixed to the right and left side walls 13*b* and 13*a*, and which serves as a guide member having a circular section.

The carriage 5 is attached to be pivotal about the guide rail 6, so that the front portion of the carriage 5, i.e., a portion opposing the recording sheet 1 is inclined downward. As a result, the front end portion of the carriage contacts the sheet pressing member 3 by the weights of the carriage 5 and the recording means 7 carried on the carriage 5.

Thus, the interval between the recording means 7 carried on the carriage 5 and the recording sheet 1 can be maintained constant all the time.

The drive force of the carriage motor 9 is transmitted to the carriage 5 via the transmission means 10, thereby reciprocally moving the carriage 5.

A driving pulley 10*a* is attached to one end of the moving range of the carriage 5, and a driven pulley 10*b* is attached to the other end. The driving pulley 10*a* is coupled to the carriage motor 9. The endless timing belt 10*c*, which extends parallel to the guide rail 6, and serves as a transmission member, is looped between the pulleys 10*a* and 10*b*, and a portion of the timing belt 10*c* is fixed to the carriage 5.

<Recording Means>

The recording means is carried on the carriage 5, and records an ink image on the recording sheet 1 fed by the conveyance means 2. As the recording means in this apparatus, an ink-jet recording system is suitably used.

The ink-jet recording system comprises ink ejection orifices for ejecting a recording ink as flying droplets, ink channels communicating with these ejection orifices, and ejection energy generation means for applying ejection energy to the ink in the channels to form flying droplets. The ejection energy generation means are driven according to an image signal to form ink droplets, thereby recording an image.

As the ejection energy generation means, for example, a method using a pressure energy generation means such as an electromechanical converter, e.g., a piezo element, a method using an electromagnetic energy generation means for causing an ink to absorb an electromagnetic wave such as a laser radiated thereon so as to form flying droplets, a method using a heat energy generation means such as an electro-thermal converter, or the like is available. Of these methods, the method using the heat energy generation means such as an electro-thermal converter is suitable since it allows a high-density arrangement of ejection orifices, and can attain a compact structure of a recording head. For this reason, in this embodiment, an ink is ejected by this method.

A capping means (not shown) is arranged at the left end portion of the moving range of the carriage 5. The capping means has a function of preventing an ink near the ejection orifices of the recording head 7 from being dried, and solidification of the dried ink by covering the ink ejection surface of the recording head 7 in a non-recording state.

The capping means is connected to a pump (not shown). In order to remove or avoid ink ejection errors, the pump is driven to draw an ink by suction from the ejection orifices by the suction force of the pump, thus executing recovery processing.

<Exhaust Means>

The exhaust means 8 is arranged for exhausting the recording sheet recorded by the recording means 7.

The exhaust means 8 comprises exhaust rollers 8*a* and spur gears (not shown) contacting these gears. An exhaust gear 8*d* is attached to the end portion of a roller shaft 8*c* of the exhaust rollers 8*a*, and is meshed with the idler gear $2d_2$.

Therefore, when the conveyance motor 2*e* is rotated, its drive force is transmitted to the exhaust rollers 8*a* to rotate these rollers 8*a*, and the recording sheet 1 is exhausted by co-operations of the exhaust rollers 8*a* and spur gears 8*b*. The exhausted recording sheet 1 is stacked on an exhaust stacker 8*f* located above the exhaust rollers 8*a*.

Control according to this embodiment will be described below with reference to FIGS. 2 and 3.

Figure 2:
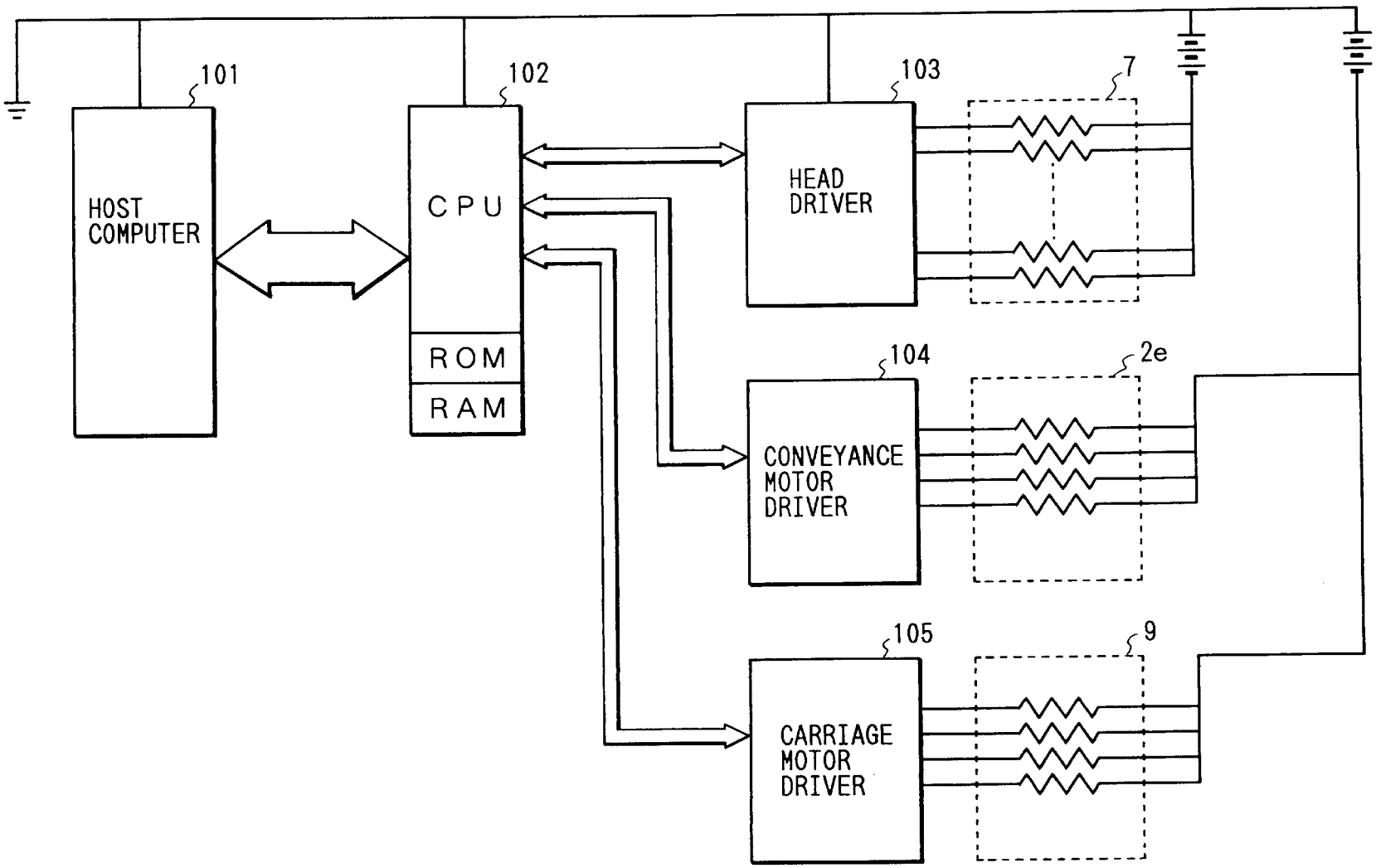
FIG. 2 is a block diagram showing an arrangement for driving a recording head, a recording sheet conveyance motor, and a carriage motor in the apparatus shown in FIG. 1.

FIG. 2 is a block diagram showing a control unit of the ink-jet recording apparatus shown in FIG. 1. The control unit includes a host computer 101 for supplying recording image data, and various control signals, and a CPU 102 for executing communication control with the host computer 101 and sequence control of the ink-jet recording apparatus of this embodiment, and mainly consisting of a known one-chip microcomputer including a ROM, a RAM, or the like. The control unit also includes a head driver 103 for driving the ejection energy generation means of the recording means 7, a conveyance motor driver 104 for driving the conveyance motor 2*e*, and a carriage driver 105 for driving the carriage motor 9.

Figure 3:
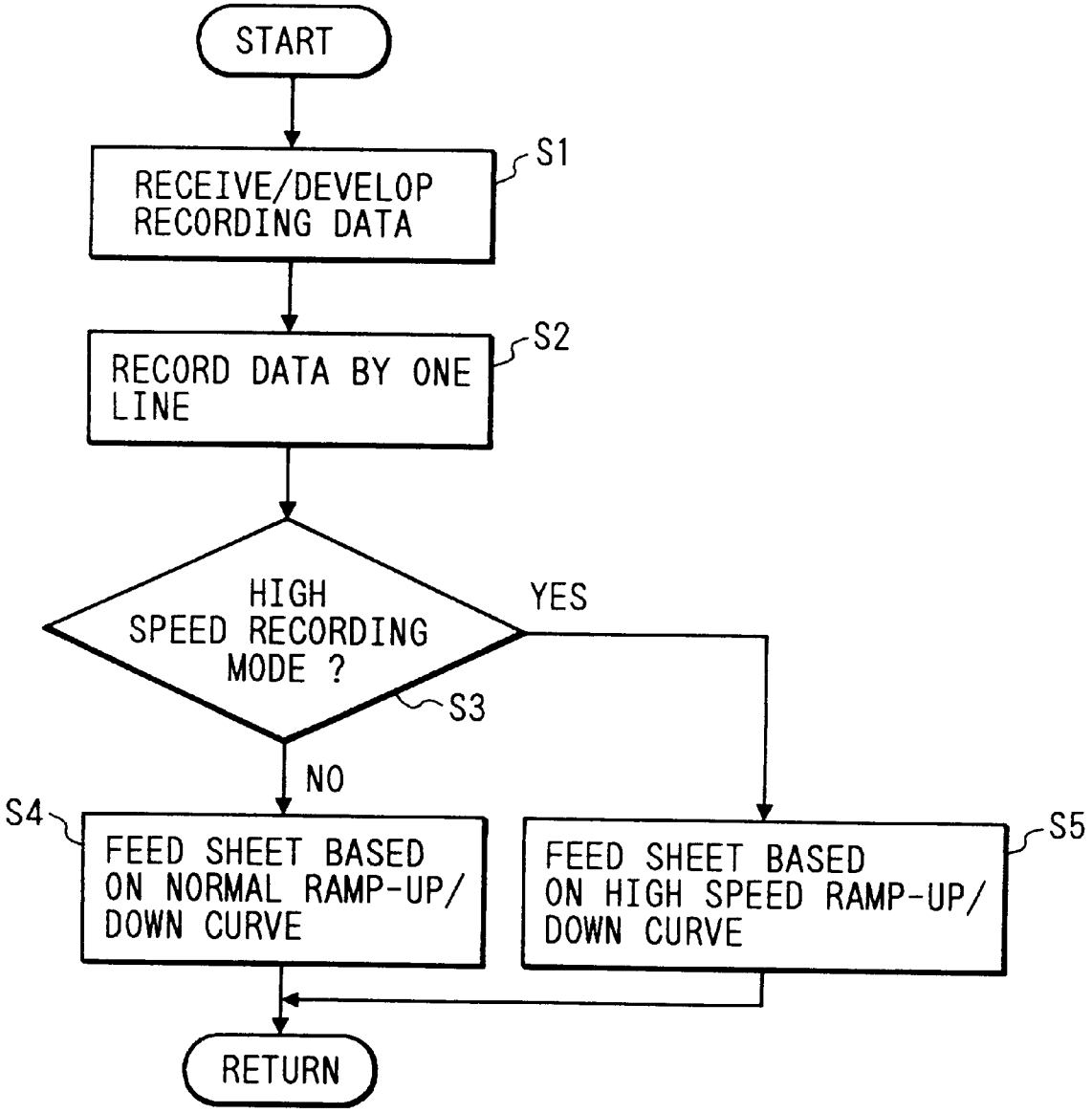
FIG. 3 is a flow chart showing a processing sequence according to the first embodiment of the present invention.

FIG. 3 is a flow chart showing the flow of control to be executed by the CPU 102 shown in FIG. 2, and a program according to this flow chart is stored in the ROM. In this embodiment, a recording mode includes a standard recording mode, and a high-speed recording mode (draft mode) for recording an image by thinning out half of ink droplets to be ejected (for this reason, the recording density of the recorded image is lowered, and the recording state slightly deteriorates). In these modes, the drive curve of the recording sheet conveyance motor 2*e* is changed. This control will be described in more detail below.

In step S1, the CPU 102 receives recording data sent from the host computer 101. After the data is received, data is recorded by one line in step S2. In this operation, the CPU 102 supplies a drive signal to the carriage motor driver 105 to drive the carriage motor 9, and at the same time, supplies a recording signal to the head driver 103 to drive the energy generation means of the recording head 7, thereby recording data for one line.

Upon completion of recording for one line, a sheet feed operation is performed to prepare for the recording operation for the next line. Prior to this operation, it is checked in step S3 if the current recording mode is the high-speed recording mode (draft mode). If NO in step S3, a sheet feed drive operation based on a normal ramp-up/down curve is executed in step S4.

Figure 4:
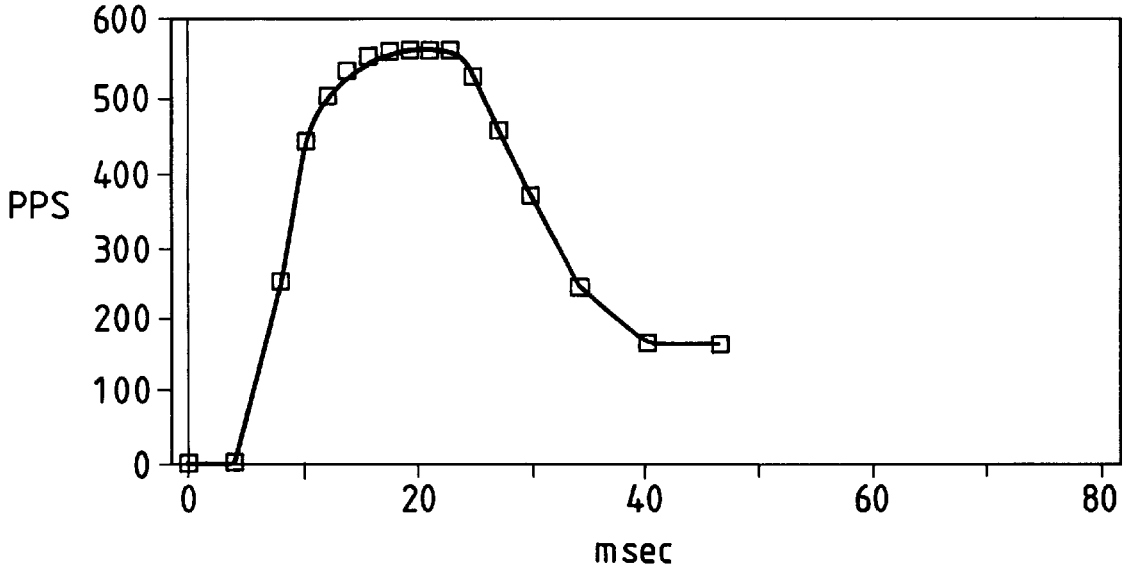
FIG. 4 is a graph showing a motor drive curve used in the first embodiment.

FIG. 4 shows the normal ramp-up/down curve. Referring to FIG. 4, elapsed time is plotted along the abscissa, the drive speed (unit: PPS (pulses/second)) of the conveyance motor 2*e* is plotted along the ordinate, and each □ mark indicates the speed for the elapsed time per step. That is, the conveyance motor 2*e* is driven to gradually increase its speed in the former seven steps, and is driven to decrease its speed in the latter seven steps. More specifically, a long phase excitation switching time is set initially, the shortest switching time is set after seven steps, and thereafter, the switching time is prolonged.

Figure 5:
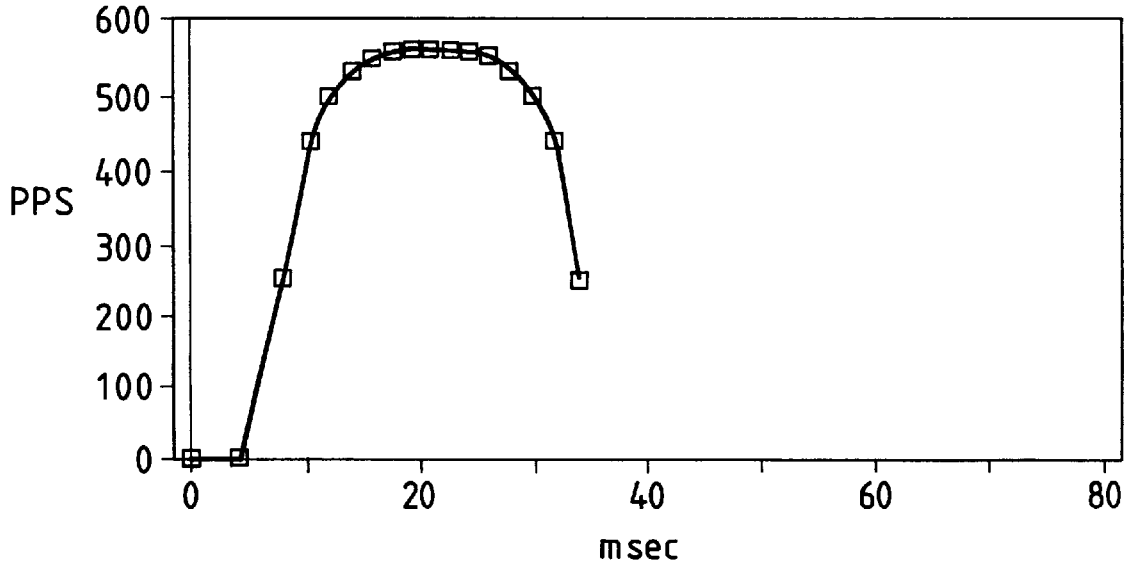
FIG. 5 is a graph showing another motor drive curve used in the first embodiment.

Referring back to the flow chart in FIG. 3, if it is determined in step S3 that the recording mode is the high-speed recording mode, a sheet feed drive operation based on a high-speed ramp-up/down curve which is different from the normal ramp-up/down curve is executed. FIG. 5 shows the high-speed ramp-up/down curve.

Referring to FIG. 5, although the total number of steps (the number of □ marks) is the same as that in the ramp-up/down curve shown in FIG. 4, the curve shown in FIG. 5 includes a curve pattern for rapidly decreasing the speed in the latter half thereof. As a result, upon comparison between the total elapsed times for the sheet feed operations, the control based on the curve in FIG. 4 requires about 47 msec, while the control based on the curve in FIG. 5 requires 35 msec. Therefore, in the high-speed recording mode, the sheet feed operation is completed very fast.

Upon comparison between the sheet feed drive operations based on the two different curves shown in FIGS. 4 and 5, as for precision, the sheet feed drive control based on the curve shown in FIG. 4 is advantageous due to the effect of a curve pattern for gradually decreasing the speed in a deceleration state, but as for the sheet feed speed (sheet feed time), the sheet feed drive control based on the curve shown in FIG. 5 is advantageous, as described above.

When the above-mentioned control shown in steps S2 to S5 is executed, a sheet feed operation which meets specific precision, speed, and noise requirements of the sheet feed control, can be performed in the normal recording mode. On the other hand, in the high-speed recording mode (draft mode) which does not require high precision, a high-speed sheet feed operation can be performed.

Note that the curve shown in FIG. 5 has the same highest speed as that of the curve shown in FIG. 4. However, for example, when the highest speed is set below the performance of the motor in consideration of a total balance since the precision and noise requirements are not satisfied upon formation of the curve shown in FIG. 4, the curve shown in FIG. 5 need not have the same highest speed as that of the curve shown in FIG. 4, and may have the highest speed higher than that of the curve shown in FIG. 4.

Figure 6:
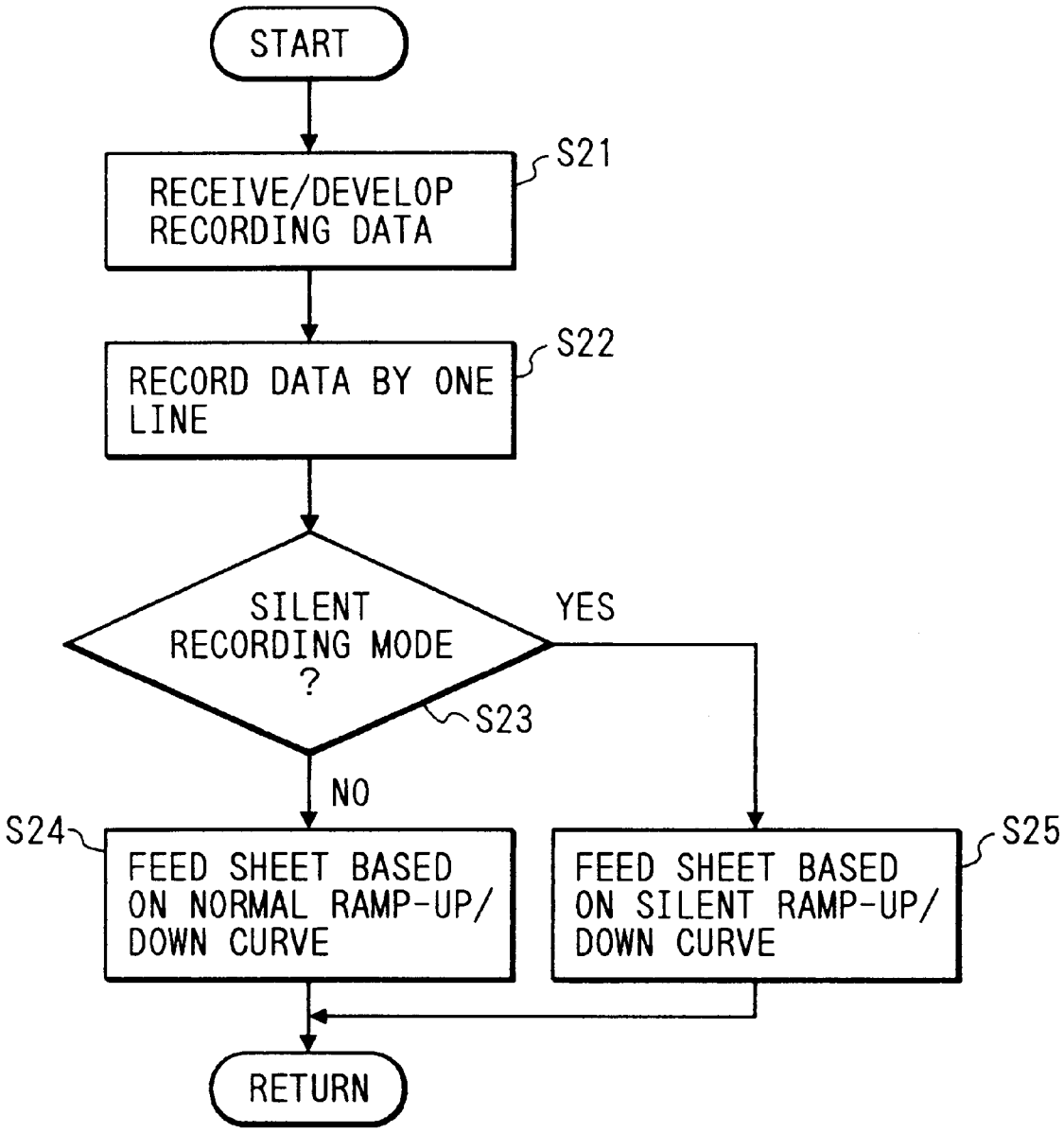
FIG. 6 is a flow chart showing a processing sequence according to a modification of the first embodiment of the present invention.
Figure 7:
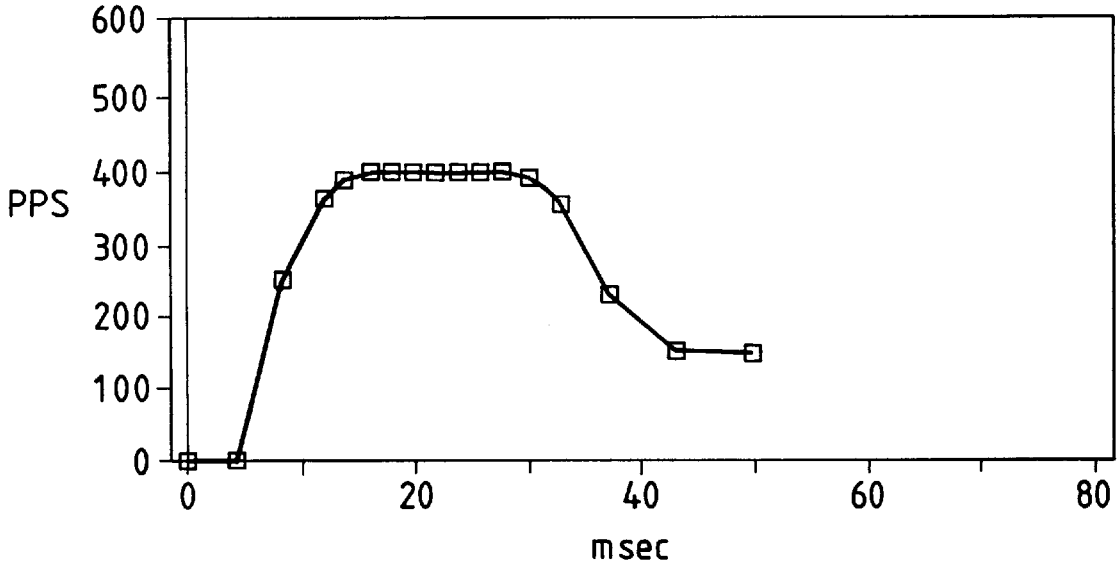
FIG. 7 is a graph showing a motor drive curve used in the modification of the first embodiment.

FIG. 6 is a flow chart showing a control sequence according to a modification of the first embodiment of the present invention, and FIG. 7 is a graph showing a conveyance motor drive curve of this modification.

In this modification, the recording mode includes the standard recording mode, and a silent recording mode with lower sheet feed noise. In these modes, the drive curve of the recording sheet conveyance motor 2*e* is changed. This control will be described in detail below.

In step S21 in FIG. 6, the CPU 102 receives recording data sent from the host computer 101. After the data is received, data is recorded by one line in step S22 as in the first embodiment. Upon completion of recording for one line, it is checked in step S23 if the current recording mode is the silent recording mode, i.e., a mode with low noise upon execution of the sheet feed operation. If NO in step S23, sheet feed control based on the normal ramp-up/down curve is executed in step S24. This normal ramp-up/down curve is the same as that shown in FIG. 4.

If it is determined in step S23 that the recording mode is the silent recording mode, sheet feed control based on a silent ramp-up/down curve is executed in step S25. FIG. 7 shows this silent ramp-up/down curve.

Although the total number of steps of the drive curve shown in FIG. 7 is the same as that of the ramp-up/down curve shown in FIG. 4, the highest speed of the curve shown in FIG. 7 is set to be lower than that of the curve shown in FIG. 4, i.e., 400 PPS.

Upon comparison between the sheet feed drive operations based on the two different curves shown in FIGS. 4 and 7, the curve shown in FIG. 4 is advantageous in terms of the sheet feed speed (sheet feed time), but the curve shown in FIG. 7 is advantageous in terms of noise.

The reason why the sheet feed drive control based on the curve shown in FIG. 7 is advantageous in terms of noise will be described below. Sheet feed noise is roughly classified into two kinds of noise: one is vibration noise generated by the drive motor, and the other is sheet rubbing noise.

In general, the drive motor generates large vibration noise at a low speed. On the other hand, when the motor is driven at a considerably high speed, it generates rasping high-frequency noise. The paper rubbing noise increases as the speed is increased. The drive frequency determined based on the balance between these kinds of noise is 400 PPS shown in FIG. 7. Therefore, the sheet feed drive control based on the curve shown in FIG. 7 has lower noise than the drive control based on the curve shown in FIG. 4 in which the highest speed exceeds 500 PPS.

With the above-mentioned control, in the normal recording mode, a sheet feed operation satisfying the precision requirement is performed, while in the silent recording mode which does not require high precision, a silent sheet feed operation can be performed although the precision is slightly lowered.

Note that the curve shown in FIG. 7 includes the same rising and falling curve patterns as those in the curve shown in FIG. 4. In order to attain a more silent sheet feed operation, the curve shown in FIG. 7 may include different rising and falling curve patterns from those in FIG. 4.

Figure 9:
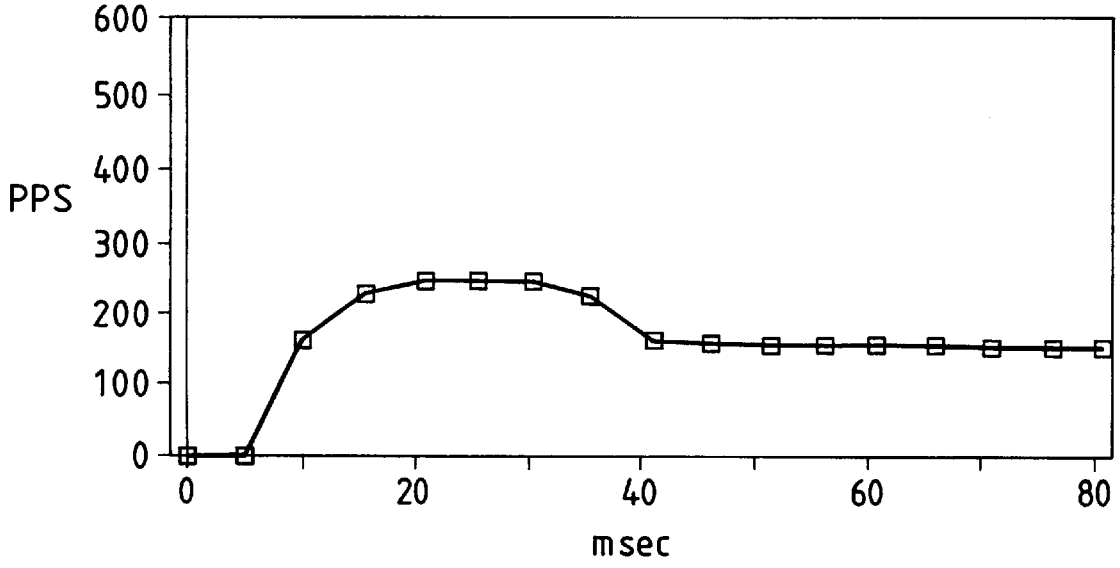
FIG. 9 is a graph showing a motor drive curve used in the modification of the first embodiment shown in FIG. 8.
Figure 8:
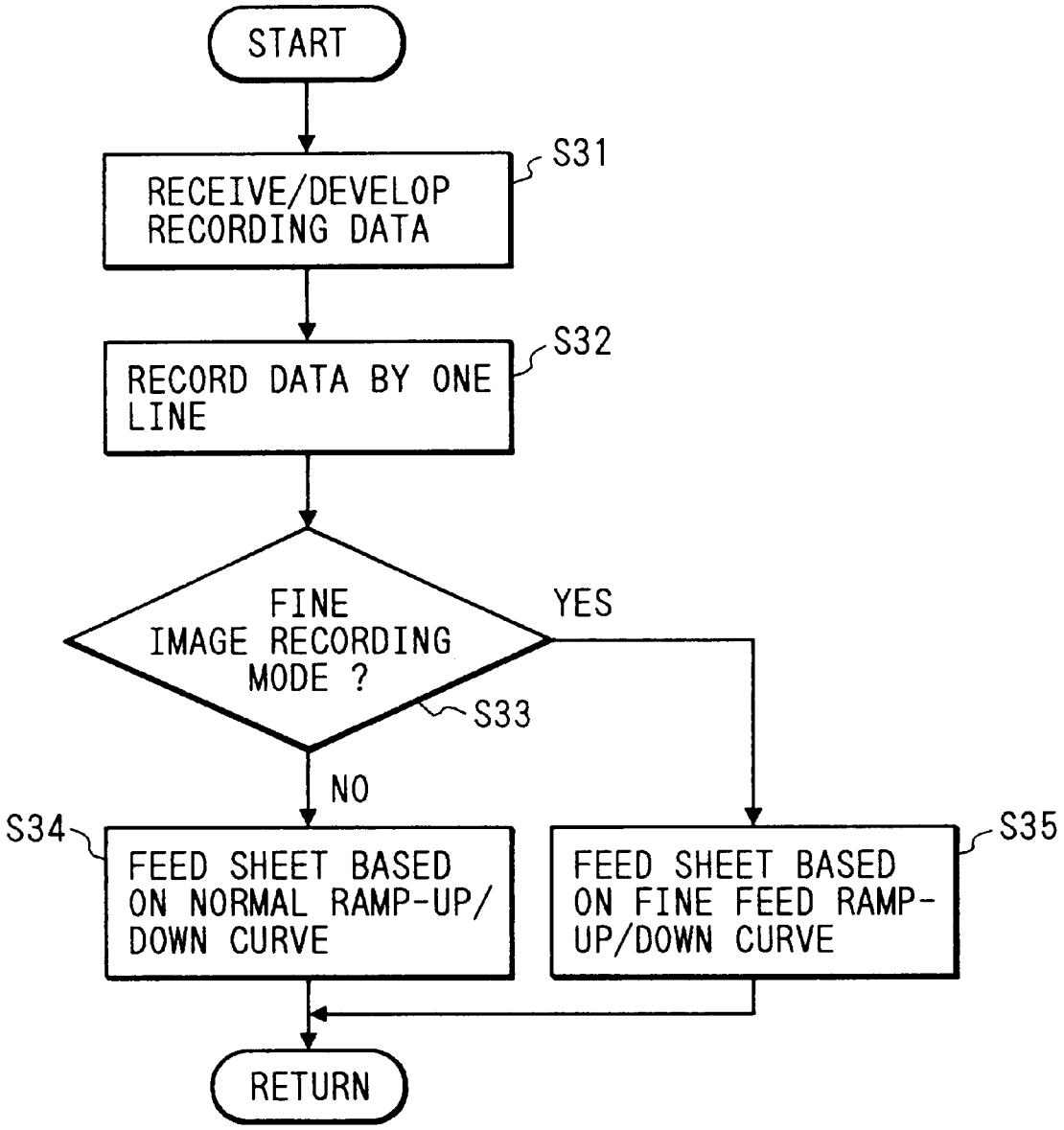
FIG. 8 is a flow chart showing a processing sequence according to another modification the first embodiment of the present invention.

FIG. 8 is a flow chart showing a control sequence according to another modification of the first embodiment of the present invention, and FIG. 9 is a graph showing a drive curve of the conveyance motor.

In this modification, the recording mode includes the standard recording mode, and a fine-image recording mode with high sheet feed precision. In these modes, the drive curve of the conveyance motor 2*e* is changed.

In step S31 in FIG. 8, the CPU 102 receives recording data sent from the host computer 101. After the data is received, data is recorded by one line in step S32 as in the first embodiment. Upon completion of recording for one line, a sheet feed operation is performed to prepare for recording for the next line. Prior to this sheet operation, it is checked in step S33 if the current recording mode is the fine-image recording mode. If NO in step S33, sheet feed control based on the normal ramp-up/down curve is executed in step S34. The normal ramp-up/down curve is the same as that shown in FIG. 4.

If it is determined in step S33 that the recording mode is the fine-image recording mode, sheet feed control based on a fine-feed ramp-up/down curve is executed in step S35. FIG. 9 shows the fine-feed ramp-up/down curve.

Although the total number of steps of this drive curve shows the same tendency as that of the ramp-up/down curve shown in FIG. 4, the highest speed of the curve shown in FIG. 9 is set to be lower than that shown in FIG. 4, and a curve pattern for setting a constant speed is included after a rising curve pattern.

Upon comparison between the sheet feed drive operations based on the two different curves shown in FIGS. 4 and 9, the curve shown in FIG. 4 is advantageous in terms of the sheet feed speed, but as far as feed precision is concerned, the sheet feed control with high precision can be attained when the curve shown in FIG. 9 is used. Note that the curve shown in FIG. 9 includes a curve pattern for setting a constant speed (160 PPS) from its middle portion. The constant speed is set based on measurement results of sheet feed precision at a plurality of speeds.

With the above-mentioned control, in the normal recording mode, the sheet feed operation satisfying various precision, speed, and noise requirements is performed, while in the fine-image recording mode which does not require a high feed speed, a sheet feed operation with high feed precision can be performed although the sheet feed speed is slightly lowered.

Second Embodiment

Figure 10:
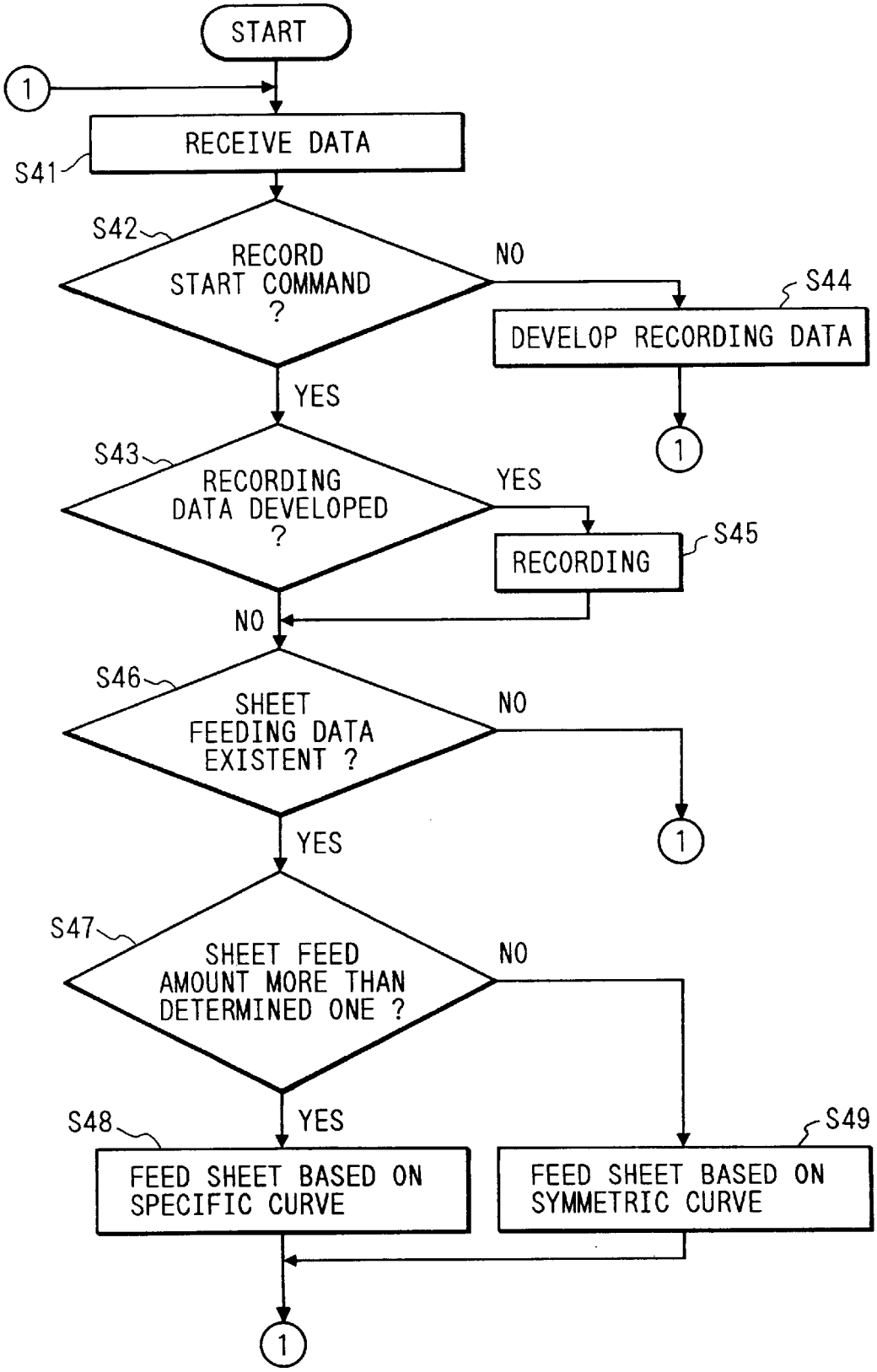
FIG. 10 is a flow chart showing a processing sequence according to the second embodiment of the present invention.

FIG. 10 is a flow chart showing a processing sequence according to the second embodiment of the present invention. The processing of this embodiment is executed by the same apparatus and control arrangement as those described in the first embodiment. In the first embodiment, the drive curve of the recording sheet conveyance motor is changed in correspondence with the high-speed recording mode, the silent recording mode, the fine-image recording mode, and the like. However, in this embodiment, the drive curve of the recording sheet conveyance motor 2*e* is changed in accordance with the conveyance amount of the recording sheet.

Referring to FIG. 10, in step S41, data sent from the host computer 101 is received. After the data is received, it is checked in step S42 if the data is a record start command including a sheet feed command. If YES in step S42, it is checked in step S43 if non-recorded recording data is left in a developed state. On the other hand, if it is determined in step S42 that the sent data is simple recording data, the data is developed on a predetermined recording area in step S44, and the flow returns to step S41 to execute data reception processing.

As a result of checking in step S43 if non-recorded recording data is left in a developed state, if it is determined that no recording data is left, it is checked in step S46 if sheet feeding data exists. If it is determined in step S43 that recording data is left, a recording operation is performed based on the data in step S45, and thereafter, decision step S46 is executed; if it is determined in step S43 that no recording data is left, decision step S46 is immediately executed.

If it is determined in step S46 that no sheet feeding data exists, the flow returns to the processing in step S41. If it is determined in step S46 that sheet feeding data exists, it is checked in step S47 if the sheet feeding data indicates a sheet feed amount equal to or larger than a predetermined amount. If it is determined in step S47 that the sheet feeding data indicates a sheet feed amount equal to or larger than the predetermined amount (including a normal sheet feed amount), a sheet feed operation is performed based on a drive curve which places relatively high importance on sheet feed precision, speed, noise, and the like, and includes asymmetrical rising and falling curve patterns, in step S48. As this drive curve, the above-mentioned drive curve shown in FIG. 4 can be used.

Figure 11:
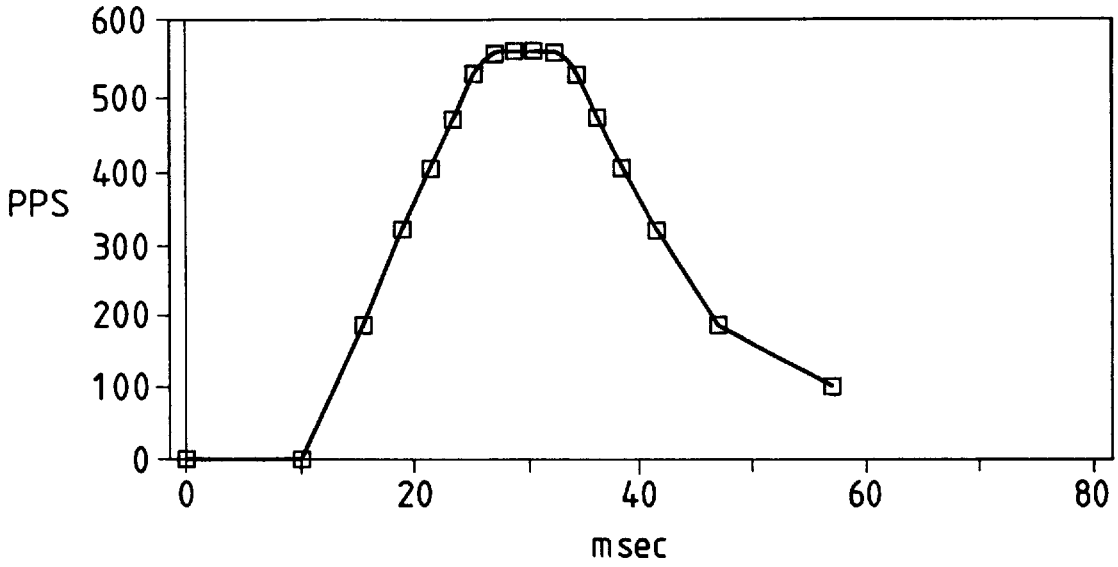
FIG. 11 is a graph showing a motor drive curve used in the second embodiment.
Figure 12:
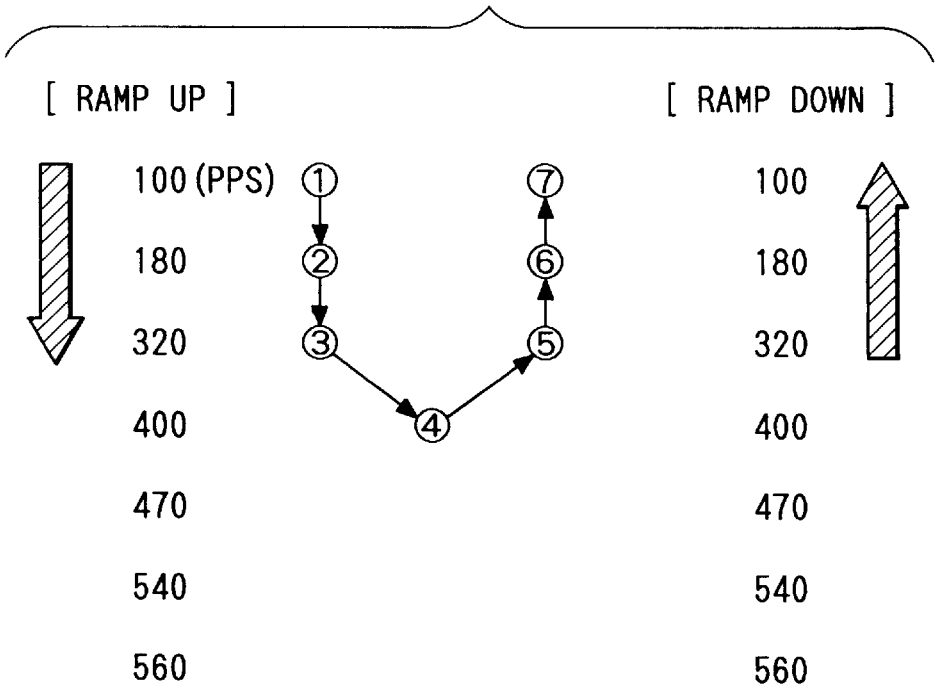
FIG. 12 is an explanatory view of a drive table for realizing the drive curve of the second embodiment.

If it is determined in step S47 that the sheet feed amount is less than the predetermined amount, a sheet feed operation is performed based on a drive curve including symmetrical rising and falling curve patterns, as shown in FIG. 11, in step S49. FIG. 12 shows a drive table for realizing this drive curve.

The predetermined sheet feed amount includes 14 steps when the drive curves shown in FIGS. 4 and 11 are used as in this embodiment. The sheet feed operation defined by less than 14 steps corresponds to that executed in step S49.

More specifically, FIG. 12 shows a case wherein a feed amount for six steps is set. In this case, in general, since an excitation in the first step drives the motor from a phase located at the beginning of driving, if the feed amount for six steps is set, seven excitations (① to ⑦ in FIG. 12) are performed. As shown in FIG. 12, in a ramp-up state, the pulse rates on the table are sequentially switched downward, and in a ramp-down state, the pulse rates on the table are sequentially switched upward. The above-mentioned seven switching operations are sequentially performed in the order of ①→⑦, as shown in FIG. 12. More specifically, since the drive curve shown in FIG. 11 includes the same ramp-up/down table portions, it can execute drive control so that the speed returns from a half ramp-up position in the reverse direction by utilizing symmetrical portions of the table.

With the above-mentioned drive control in step S47 and subsequent steps, the sheet feed operation of the predetermined amount or more used in the normal sheet feed operation can satisfy precision, speed, and noise requirements. When the sheet feed operation of less than the predetermined amount is performed, a drive curve including symmetrical rising and falling curve patterns is partially utilized in correspondence with the sheet feed amount, i.e., the number of steps. For this reason, a sheet feed operation of any feed amount, which can satisfy the sheet feed speed and noise requirements to some extent, can be attained by simple control.

In this embodiment, a small number of pulses is set, i.e., each of ramp up and down curve patterns consists of seven steps. As the number of steps is increased, the effect of simplifying control, and the effect of satisfying the sheet feed speed, precision, and noise requirements can be enhanced.

In this embodiment, the number of drive curves used when the sheet feed amount is equal to or larger than the predetermined amount is only one shown in FIG. 4. However, for example, a plurality of curves such as a precision priority specific curve, a speed priority specific curve, and the like may be prepared. Alternatively, as specific curves used when the sheet feed amount is equal to or larger than the predetermined amount, two different curves, e.g., a curve used when the sheet feed amount is equal to or larger than a first predetermined amount, and a curve used when the sheet feed amount is equal to or larger than a second predetermined amount may be used. On the other hand, the general curve shown in FIG. 11 used when the sheet feed amount is less than the predetermined amount may be classified into two stages, and two different curves may be used.

Figure 13:
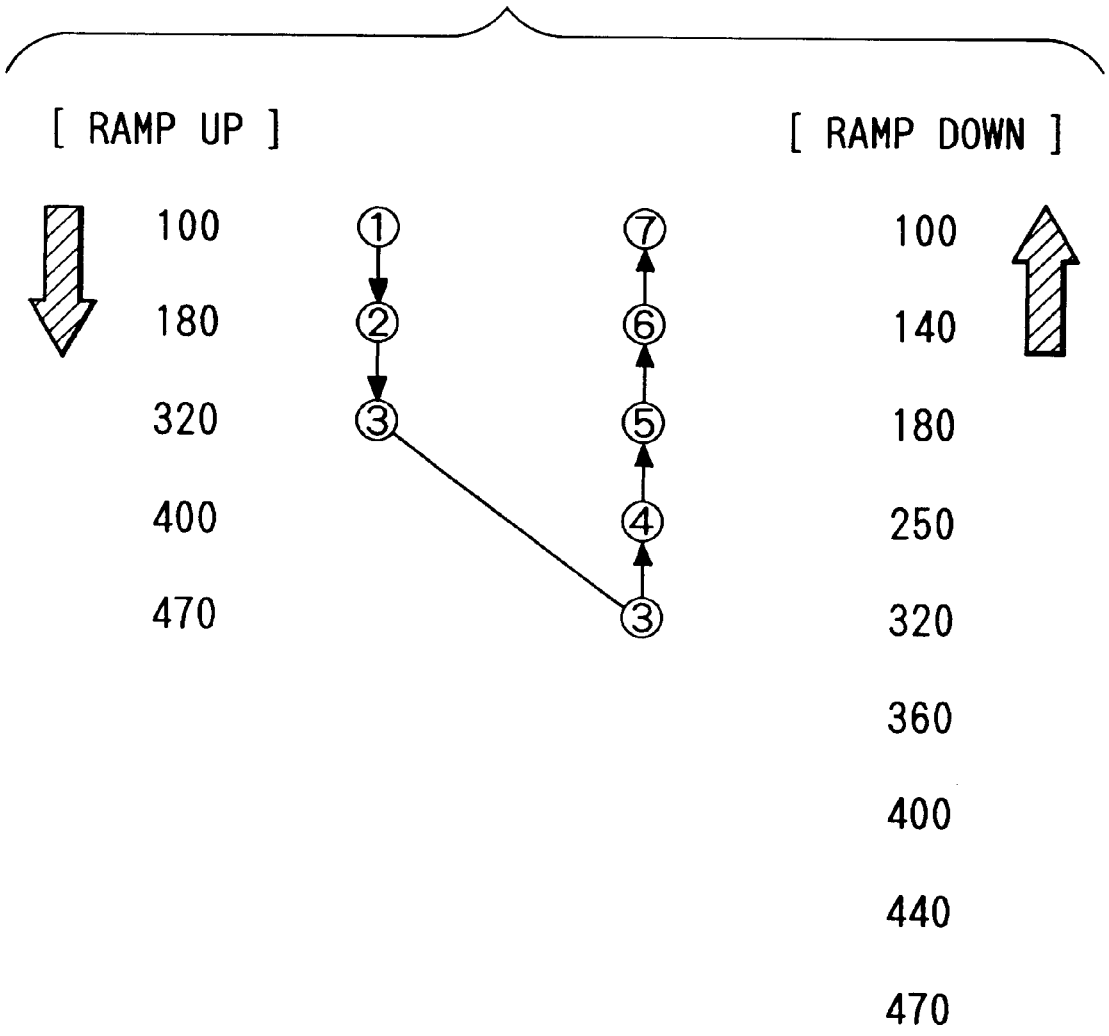
FIG. 13 is an explanatory view of a drive table used in a modification of the second embodiment of the present invention.

A drive table shown in FIG. 13 is associated with a modification of the second embodiment of the present invention.

In this modification, as can be understood from FIG. 13, in a ramp-down state, the speed is decreased at a rate about ½ of that in the ramp-up state. In this case, control is made in such a manner that a portion of the ramp-up table is used up to a timing about ⅓ of the feed amount defined by the drive curve shown in FIG. 11, and the remaining feed operation is performed according to another ramp-down table. More specifically, although excitations are switched in the order of ①→⑦ shown in FIG. 13, the two tables include a pulse rate of 320 PPS indicated by the excitation ③, and this pulse rate corresponds to the highest speed.

In this embodiment, when the motor is stopped, the speed is slowly decreased as compared to the second embodiment. Therefore, the feed precision, and the like can be further improved.

Third Embodiment

In the third embodiment of the present invention, the above-mentioned conveyance motor drive control of the second embodiment is applied to drive control of the carriage motor.

Figure 14:
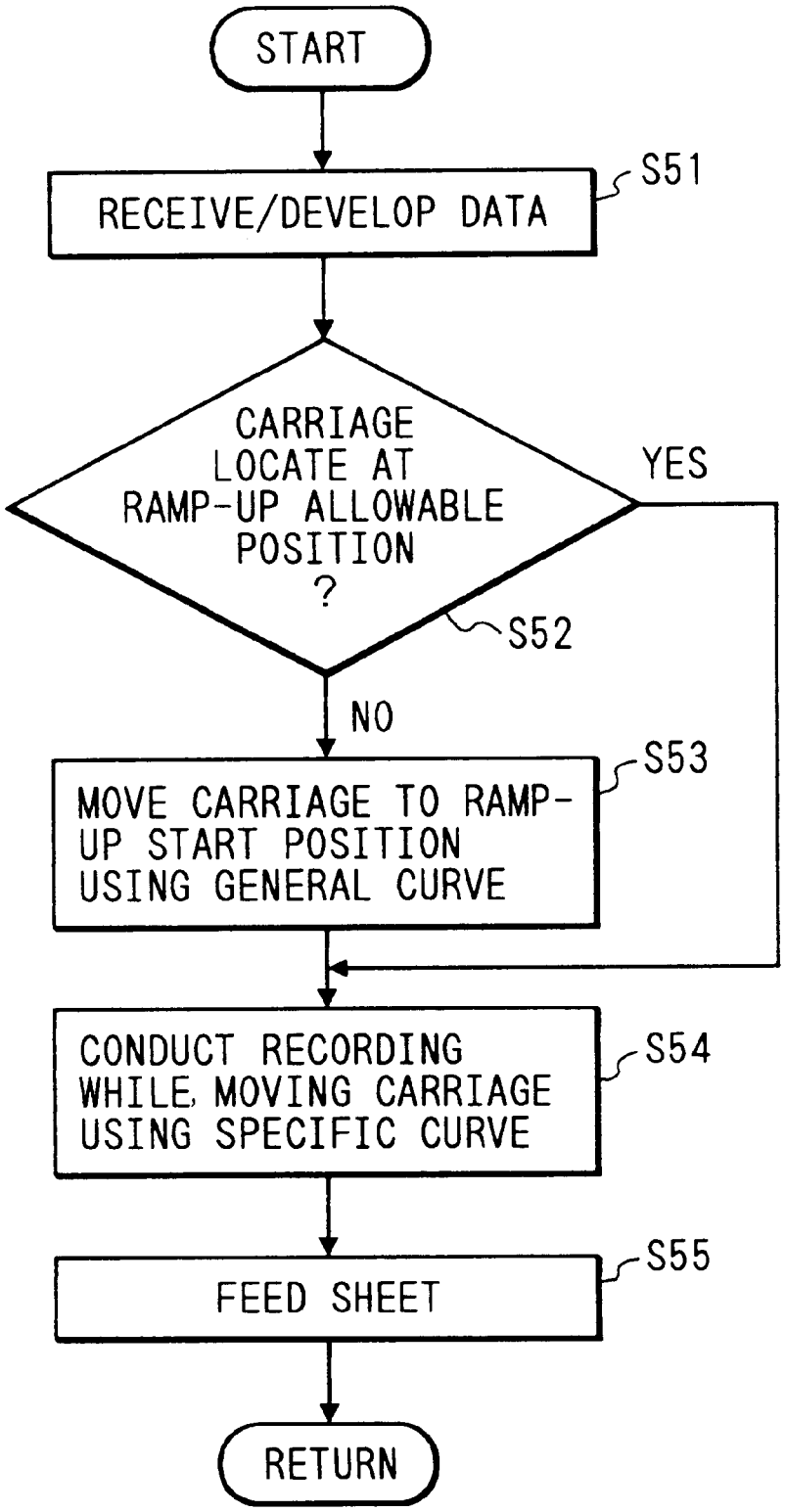
FIG. 14 is a flow chart showing a processing sequence according to the third embodiment of the present invention.

FIG. 14 is a flow chart showing a processing sequence according to this embodiment. This processing will be described below.

In step S51 in FIG. 14, data sent from the host computer 101 is received, and is developed in a recordable state. It is checked in step S52 if the current position of the carriage which carries the recording means (recording head) is a position where the carriage can be moved from that position in a ramp-up mode to the recording start position so as to allow recording. For example, when the current position is located at the side of the recording region of the recording start position, or when the current position is located before the recording start position, and the ramp-up distance cannot be assured, it is determined that the carriage is currently located at a ramp-up unallowable position.

If it is determined in step S52 that the current position is a position where it is impossible to start recording in the ramp-up mode, the carriage is moved to a ramp-up start allowable position for recording in step S53. The moving distance in this case includes various distances, and may be shorter than a moving distance using a ramp-up/down curve for recording. For this reason, the carriage is moved using a general curve which can be used even for any short distance. This general curve is the same as the drive curve shown in FIG. 11 of the second embodiment related to the conveyance motor, i.e., the drive curve including symmetrical ramp-up and ramp-down curve patterns.

If it is determined in step S52 that the carriage is located at a position where it is possible to start recording in the ramp-up mode, processing in step S54 is executed. In step S54, the carriage is moved to the recording start position using a specific ramp-up curve, and recording is then performed at a constant speed. Thereafter, the carriage is stopped using a specific ramp-down curve. Upon completion of recording, a sheet feed operation is performed in step S55.

Note that the specific curve is the same as that in FIG. 4 in the first embodiment.

The carriage drive control for less than the predetermined distance using the general curve is the same as that described above with reference to FIG. 12 in the second embodiment, and a detailed description thereof will be omitted.

The carriage motor drive control may be executed using the drive curve shown in FIG. 13 in place of FIG. 11.

Fourth Embodiment

The fourth embodiment of the present invention will be described hereinafter.

Figure 15:
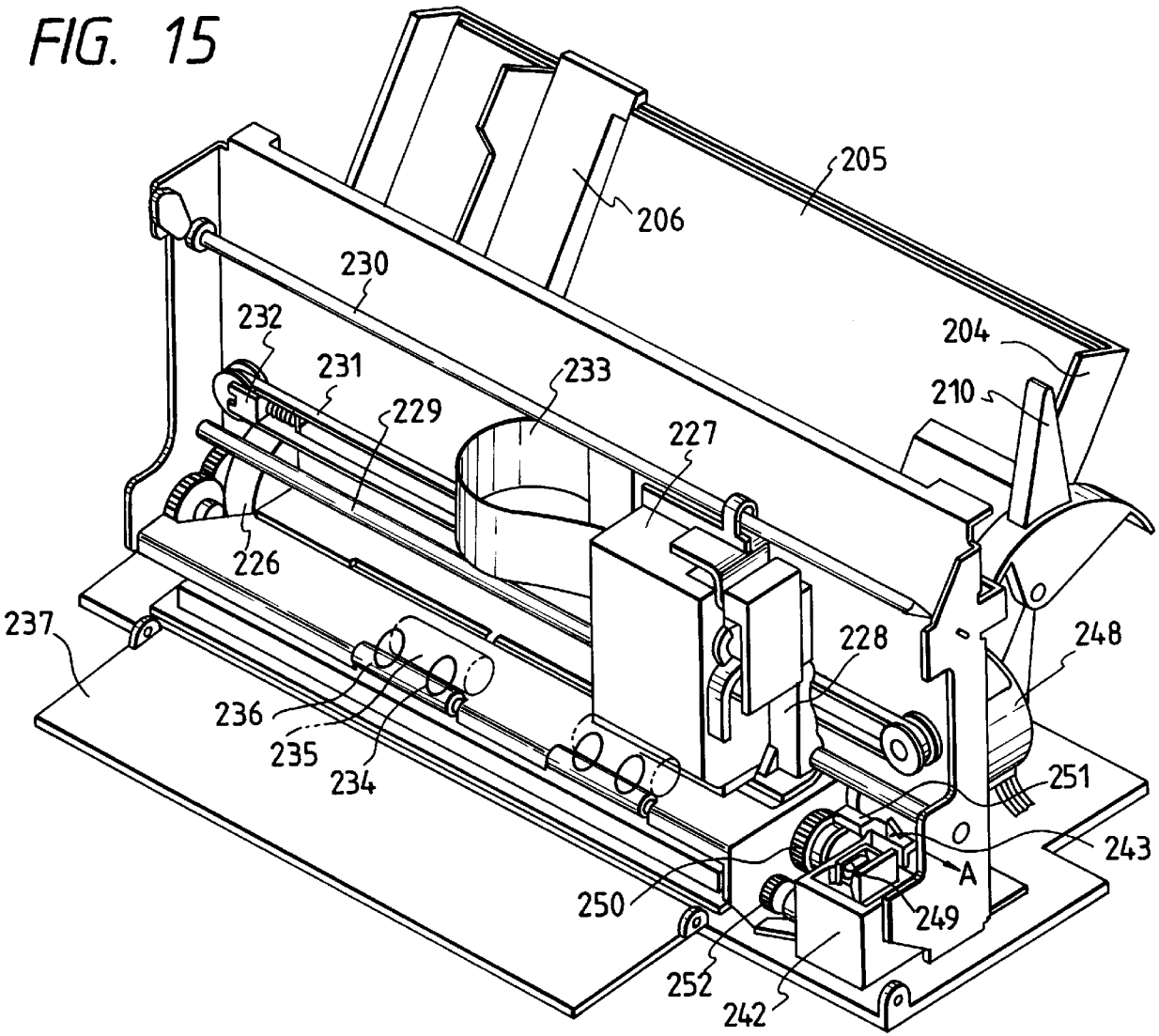
FIG. 15 is a perspective view showing the overall arrangement of a serial recording apparatus.
Figure 16:
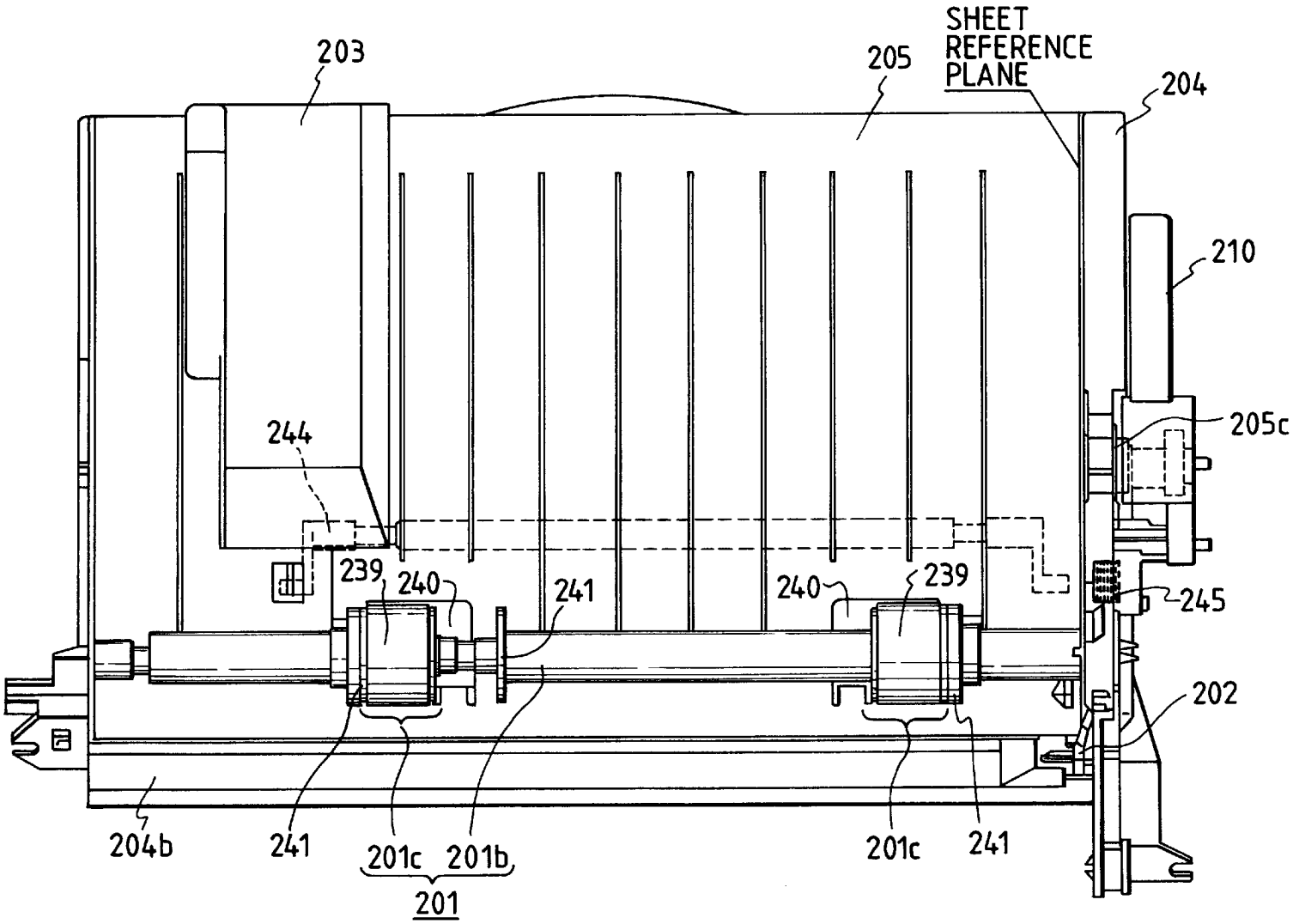
FIG. 16 is a front view of a sheet supply unit.

The overall arrangement of a recording apparatus to which the present invention is applied will be described below with reference to the perspective view in FIG. 15 and the front view of a sheet supply unit in FIG. 16.

A sheet supply unit is attached to the main body to be inclined at an angle of 30° to 60°, and a set recording sheet is exhausted horizontally after a print operation.

The sheet supply unit comprises sheet supply rollers 201, a separation pawl 202, a movable side guide 203, a base 204, a pressure plate 205, a pressure plate spring, a drive gear, a release cam, a pawl spring, a releasing cam (none of components without reference numerals are shown), a releasing lever 210, and the like. Normally, since the release cam pushes down the pressure plate 205, a recording sheet is separated from the sheet supply rollers 201.

When a recording sheet is set, the drive force of conveyance rollers is transmitted to the sheet supply rollers 201 and the release cam via a drive gear. When the release cam is separated from the pressure plate 205, the pressure plate 205 is moved upward, and the sheet supply rollers 201 are brought into contact with the recording sheet. Upon rotation of the sheet supply rollers 201, a recording sheet is picked up, and is separated one by one by the separation pawl 202. The separated recording sheet is fed to a sheet feed unit. The sheet supply rollers 201 and the release cam complete one revolution until they completely feed the recording sheet to the sheet feed unit. When the pressure plate 205 is released from the sheet supply rollers 201, the drive force from the sheet supply rollers 201 is stopped, thus holding this initial state.

The sheet feed unit comprises conveyance rollers, pinch rollers, a pinch roller guide, a pinch roller spring, a PE sensor lever, a PE sensor, a PE sensor spring, an upper guide, a platen (none of them are shown), and the like. The recording sheet fed to the sheet feed unit is fed to the roller pairs of conveyance rollers and pinch rollers using the platen, the pinch roller guide, and the upper guide as guides. The PE sensor lever is arranged in front of these roller pairs. The PE sensor detects the leading end of the recording sheet upon displacement of the PE sensor lever, and the print position on the recording sheet is determined in accordance with the detection result.. When the pinch roller guide is biased by the pinch roller spring, the pinch rollers are pressed against the conveyance rollers, thereby generating a conveyance force of the recording sheet. The recording sheet fed by the roller pairs moves along the platen upon rotation of the roller pairs by an LF motor (conveyance motor) 226, and is subjected to recording based on predetermined image information by a recording head 227.

The recording head 227 is an exchangeable ink-jet recording head, which is integrated with an ink tank. The recording head 227 comprises electrical converters, and ejects an ink from ejection orifices by utilizing a change in pressure caused by growth and shrinkage of bubbles formed by film boiling generated upon application of heat energy, thus attaining recording.

A carriage unit is constituted by a carriage 228 on which the recording head 227 is mounted, a guide shaft 229 for reciprocally scanning the carriage 228 in a direction perpendicular to the conveyance direction of the recording sheet, a guide 230 for holding the rear end of the carriage 228 to maintain a certain interval between the head and the sheet, a timing belt 231 for transmitting the drive force of a carriage motor 248 to the carriage 228, idle pulleys 232 between which the timing belt 231 is looped, a flexible circuit board 233 for supplying a head drive signal from an electrical circuit board to the recording head 227, and the like. When the recording head 227 is scanned integrally with the carriage 228, it forms an image on the recording sheet conveyed along the platen.

An exhaust unit is provided with exhaust rollers 234, transmission rollers 235 for transmitting the drive force of the conveyance rollers to the exhaust rollers 234, spurs 236 for assisting the exhaust operation, and an exhaust tray 237. The recording sheet is exhausted onto the exhaust tray by the exhaust rollers 234 and the spurs 236 without staining an image thereon.

A cleaning unit is constituted by a pump 242 for cleaning the recording head 227, a cap 249 for preventing the recording head 227 from being dried, and a drive switching lever 243 for switching the drive force from the conveyance rollers to the sheet supply unit and the pump 242. In a state other than a sheet supply cleaning mode, the drive switching lever 243 is located at a position illustrated in FIG. 15, and fixes a planetary gear (not shown), which is rotated about the central axis of the conveyance rollers, in a predetermined position. For this reason, the drive force of the conveyance rollers is not transmitted to the pump 242 and the sheet supply unit. When the drive switching lever 243 is moved in the direction of an arrow A by moving the carriage 228, the planetary gear moves according to the forward or reverse rotation of the conveyance rollers. Upon forward rotation of the conveyance rollers, the drive force is transmitted to the sheet supply unit; upon reverse rotation of the conveyance rollers, the drive force is transmitted to the pump 242.

The LF motor 226 for driving the conveyance rollers, and the like, and the carriage motor 248 for driving the carriage 228 comprise stepping motors, which are rotated by a predetermined angle in accordance with signals supplied from drivers (to be described later).

Sheet feed control of the present invention will be described below with reference to FIGS. 17 to 21B.

Figure 17:
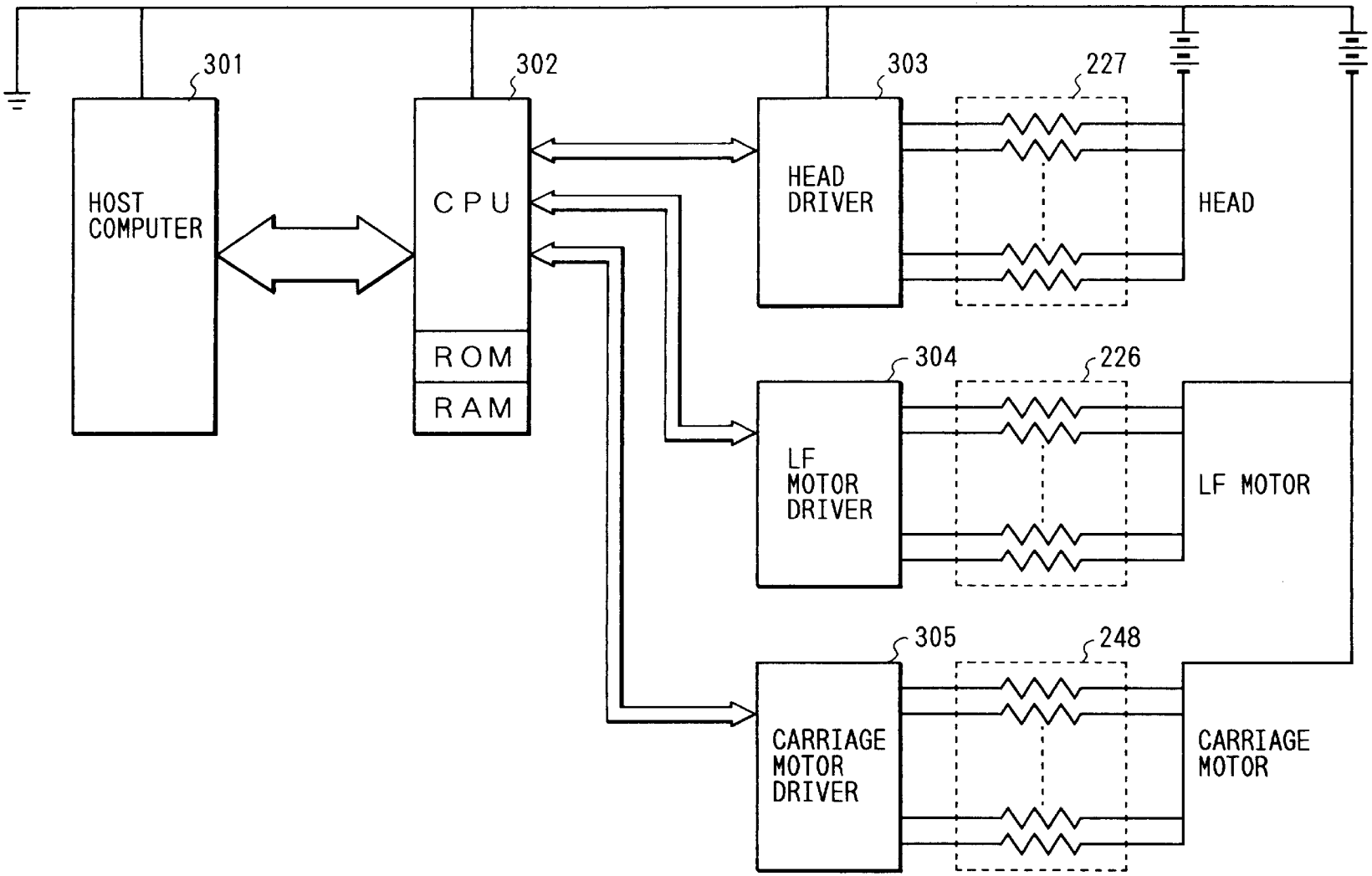
FIG. 17 is a block diagram showing a control arrangement according to the fourth embodiment of the present invention.
Figure 18:
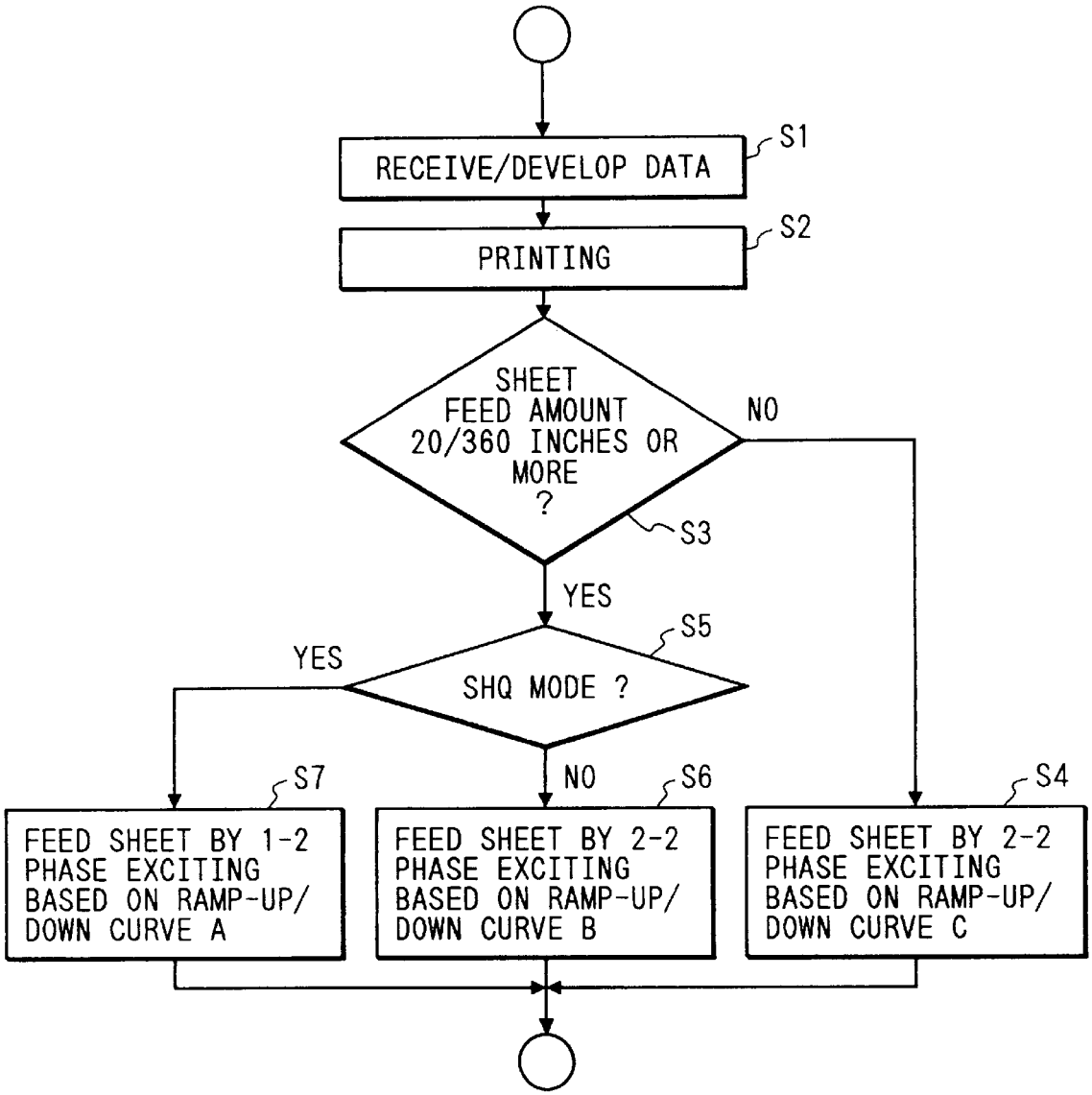
FIG. 18 is a flow chart showing sheet control.
Figures 19A, 19B:
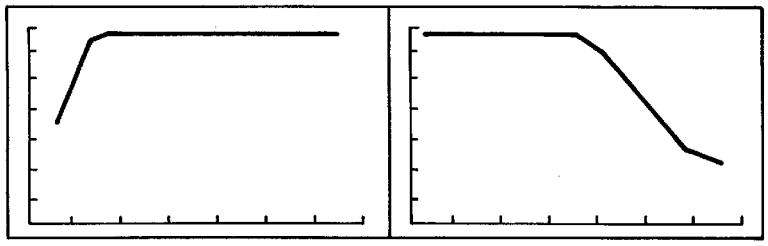
FIGS. 19A and 19B show a sheet feed control table.
Figures 20A, 20B:
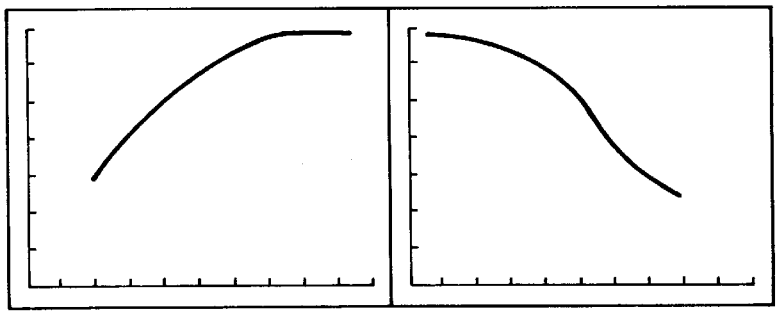
FIGS. 20A and 20B show another sheet feed control table.
Figures 21A, 21B:
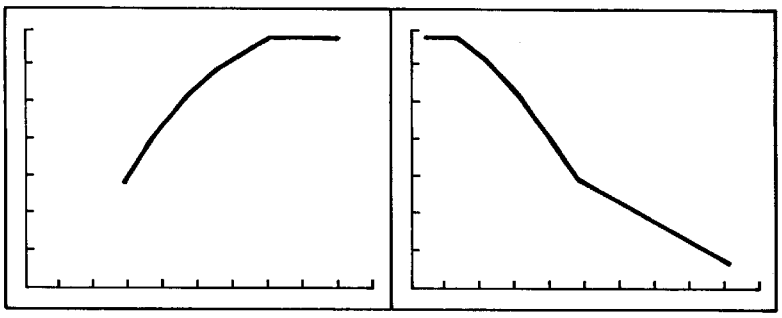
FIGS. 21A and 21B show still another sheet feed control table.

FIG. 17 is a block diagram showing a circuit arrangement of the fourth embodiment. Data sent from a host computer 301 is received by a controller 302 having a CPU, and the like. Drivers 303, 304, and 305 respectively drive the recording head 227, the conveyance motor 226, and the carriage motor 248.

The ink-jet recording apparatus according to this embodiment has three print speed modes, i.e., a standard print speed mode (to be referred to as an HQ mode hereinafter) with a full performance of the recording head, a high-speed mode (to be referred to as an HS mode hereinafter) with a slightly deteriorated recording state (since a print operation is performed while thinning out ink droplets to be ejected, the print density is lowered), and a fine-image, low-noise mode (to be referred to as an SHQ mode hereinafter) corresponding to the current circumstance requiring high-quality printing.

FIG. 18 and FIGS. 19A to 21B are respectively a flow chart and tables for explaining sheet feed control. The control will be described below with reference to these figures.

After reception/development of data (step S1) and printing (step S2), it is checked if the sheet feed amount is equal to or larger than 20/360 inches (step S3). In this step, since the sheet feed amount is defined by one pulse=1/360 inches, it is checked whether a sheet feed operation of 20 pulses or more or a fine sheet feed operation of less than 20 pulses is performed.

In the case of the fine sheet feed mode, a ramp-up operation corresponding to about a half feed amount is performed according to a general curve C (FIG. 21B) using a portion up to the middle of a ramp-up table, and a ramp-down operation corresponding to the remaining half feed amount is performed using a portion after the middle of a ramp-down table, in step S4.

If the fine sheet feed mode is not selected, it is checked if the SHQ mode is selected (step S5). If NO in step S5, a sheet feed operation is performed by a 2-2 phase exciting method based on a table B (FIG. 20A) (step S6). In this case, the sheet feed operation is performed at a high speed. However, if YES in step S5, a sheet feed operation is performed by a 1-2 phase exciting method based on a table A (FIG. 19A) (step S7). In this case, although the sheet feed speed is low, a low-noise, high-precision sheet feed operation can be attained.

As a result, the sheet feed operation in the SHQ mode is performed by the normal 1-2 phase exciting method, and when the sheet feed amount is less than 20 pulses, the sheet feed operation is performed by the 2-2 phase exciting method.

As described above, this embodiment is characterized in that ① different tables are used in the fine sheet feed mode and the normal mode, and ② a ramp-up constant and exciting method (1-2 phase) which can attain low-noise, high-precision control are adopted in the SHQ mode compared to the HQ and HS modes.

More specifically, this embodiment has at least one specific rising/falling speed curve, and at least one general rising/falling speed curve so as to control the sheet feed amount equal to or larger than a predetermined amount, and control based on the general speed curve is executed using a portion up to the middle of the rising pattern of the speed curve, and a portion from the middle of the falling pattern in accordance with the feed amount.

According to this control, when a sheet is conveyed by a predetermined amount which is normally used, ideal rising/falling control can be attained, and the precision, speed, and noise requirements can be satisfied. On the other hand, even when a sheet is conveyed by an amount less than the predetermined amount, the single curve can be used for any conveyance amount, and drive control which can solve the problem of noise generated upon driving at a constant pulse rate, and the problem of speed can be realized.

Also, the drive speed is controlled in different modes in accordance with a plurality of image recording modes.

When the image recording mode is a silent image recording mode, the drive method of the sheet drive means is controlled in a mode placing an importance on noise.

When the image recording mode is a fine-image recording mode (SHQ mode), the drive method of the sheet drive means is controlled in a mode placing an importance on the conveyance precision.

According to this embodiment, upon relative movement between the recording means and the sheet, drive control matching with the image recording mode can be executed. In the silent image recording mode, sheet conveyance control with low conveyance noise can be attained, and in the fine-image recording mode, sheet conveyance control with high conveyance precision can be attained.

Fifth Embodiment

Carriage drive control according to the image recording mode can be performed in addition to the above-mentioned recording sheet conveyance control according to the image recording mode. Skip and high-speed return control of this embodiment will be described below with reference to FIGS. 22A to 23.

Figure 22A:
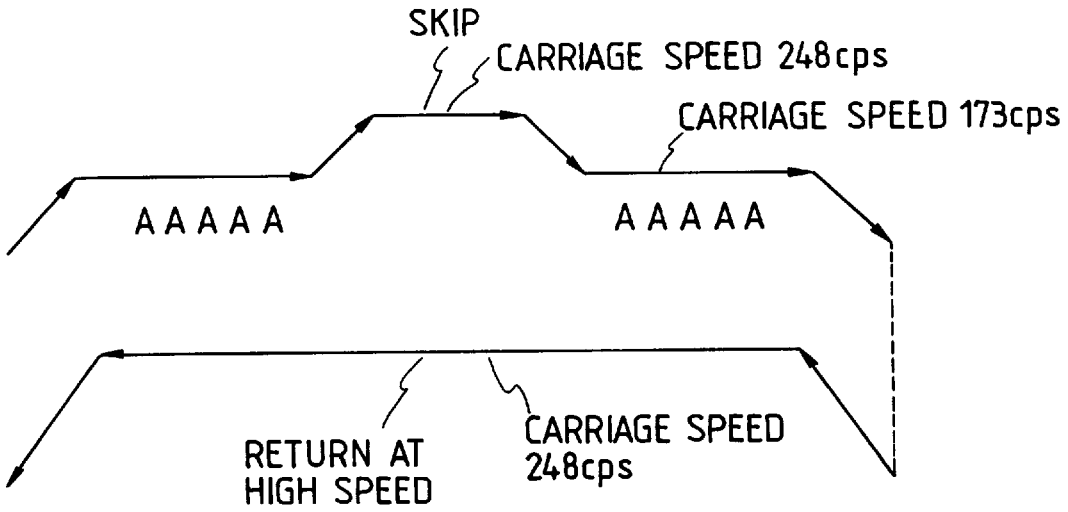
FIGS. 22A and 22B are explanatory views of carriage control.
Figure 22B:
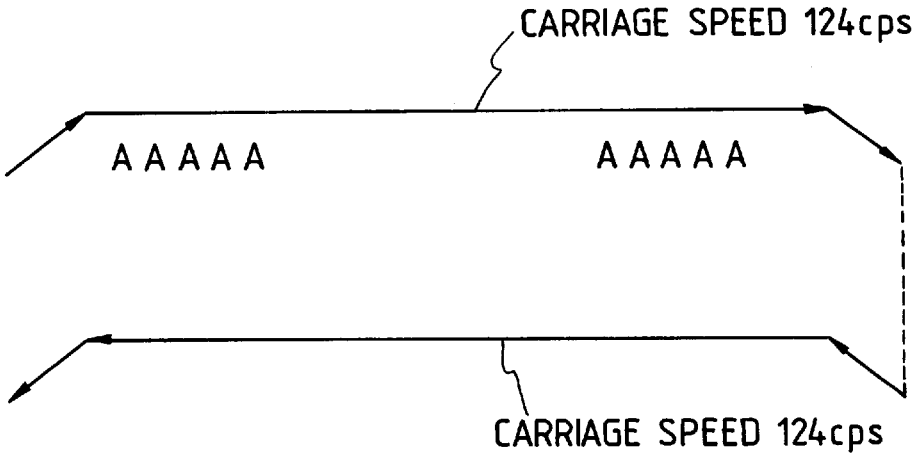

In the HQ mode, in order to increase the print speed as a whole, the following two speed switching operations are performed in carriage control:

① Skip Operation: As shown in FIG. 22A, when one-line print data includes a large blank portion, a series of blocks (five A's in the former half in FIG. 22A) are printed at 173 cps, and thereafter, the speed is switched. In this case, the speed is gradually changed from the print speed of 173 cps to 248 cps. After the carriage is moved at this speed by a predetermined amount, the speed is gradually returned to 173 cps. In this manner, another series of blocks (five A's in the latter half in FIG. 22A) are printed at a print speed of 173 cps.

② High-speed Return Operation: As shown in FIG. 22A, the carriage is returned at a high speed, i.e., 248 cps if no printing is performed.

According to the above-mentioned control, although the print speed improves, since the carriage is moved at a high speed, sliding noise increases, and rasping high-frequency noise is generated. A decrease in print precision caused by speed nonuniformity occurring when the speed is switched from the high speed to the print speed cannot be completely prevented.

Thus, in this embodiment, in contrast to the HQ mode placing an importance on the speed, in the SHQ mode placing an importance on the print precision and noise, the skip and high-speed return operations are not performed, thereby suppressing a decrease in print precision caused by speed nonuniformity, and generation of sliding noise.

Figure 23:
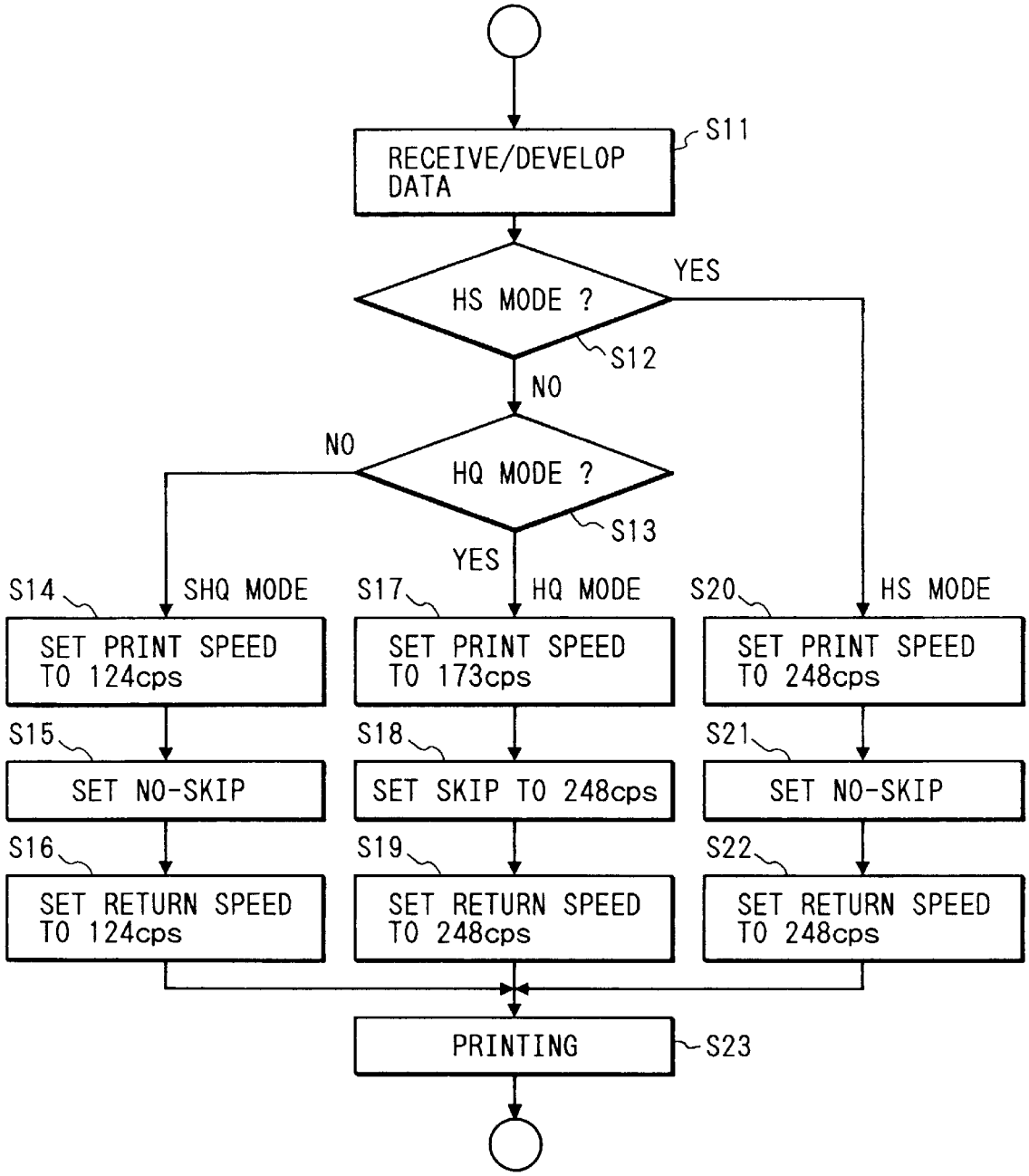
FIG. 23 is a flow chart showing carriage control.

The operation of this embodiment will be described below with reference to the flow chart shown in FIG. 23. Data reception is performed in step S11, and prior to a print operation, it is checked in steps S12 and S13 if the current mode is the SHQ, HQ, or HS mode.

If the current mode is the SHQ mode, the print speed is set at 124 cps, and neither of the skip mode nor the high-speed return mode are selected (steps S14 to S16). On the other hand, if the current mode is the HQ mode, the print speed is set at 173 cps, and the skip and return speeds are set at a high speed, i.e., 248 cps (steps S17 to S19). If the current mode is the HS mode, neither of the skip mode nor high-speed return mode are selected, and the print and return speeds are set at 248 cps (steps S20 to S22).

Thereafter, in step S23, the print operation is performed according to the selected skip and return modes.

Sixth Embodiment

In addition to the recording sheet conveyance control and carriage drive control according to the image recording mode, capping and wiping operations of an ink-jet recording head can be controlled in accordance with the image recording mode.

Capping and wiping control of this embodiment will be described below with reference to FIGS. 24 and 25.

An ink-jet recording apparatus of this embodiment is constituted by a recording head for forming an image on a recording medium by ejecting an ink, a carriage which carries the recording head, and is reciprocally moved in the right-and-left direction, a guide shaft for guiding the carriage, a wiper for removing dust such as paper particles or an ink attached on a head face, a cap for preventing clogging of nozzles of the head face, or performing suction recovery, and the like.

The wiping operation will be described in detail below with reference to FIG. 24.

Figure 24:
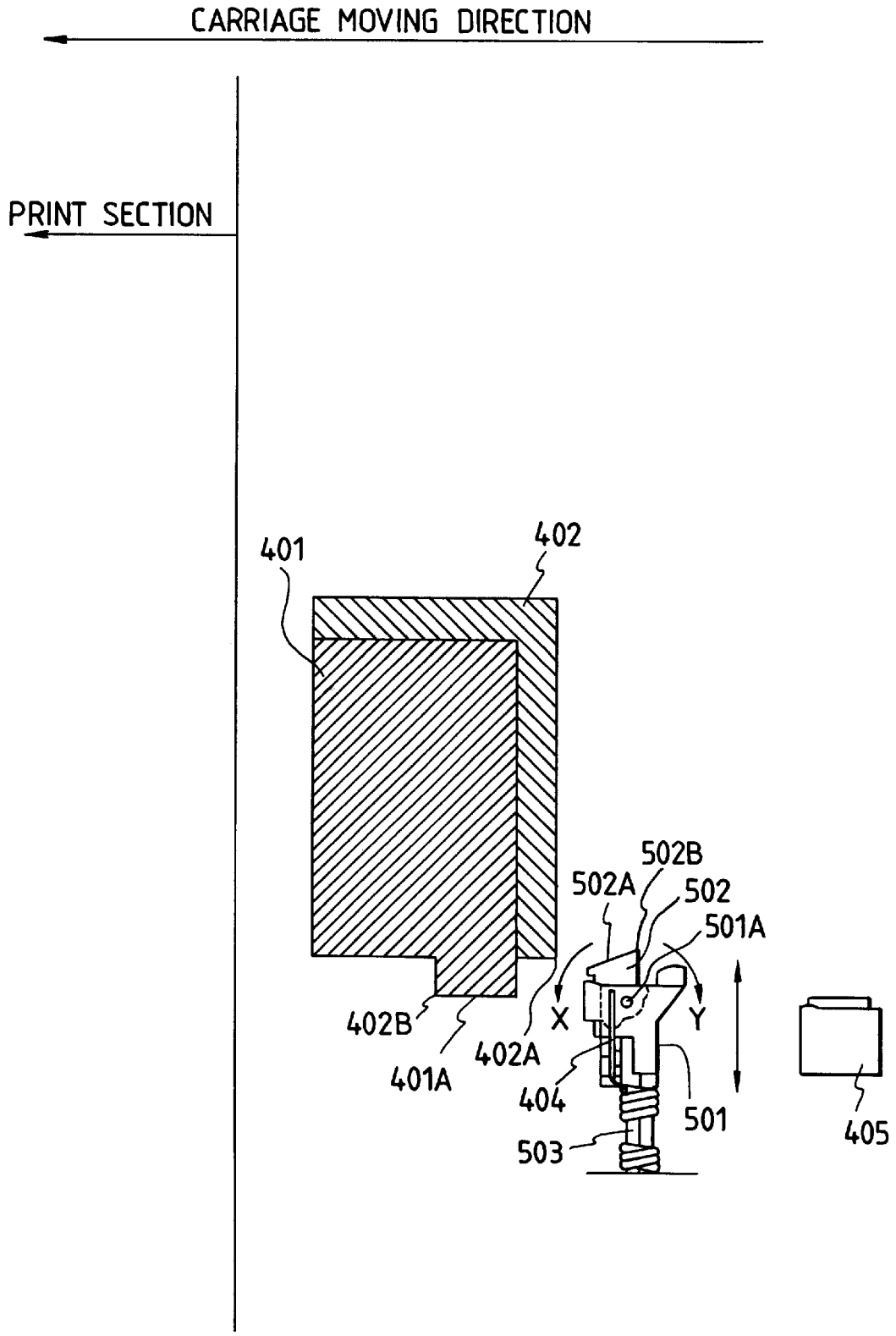
FIG. 24 is a schematic view showing an arrangement for wiping.
Figure 25:
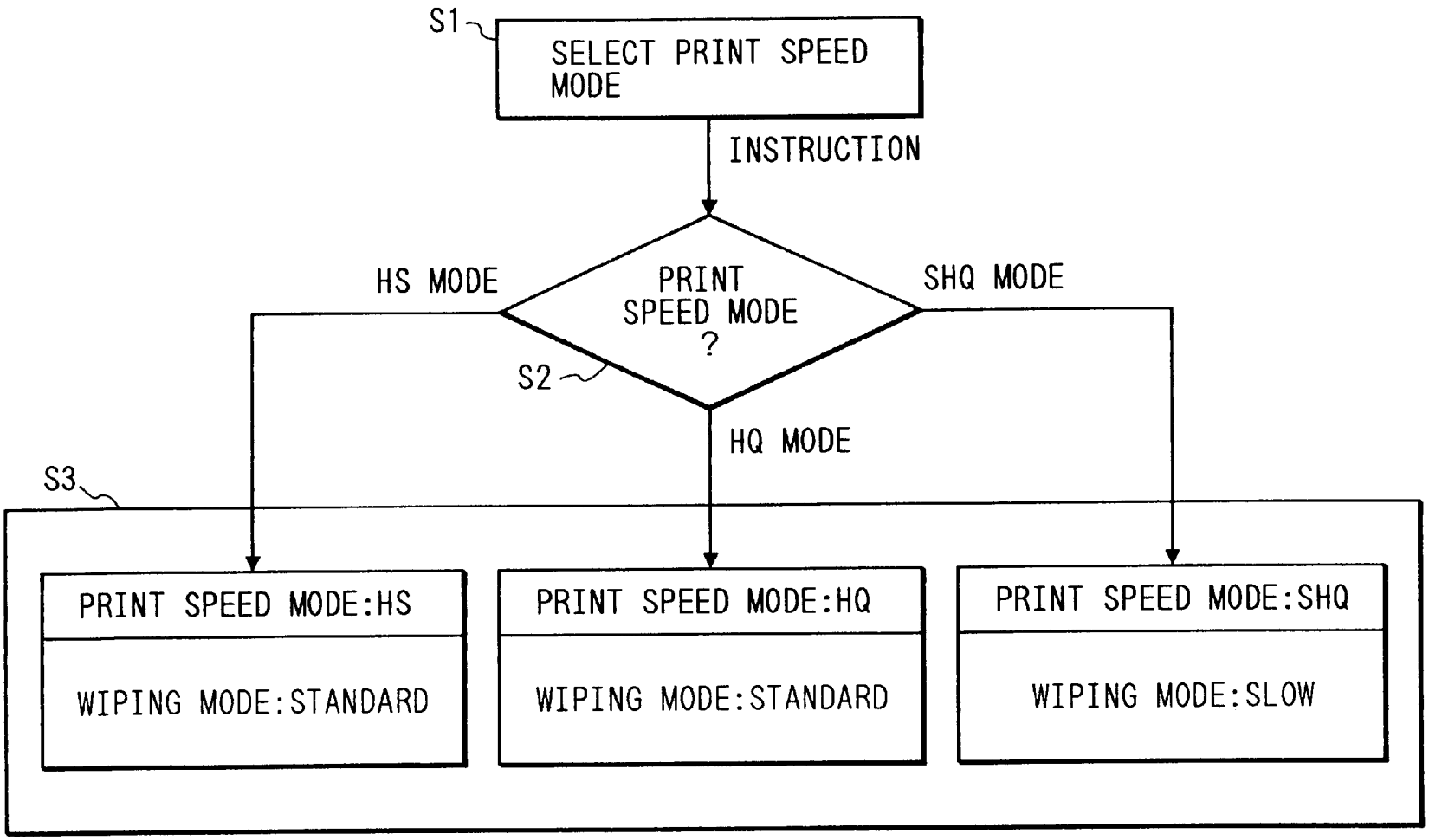
FIG. 25 is a flow chart showing wiping control.

Referring to FIG. 24, a wiper holder 501 holds a wiper 404. A wiper lever 502 has a cam surface 502A, and is pushed down when a lever push-down portion 402A of a carriage 402 is moved along the cam surface 502A. The wiper lever 502 is attached to the wiper holder 501 to be rotatable about a lever shaft 501A. The wiper lever 502 attached to the lever shaft 501A is rotatable in the X-direction in FIG. 24, but is non-rotatable in the Y-direction. Furthermore, the lever 502 always maintains the state shown in FIG. 24 by the biasing force of, e.g., a spring (not shown). A holder spring 503 always pushes up the wiper holder 501 (to a wiping position).

When the carriage 402 moves in the direction of a cap 405, the lever push-down portion 402A is brought into contact with the cam surface 502A. When the carriage 402 further moves, the wiper holder 501 is pushed down together with the wiper lever 502. Thus, since the wiper 404 is moved downward, a head face 401A does not contact the wiper 404, and no wiping operation is performed. After the head face 401A opposes the cap 405, the carriage 402 begins to move toward the print section in response to, e.g., a print instruction.

At this time, a lever-side trigger portion 502B is brought into contact with a carriage-side trigger portion 402B, and the wiper lever 502 is rotated in the direction of the arrow X in FIG. 24. Thus, the wiper holder 501 is moved upward by the pressure of the holder spring 503, thus allowing wiping. When the carriage 402 further moves toward the print section, the head face 401A is brought into contact with the wiper 404, thus attaining the wiping operation.

However, the conventional control suffers from the following drawbacks.

① When the above-mentioned three print speed modes are selectively executed, in the SHQ (fine-image, low-noise) mode, the moving noise in the wiping operation is high, and the feature of the SHQ mode cannot be satisfactorily exhibited.

② When the moving noise in the wiping operation is to be suppressed, since the speed of the carriage in the wiping operation must be decreased, a total print speed obtained when an image is printed on the entire recording medium in other HQ and HS (standard and high-speed) modes is lowered.

In this embodiment, two wiping modes, i.e., a standard mode (for the HQ and HS modes) and a low-noise mode (for the SHQ mode) are prepared. The wiping modes are selectively used in correspondence with the print modes, so that a low-noise apparatus can be realized without impairing the standard specifications of the recording apparatus.

The operation of this embodiment will be described below with reference to FIG. 25. When a user selects a print mode using, e.g., a key switch (S1), the CPU of the recording apparatus detects the selected mode (S2), and the print mode is set in the selected mode. At the same time, the wiping mode of the recovery system is set in correspondence with the selected print mode (S3).

In this embodiment, the wiping operation is performed at a standard speed in the HQ or HS mode, and the low-noise wiping mode is executed in the SHQ mode although the wiping speed is low.

As described above, the plurality of wiping modes are prepared in correspondence with the plurality of print speed modes, and are selectively used to utilize the feature of each print mode, thus improving the total specifications of the recording apparatus.

Figure 26:
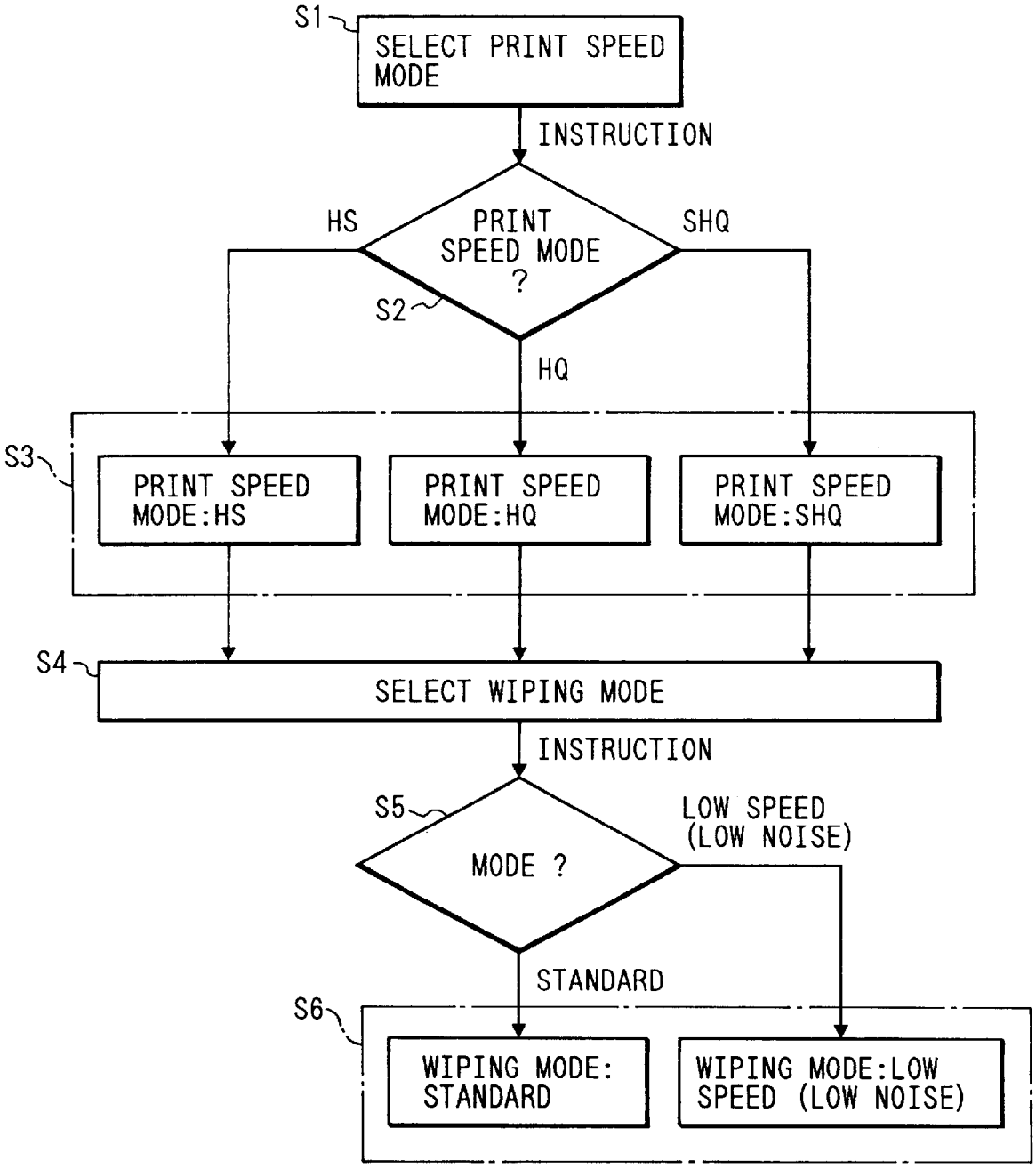
FIG. 26 is a flow chart showing another wiping control.

FIG. 26 is a flow chart for explaining another operation for selecting the wiping mode. In this embodiment, steps S1 to S3 execute the same operation sequence as in FIG. 25 of the sixth embodiment. Thereafter, the wiping mode can be individually selected by, e.g., a key switch in step S4. The instruction issued in step S4 is discriminated by the CPU in the apparatus in step S5, and a combination of the print speed mode and the wiping mode is set in step S6. Thus, the same effect as in the embodiment shown in FIG. 25 can be obtained.

Seventh Embodiment

In addition to the recording sheet conveyance control, the carriage drive control, and the capping and wiping control of the recording head in accordance with the image recording mode, drive control of the recording head can be performed in accordance with the image recording mode. This embodiment will be described below with reference to FIGS. 27 to 33.

Figure 27:
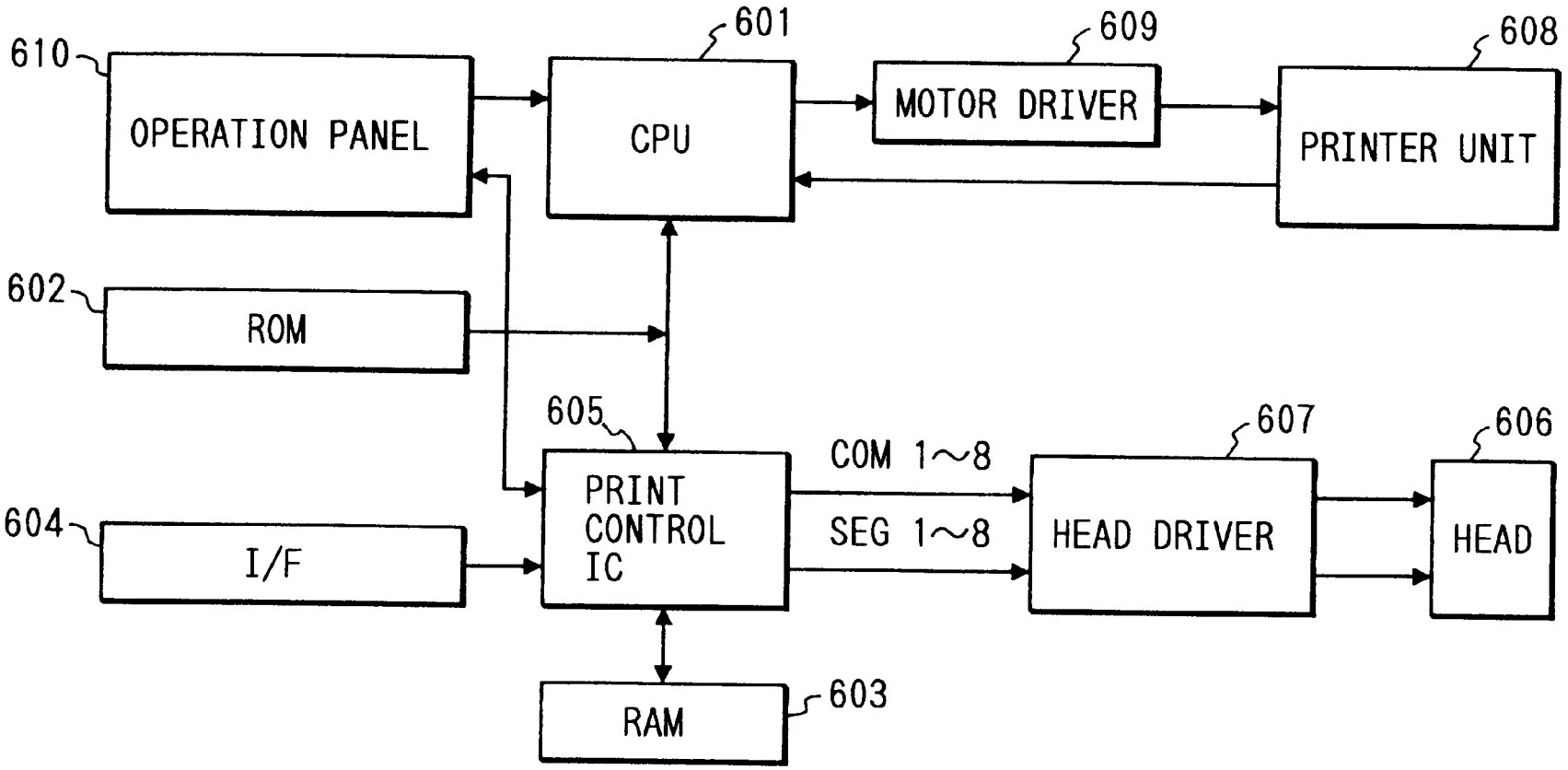
FIG. 27 is a block diagram showing a control circuit.

FIG. 27 is a block diagram showing constituting elements of a control circuit of a recording apparatus to which the present invention is applied. The control circuit includes a CPU 601, a ROM 602, a RAM 603, an interface 604, a printer control IC 605, a recording head 606, a head driver 607, a printer unit 608, a motor driver 609, and an operation panel 610.

The CPU 601 analyzes commands, data, and the like received from a host computer to form bit image data corresponding to a final recording content, and controls the entire recording apparatus. The ROM 602 stores a program used for control executed by the CPU 601. The RAM 603 temporarily stores data received from the interface 604, and also stores recording data obtained by analyzing the received data by the CPU 601. The interface 604 is a connection unit to the host computer. The printer control IC 605 is connected to a bus line of the CPU 601, and controls the RAM 603, the interface 604, and the recording head 606 on the basis of an instruction from the CPU 601. The recording head 606 is a 64-nozzle (ejection orifice) ink-jet head using heat energy, is integrated with an ink tank, and is exchangeable by a user. The head driver 607 converts a head control signal output from the printer control IC 605 into a voltage/current level which can drive the recording head. The printer unit 608 is a mechanism unit for performing a recording operation, and is constituted by a carriage system for scanning the recording head using a carriage motor as a drive source, a sheet feed system for conveying a recording sheet using a sheet feed motor as a drive source, a carriage position sensor, a sheet sensor, and the like. The motor driver 609 includes a carriage motor driver and a sheet feed motor driver. The operation panel 610 includes switches and indication lamps.

A print mode will be described below. The print mode includes three modes, i.e., HS, HQ, and SHQ modes. In the HS mode, the print speed becomes highest, and in the SHQ mode, print quality becomes highest. The HQ mode provides an intermediate print speed and image quality. A user can set the print mode by operating the operation panel 610. Also, the print mode can be changed by supplying a command from the host computer.

Figure 28:
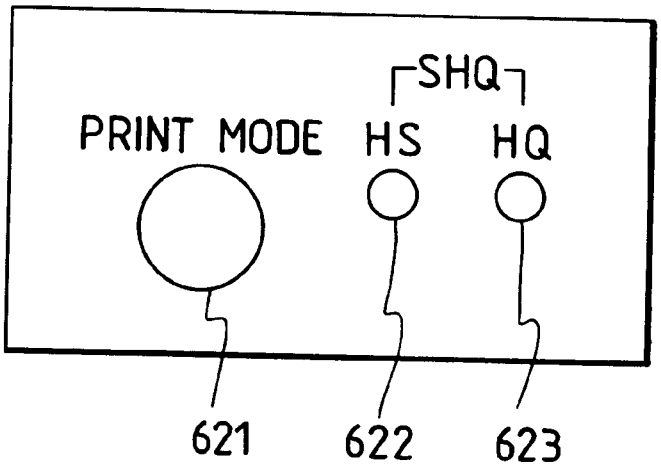
FIG. 28 is a plan view showing an outer appearance of a mode setting unit.

FIG. 28 shows the outer appearance of a mode setting unit of the operation panel 610. The mode setting unit includes a mode switch 621, an HS mode indication lamp 622, and an HQ mode indication lamp 623. When the power switch of the printer is turned on, the HQ mode is selected, and only the indication lamp 623 is turned on. When the mode switch 621 is depressed once, the SHQ mode is set, and both the indication lamps 622 and 623 are turned on. When the mode switch 621 is depressed once more, the HS mode is set, and only the indication lamp 622 is turned on. When the mode switch 621 is depressed still another time, the print mode is returned to the HQ mode. In this manner, the print mode can be cyclically changed.

Figure 29:
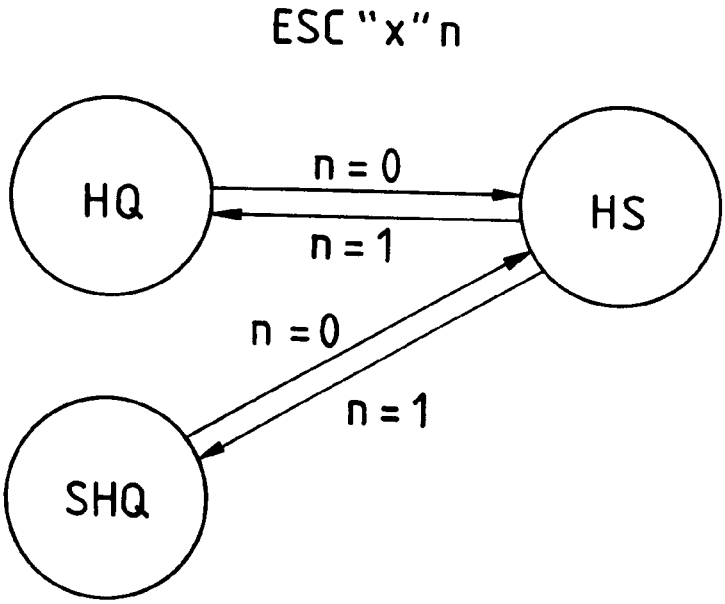
FIG. 29 is a view showing a mode setting method.

FIG. 29 shows a mode setting method by means of a command. A command for setting the mode consists of 3 bytes (ESC "x" n), and designates a mode by a value n. When n=0, the HS mode is set, and when n=1, one of the HQ and SHQ mode, which was set previously, is recovered.

Figure 30:
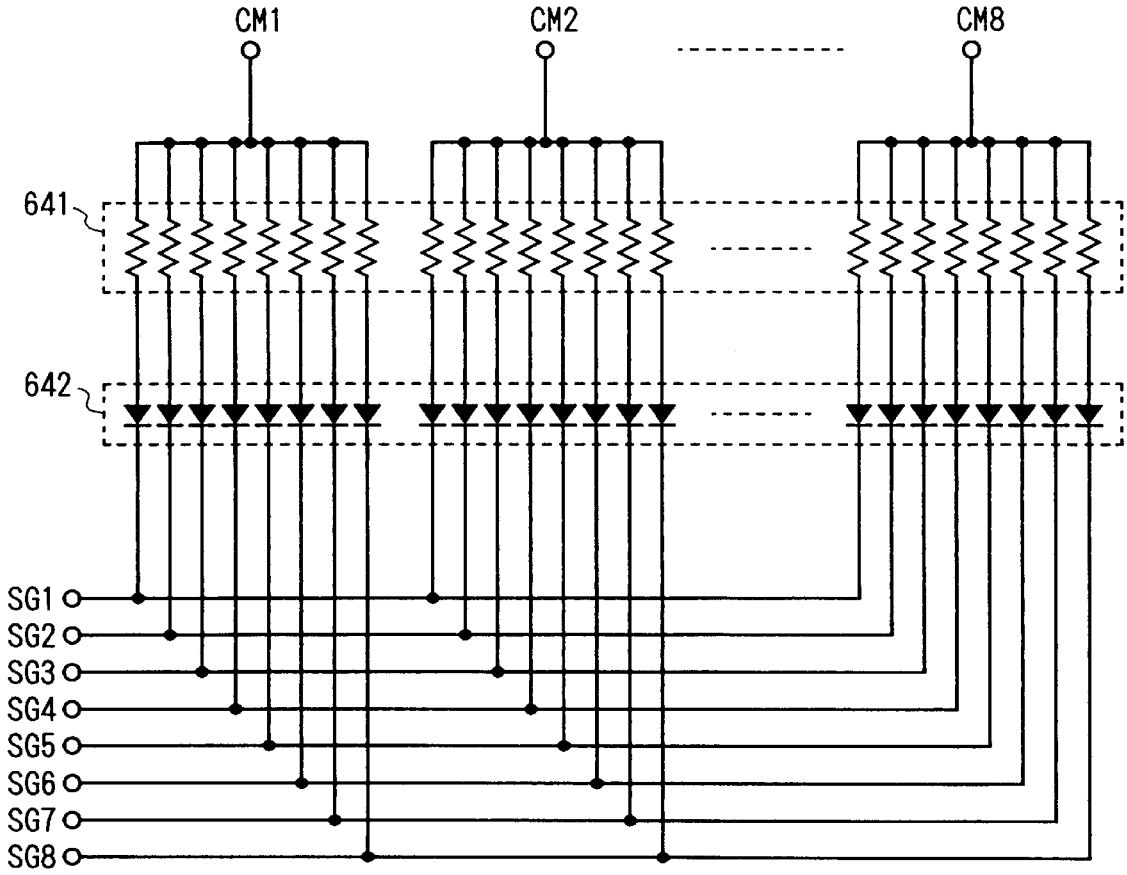
FIG. 30 is a circuit diagram showing an arrangement of a recording head.

FIG. 30 is a circuit diagram for explaining an electrical arrangement of the recording head. Referring to FIG. 30, heater resistors 641 and diodes 642 are formed on a chip board of the recording head. A total of 64 heater resisters 641 are arranged in correspondence with nozzle portions of the recording head. Similarly, 64 diodes 642 are arranged.

One-end portions of the heater resistors 641 are connected in units of eight resistors, and are then connected to current flow-in terminals CM1 to CM8. The terminals CM1 to CM8 will be referred to as common terminals hereinafter. The other end of each heater resistor 641 is connected to the anode of the corresponding diode 642. The cathodes of the diodes 642 are connected in units of eight diodes to extend in a direction perpendicular to the connection direction of the common terminals, and are then connected to current flow-out terminals SG1 to SG8. The terminals SG1 to SG8 will be referred to as segment terminals hereinafter.

The recording head is driven by supplying a current from the common terminal side to the segment terminal side. The drive control is executed in units of common terminals. First, when a driver connected to the terminal CM1 is turned on, the eight heater resistors connected to the terminal CM1 can be energized. In this case, when the ON/OFF states of segment drivers are controlled, the heater resistors to be energized are selected. The heater resistor connected to the ON segment terminal generates heat by energization, and forms a bubble in an ink near it. An ink droplet is ejected from the corresponding nozzle by the pressure of the bubble. When the common drivers are sequentially turned on from the terminal CM2 to CM8, all the heater resistors can be energized.

Figure 31:
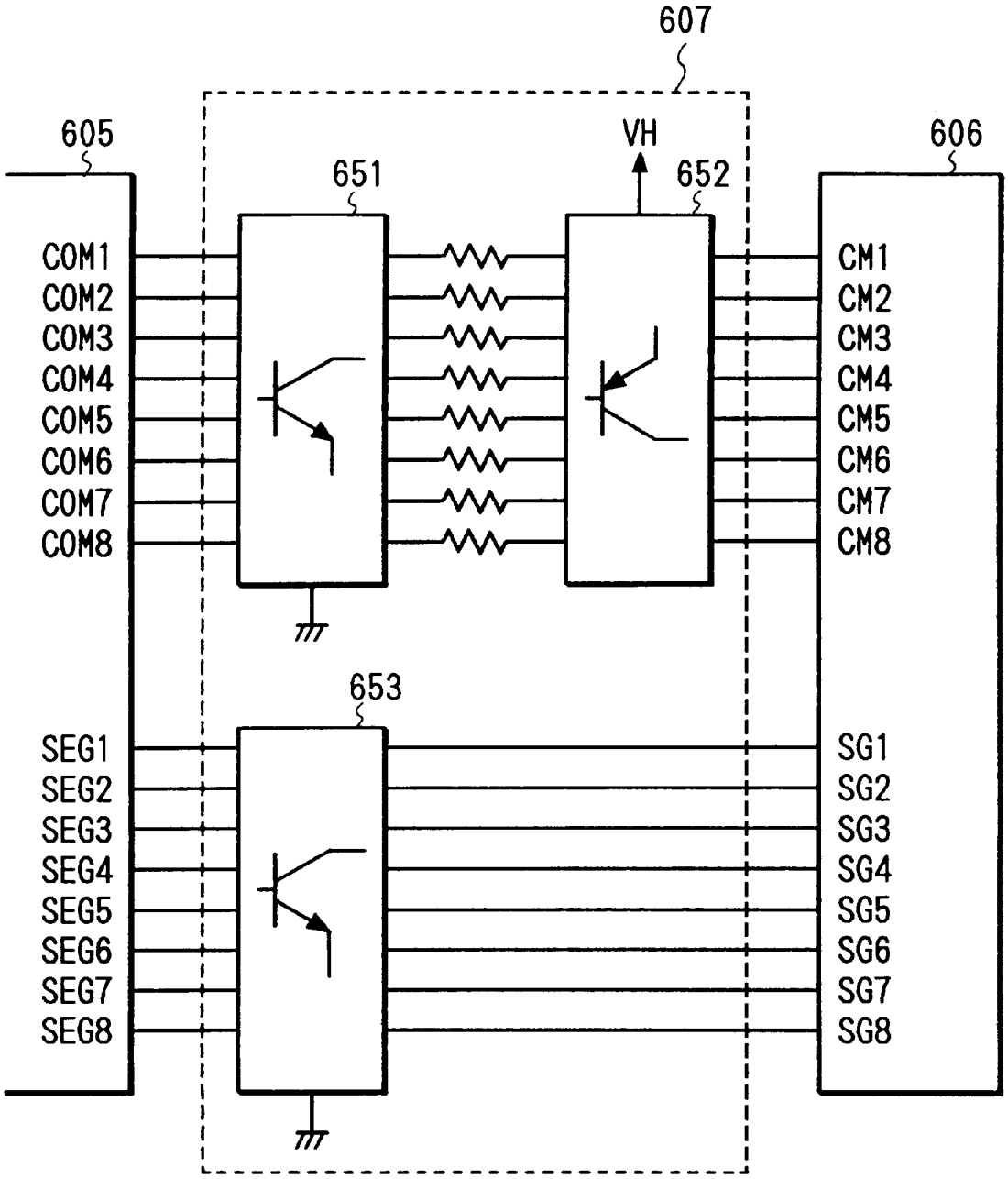
FIG. 31 is a block diagram showing a circuit arrangement of a head driver 607.

FIG. 31 is a block diagram showing a circuit arrangement of the head driver 607. The head driver 607 includes a pre-driver 651, a common driver 652, and a segment driver 653. The printer control IC 605 outputs common control signals COM1 to COM8, and segment control signals SEG1 to SEG8. The pre-driver 651 converts the common control signals COM1 to COM8 output from the printer control IC 605 into levels capable of driving the common driver 652. The common driver 652 is a source type driver, and supplies currents to the common terminals CM1 to CM8 of the recording head 606. The segment driver 653 is a source type driver, and absorbs currents from the segment terminals SG1 to SG8 of the recording head 606 in response to the segment control signals SEG1 to SEG8 output from the printer control IC 605.

Figure 32:
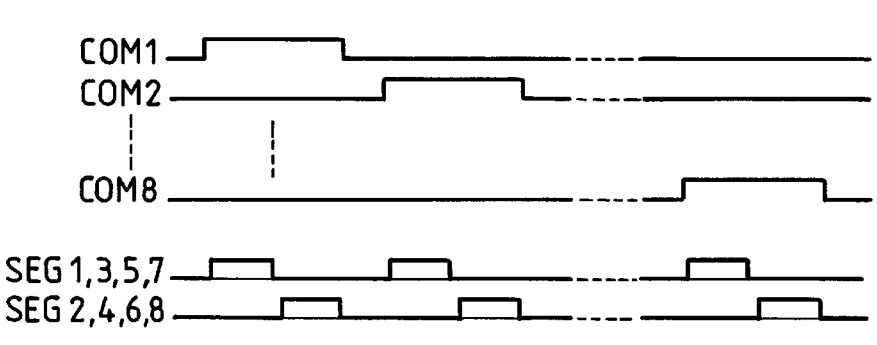
FIG. 32 is a timing chart of head control signals in HQ and SHQ modes.

FIG. 32 is a timing chart of head control signals in the HQ and SHQ modes. Referring to FIG. 32, the common control signals COM1 to COM8 are sequentially enabled, and while each common control signal is enabled, the segment control signals SEG1 to SEG8 are selectively enabled in correspondence with recording data. Of the segment control signals, odd segment control signals SEG1, SEG3, SEG5, and SEG7 are enabled first, and even segment control signals SEG2, SEG4, SEG6, and SEG8 are then enabled. Since the segment control signals are selectively enabled in two groups, currents flowing through the common terminals CM1 to CM8 are halved as compared to a case wherein all the segments are simultaneously driven. For this reason, the allowable current capacity of the common driver 652 can be reduced to realize a compact, low-cost circuit. Since the number of nozzles which are simultaneously driven is halved, a vibration of an ink in the head generated upon ejection of ink droplets is eliminated. The ink vibration disturbs uniform ejection of ink droplets, and causes deterioration of print quality. For this reason, the eliminated ink vibration contributes to improvement of print quality.

Figure 33:
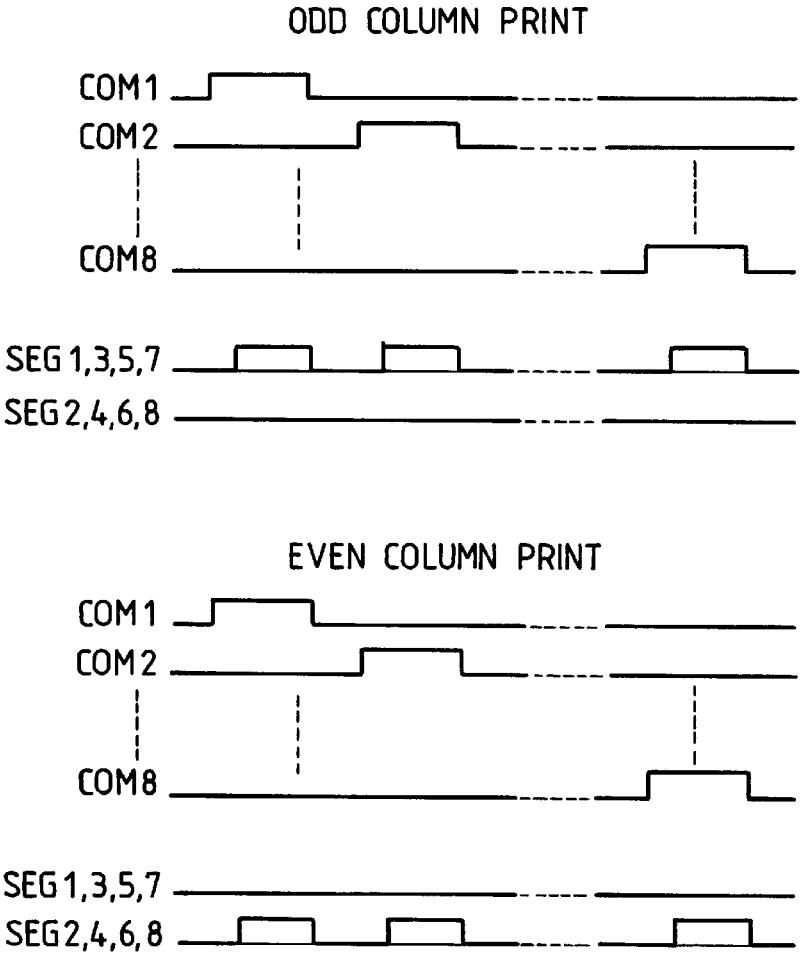
FIG. 33 is a timing chart of head control signals in an HS mode.

FIG. 33 is a timing chart of head control signals in the HS mode. In the HS mode, only odd segment signals SEG1, SEG3, SEG5, and SEG7 are enabled in an odd column print mode, and only even segment signals SEG2, SEG4, SEG6, and SEG8 are enabled in an even column print mode. For this reason, the print result has a pattern obtained by thinning out dots in a checker pattern. As in the HQ and SHQ modes, since the number of segments which are simultaneously driven is half of the total number of segments in the HS mode, the allowable current capacity of the common driver 652 can be reduced to realize a compact, low-cost circuit. In the HS mode, since the segments need not be selectively driven in two groups, the ON time of common signals is shortened as compared to the HQ or SHQ mode, and the head drive time can be shortened. For this reason, the print speed can be increased by increasing the head drive frequency.

As described above, in the HQ and SHQ modes, the segments to be simultaneously driven are divided into odd and even groups, and these groups are time-divisionally driven. In the HS mode, odd segments and even segments are alternately driven in units of columns. For these reason, the allowable current capacity of the common driver 652 can be reduced to realize a compact, low-cost circuit.

In the HQ and SHQ modes, since the segments are time-divisionally driven, an ink vibration in the head can be eliminated, and print quality can be improved.

In the HS mode, since print dots are thinned out in a checker pattern, the head drive time can be shortened, and the print speed can be increased.

Ejection amount control and head drive control will be described below with reference to FIGS. 34 to 42B.

In this embodiment, the drive condition of the recording head is controlled in accordance with the print mode, the ambient temperature, and the head chip temperature. Drive control having three print modes, i.e., HQ, SHQ, and HS modes, for increasing/decreasing the ejection amount is executed to correct a change in ejection amount caused by changes in ambient temperature and head chip temperature, thus realizing high image quality.

In the ink-jet recording apparatus, when the temperature of the recording head is controlled within a predetermined range, ejection and the ejection amount can be stabilized, and a high-quality image can be recorded. A calculation detection means for the temperature of the recording head, and an optimal drive control method according to the temperature for realizing stable high-quality recording will be briefly described below.

(1) Setting of Target Temperature

Head drive control for stabilizing the ejection amount to be described below uses the head chip temperature as a control reference. More specifically, the head chip temperature is used as an index for detection of an ejection amount per dot ejected at that time. However, even when the chip temperature is constant, since the ink temperature in a tank depends on the ambient temperature, the ejection amount varies. For the purpose of eliminating this difference, a value which determines the head chip temperature to equalize the ejection amount in units of ambient temperatures (i.e., in units of ink temperatures) is a target temperature. The target temperature is pre-set as a target temperature table. FIG. 34 shows the target temperature table used in this embodiment.

(2) Recording Head Temperature Calculation Means

The recording head temperature is estimated and calculated based on previously input energy. In a calculation method, a change in temperature of the recording head is processed as an accumulation of discrete values per unit time, the change in temperature of the recording head according to the discrete value is calculated in advance within a range of inputtable energy, and the calculation results are summarized as a table. Note that the table employs a two-dimensional matrix (two-dimensional table) of input energy per unit time and elapsed time.

In a temperature calculation algorithm means in this embodiment, the recording head as a combination of a plurality of members having different heat conduction times is substituted with models as thermal time constants fewer than those in practice, and calculations are individually performed using different required calculation intervals and required data hold times in units of models (thermal time constants). Furthermore, a plurality of heat sources are set, and a raised temperature width (temperature increment) is calculated for each heat source in units of models. These results are added to each other to calculate the head temperature.

The reason why the chip temperature is not sensed using a sensor but is estimated and calculated from input energy is as follows:

① The response time obtained when the chip temperature is estimated and calculated is shorter than that obtained when the temperature is measured by a sensor. This allows a quick countermeasure against a change in chip temperature.

② Cost can be reduced.

The estimated and calculated head temperature can serve as a reference for ejection drive control and sub-heater drive control in this embodiment.

(3) PWM Control

When the head is driven at a chip temperature described in the target temperature table in each environment, the ejection amount can be stabilized. However, the chip temperature sometimes changes according to, e.g., the print duty, and is not constant. For this reason, for the purpose of stabilizing the ejection amount, a means for driving the head in a multi-pulse PWM drive mode, and controlling the ejection amount independently of the temperature is PWM control. In this embodiment, a PWM table which defines pulses having an optimal waveform and width at that time in accordance with a difference between the head temperature and the target temperature in a corresponding environment is set in advance, thereby determining an ejection drive condition.

(4) Sub-heater Drive Control

When a desired ejection amount cannot be obtained under the PWM drive control, control for driving sub-heaters immediately before a print operation to cause the head temperature to approach the target temperature is sub-heater control. An optimal sub-heater drive time at that time is set in advance in correspondence with the difference between the head temperature and the target temperature in a corresponding environment, thereby determining a sub-heater drive condition.

Control modes as the principal part of this embodiment will be individually described in detail below.

(Temperature Prediction Control)

Briefly speaking, a change in head temperature is calculated by evaluating it using a matrix calculated in advance within ranges of the thermal time constants of the head and inputtable energy.

Temperature estimation of the recording head basically complies with the following general formulas of heat conduction:

Heating $$\Delta temp = a\{1 - exp[-m*T]\} \quad (1)$$

("*" indicates—multiplied by—)

Cooling from the middle of heating $$\Delta temp = a\{exp[-m(T-T_1)] - exp[-m*T]\} \quad (2)$$

where temp: raised temperature of object a: balanced temperature of object by heat source T: elapsed time m: thermal time constant of object $T_1$: time after heat source is removed If the recording head is processed as a lumped constant system, the chip temperature of the recording head can be theoretically estimated by calculating the above-mentioned formulas (1) and (2) in accordance with the print duty in units of time constants.

However, in general, it is difficult to perform the above-mentioned calculations in view of the processing speed.

Strictly speaking, since all the constituting members have different time constants, and a time constant is generated between adjacent members, the number of times of calculations becomes huge.

In general, since an MPU cannot directly perform exponential calculations, approximate calculations must be performed, or a conversion table must be used. For this reason, the calculation time cannot be shortened.

In this embodiment, the above-mentioned problems are solved by modelling and a calculation algorithm.

(1) Modelling

Figure 35:
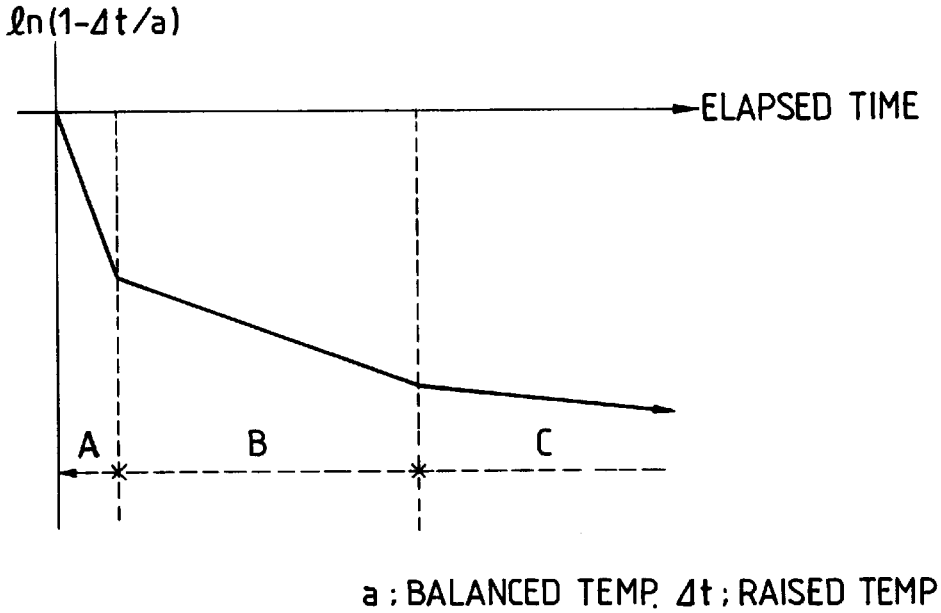
FIG. 35 is a graph showing the temperature raise process of a recording head in the seventh embodiment.

The present inventors obtained the result shown in FIG. 35 when energy was input to the recording head with the above arrangement, and data in the temperature rise process of the recording head were sampled. Strictly speaking, the recording head with the above-mentioned arrangement is constituted by a combination of many members having different heat conduction times. However, as can be seen from FIG. 35, within ranges wherein the differential value of a function between the LOG-converted raised temperature data and the elapsed time is constant (i.e., ranges A, B, and C having constant inclinations), the recording head can be substantially processed as heat conduction of a single member.

From the above-mentioned result, in this embodiment, the recording head is processed as two thermal time constants in models associated with heat conduction. Note that the above-mentioned result indicates that regression can be more precisely performed by modelling having three thermal time constants. However, in this embodiment, it is determined that the areas B and C in FIG. 35 have almost equal inclinations, and the recording head is modelled using two thermal time constants in consideration of calculation efficiency. More specifically, one heat conduction is a model of a member having a time constant for raising the temperature to the balanced temperature in 0.8 sec (corresponding to the area A in FIG. 35), and the other heat conduction is a model having a time constant for raising the temperature to the balanced temperature in 512 sec (as a model of the areas B and C in FIG. 35).

Furthermore, in this embodiment, the recording head is modelled as follows.

The temperature distribution in heat conduction is assumed to be negligible, and all members are processed as a lumped constant system.

Two heat sources, i.e., heat for printing and heat of sub-heaters are assumed.

Figure 36:
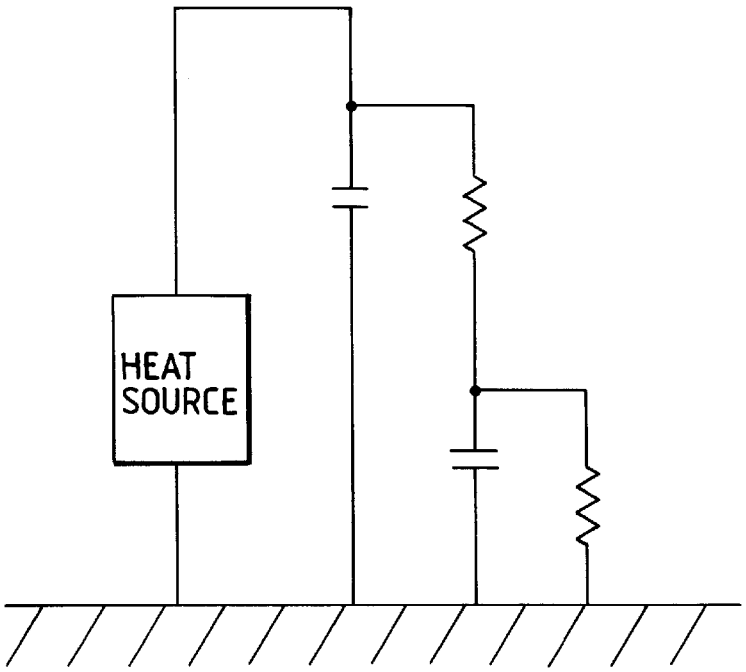
FIG. 36 shows an equivalent circuit of a thermal model in the seventh embodiment.

FIG. 36 shows an equivalent circuit of heat conduction modelled in this embodiment. Although FIG. 36 illustrates only one heat source, two heat sources can be serially connected.

(2) Calculation Algorithm

In calculations of the head temperature in this embodiment, the above-mentioned general formulas of heat conduction are developed as follows to facilitate calculation processing.

<Temperature drift after elapse of nt time after heat source is ON>

$$a\{1-exp[-m*n*t]\} = a\{exp[-m*t] - exp[-m*t] + exp[-2*m*t] - exp[-2*m*t] + \ldots + exp[-(n-1)*m*t] - exp[-(n-1)*m*t] + 1 - exp[-n*m*t]\} = a\{1-exp[-m*t]\} + a\{exp[-m*t] - exp[-2*m*t]\} + a\{exp[-2*m*t] - exp[-3*m*t]\} \quad <1>$$

$$+a\{exp[-(n-1)*m*t] - exp[-n*m*t]\} = a\{1-exp[-mt]\} \quad <2\text{-}1>$$

$$+a\{exp[-m*(2t-t)] - exp[-m*2t]\} \quad <2\text{-}2>$$

$$+a\{exp[-m*(3t-t)]-exp[-m*3t]\} \quad \text{<2-3>}$$

$$+a\{exp[-m*(nt-t)]-exp[-m*nt]\} \quad \text{<2-n>}$$

Since the formulas are developed, as described above, formula <1> coincides with <2-1>+<2-2>+<2-3>+ . . . +<2-n>.

Formula <2-n>: equal to the temperature of an object at time nt when heating is performed from time 0 to time t, and is turned off from time t to time nt.

Formula <2-3>: equal to the temperature of an object at time nt when heating is performed from time (n−3)t to time (n−2)t, and is turned off from time (n−2)t to time nt.

Formula <2-2>: equal to the temperature of an object at time nt when heating is performed from time (n−2)t to time (n−1)t, and is turned off from time (n−1)t to time nt.

Formula <2-1>: equal to the temperature of an object at time nt when heating is performed from time (n−1)t to nt.

The fact that the total of the above formulas is equal to formula <1> means that the behavior of the temperature (raised temperature) of object 1 can be estimated and calculated such that the current temperature of object 1 is obtained by calculating a decreased temperature (temperature decrement), after an elapse of each unit time, of the temperature of object 1 raised by input energy per unit time (corresponding to each of formulas <2-1>, <2-2>, <2-3>, . . . , <2-n>), and by calculating a total sum of the decreased temperatures as opposed to raised temperatures (temperature increments) per unit time (<2-1>+<2-2>+<2-3>+ . . . +<2-n>).

From the above description, in this embodiment, the calculation of the chip temperature of the recording head is performed four times (two heat sources * two thermal time constants) by the above-mentioned modelling. The required calculation interval and data hold time for each of the four calculations are as shown in FIG. 37. FIGS. 38 to 41 show calculation tables each defined by a two-dimensional matrix of input energy and elapsed time.

FIG. 38 is a calculation table for a heat source; an ejection heater, and a time constant; a short-range member group, FIG. 39 is a calculation table for a heat source; an ejection heater, and a time constant; a long-range member group, FIG. 40 is a calculation table for a heat source; a sub-heater, and a time constant; a short-range member group, and FIG. 41 is a calculation table for a heat source; a sub-heater, and a time constant; a long-range member group.

In the drawings, "~" (shorter one) means—ranges up to the value of the next row or column in each table—and "~" (larger one) indicates omitted section in the table.

As shown in FIGS. 39 to 41, the following calculations are performed at 0.05-sec intervals to obtain:

(1) the raised temperature of a member having a thermal time constant represented by the short range upon driving of the ejection heater (ΔTmh);

(2) the raised temperature of a member having a thermal time constant represented by the short range upon driving of the sub-heater (ΔTsh); and the following calculations are performed at 1.0-sec intervals to obtain:

(3) the raised temperature of a member having a thermal time constant represented by the long range upon driving of the ejection heater (ΔTmb); and (4) the raised temperature of a member having a thermal time constant represented by the long range upon driving of the sub-heater (ΔTsb).

When ΔTmh, ΔTsh, ΔTmb, and ΔTsb are added to each other (=ΔTmh+ΔTsh+ΔTmb+ΔTsb), the heat temperature at that time can be calculated.

As described above, since the recording head constituted by combining a plurality of members having different heat conduction times is modelled by substituting the members with thermal time constants fewer than practical ones, the following merits can be expected:

As compared to faithful execution of calculation processing in units of thermal time constants of all members having different heat conduction times and thermal time constants between members, the calculation processing amount can be greatly decreased without largely impairing calculation precision.

Since the recording head is modelled using time constants as a reference for decision, calculation processing can be executed in a small number of times without impairing calculation precision. For example, in the above-mentioned case, when the recording head is not modelled in units of time constants, the required calculation processing interval is determined by the area A having a small time constant, and is 50 msec. On the other hand, since the data hold time of discrete data is determined by the areas B and C having large time constants, the required data hold time is 512 sec. More specifically, accumulation calculation processing of 10,240 data for previous 512 sec at 50-msec intervals must be performed, and the number of times of calculation processing becomes several hundred of times of that in this embodiment.

As described above, in addition to the temperature calculation algorithm realized by:

(1) processing a change in temperature of the recording head as an accumulation of discrete values per unit time;

(2) calculating in advance a change in temperature of the recording head according to the discrete values within a range of inputtable energy, and forming a table of the calculation results; and (3) constituting the table as a two-dimensional matrix of input energy per unit time and the elapsed time, the recording head constituted by combining a plurality of members having different heat conduction times is modelled by substituting the members with thermal time constants fewer than practical ones, calculations are independently performed using different required calculation intervals and required data hold times calculated in units of models (thermal time constants), a plurality of heat sources are set to calculate a raised temperature width for each heat source in units of models, and these calculation results are added to each other to calculate the head temperature (multi-heat source calculation algorithm), so that a change in temperature of the recording apparatus can be processed completely in calculation processing without arranging any temperature sensor to the recording head even in an inexpensive recording apparatus.

Furthermore, the above-mentioned PWM drive control and sub-heater control for controlling the temperature of the recording head can be properly performed, and ejection and the ejection amount can be stabilized, thus allowing high-quality image recording.

Figure 42A:
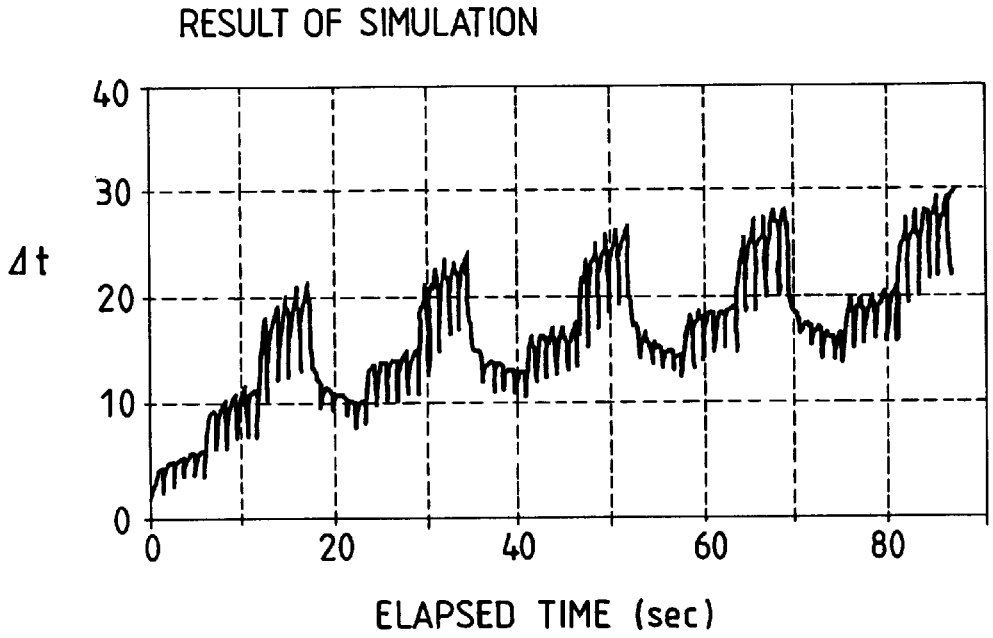
FIGS. 42A and 42B are graphs showing, in comparison, a change in temperature of a recording head estimated by a head temperature calculation means of the seventh embodiment, and a change in temperature of the recording head, which is actually measured.
Figure 42B:
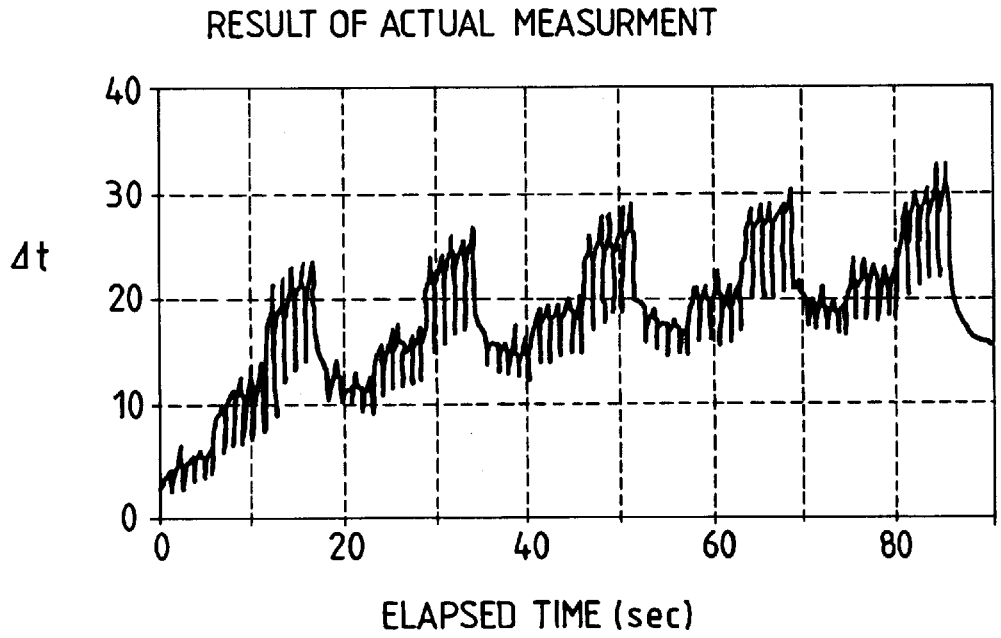

Note that FIGS. 42A and 42B show a comparison of the recording head temperature estimated by the head temperature calculation means described in this embodiment, and the actually measured recording head temperature. In FIGS. 42A and 42B, abscissa: elapsed time (sec)

ordinate: raised temperature (Δt)

print pattern: (25% duty * 5 lines+50% duty * 5 lines+100% duty * 5 lines) * 5 times (printing of a total of 75 lines)

FIG. 42A: a change in recording head temperature estimated by the head temperature calculation means FIG. 42B: a change in recording head temperature which is actually measured As can be seen from FIGS. 42A and 42B, the temperature calculation means can precisely estimate the head temperature.

(PWM Control)

The ejection amount control method of this embodiment will be described in detail below with reference to the accompanying drawings.

Figure 43:
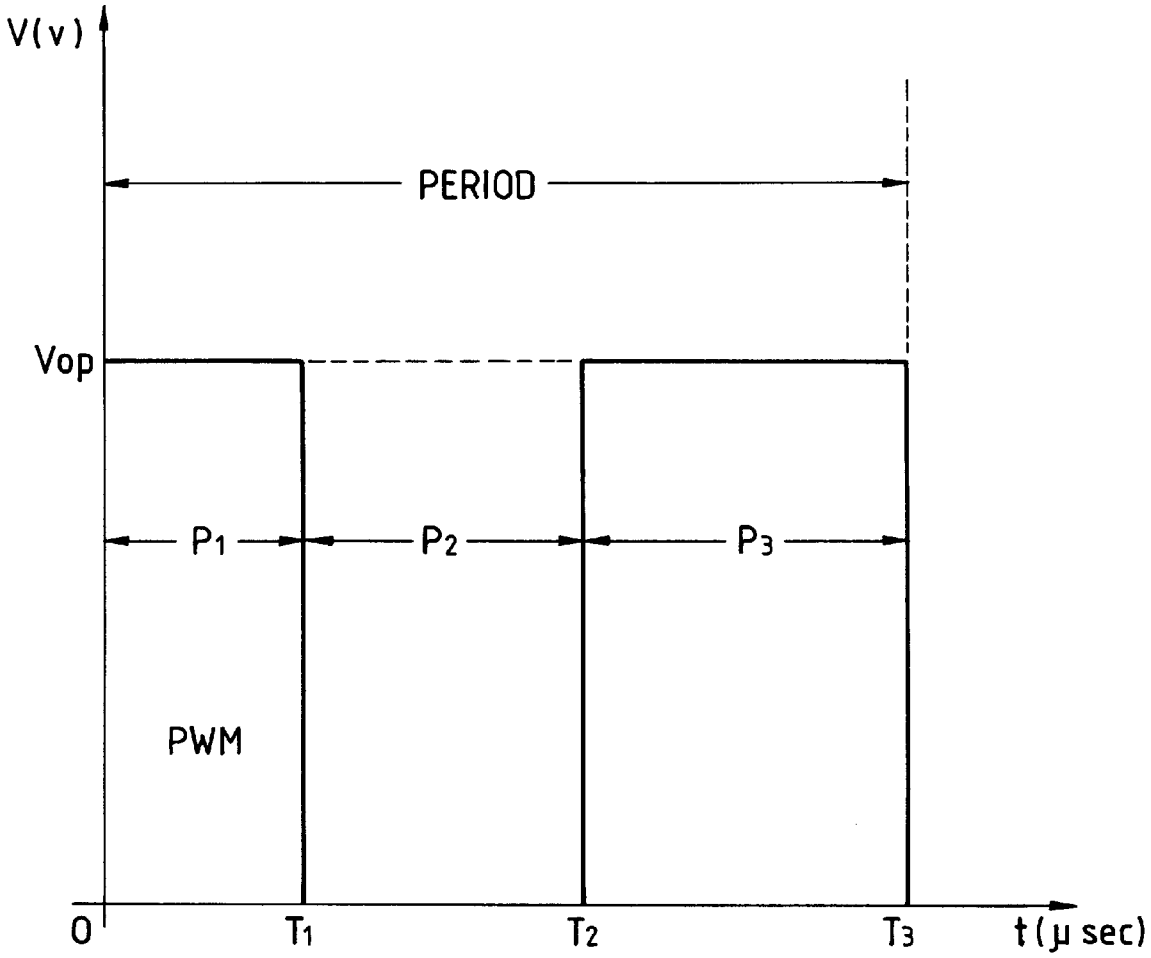
FIG. 43 is an explanatory view of a divisional pulse-width modulation drive method.

FIG. 43 is a view for explaining divisional pulses according to this embodiment. In FIG. 43, Vop represents the drive voltage, P1 represents the pulse width of the first pulse (to be referred to as a pre-heat pulse hereinafter) of a plurality of divided heat pulses, P2 represents the interval time, and P3 represents the pulse width of the second pulse (to be referred to as a main heat pulse hereinafter). T1, T2, and T3 represent times required for respectively determining the pulse widths P1, P2, and P3. The drive voltage VOP is one of electric energy sources required when electro-thermal conversion elements which receive this voltage generate, as a heater board, heat energy in an ink in ink channels defined by a top plate. The value of the drive voltage VOP is determined by the area, resistance, and film structure of the electro-thermal conversion elements, and the channel structure of the recording head. In the divisional pulse width modulation (PWM) drive method, pulses are sequentially applied to have the widths P1, P2, and P3. The pre-heat pulse is a pulse for mainly controlling the ink temperature in the channels, and plays an important role in the ejection amount control of the present invention. The pre-heat pulse width is set to be a value which does not cause a foaming phenomenon in the ink by heat energy generated by the electro-thermal conversion elements upon application of the pre-heat pulse.

The interval time is set to assign a predetermined time interval for preventing the pre-heat pulse from interfering with the main heat pulse, and to obtain a uniform temperature distribution of the ink in the ink channels. The main heat pulse is set to cause the foaming phenomenon in the ink in the channels to eject the ink from ejection orifices, and its width P3 is determined by the area, resistance, and film structure of the electro-thermal conversion elements, and the ink channel structure of the recording head.

Figure 44A:
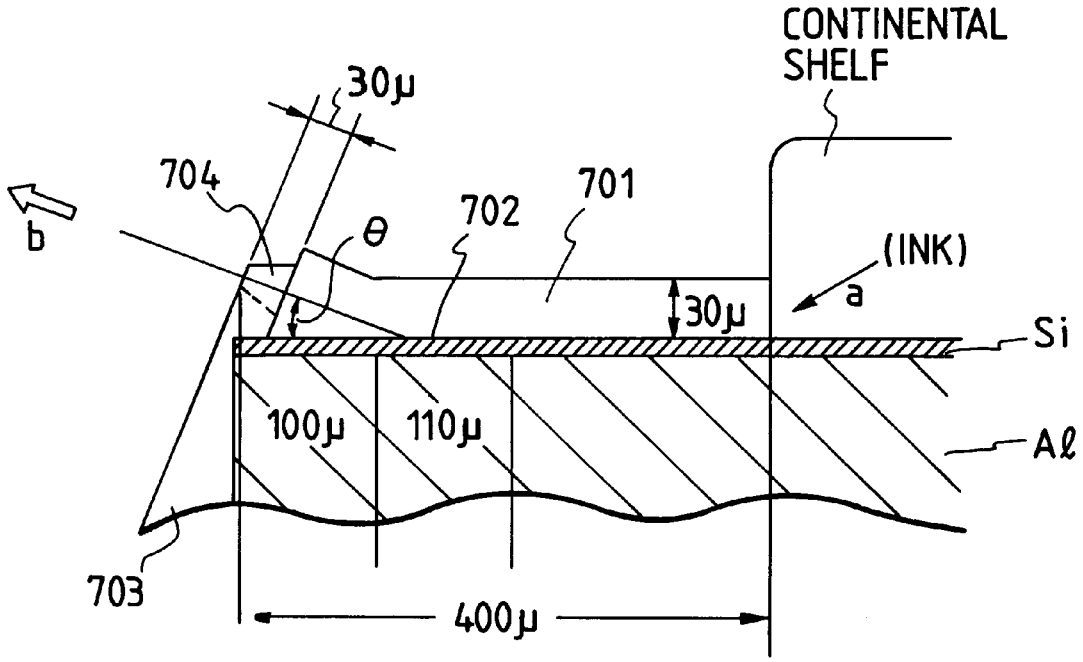
FIGS. 44A and 44B are respectively a schematic longitudinal sectional view along an ink channel and a schematic front view showing an arrangement of a recording head to which the present invention is applicable.
Figure 44B:
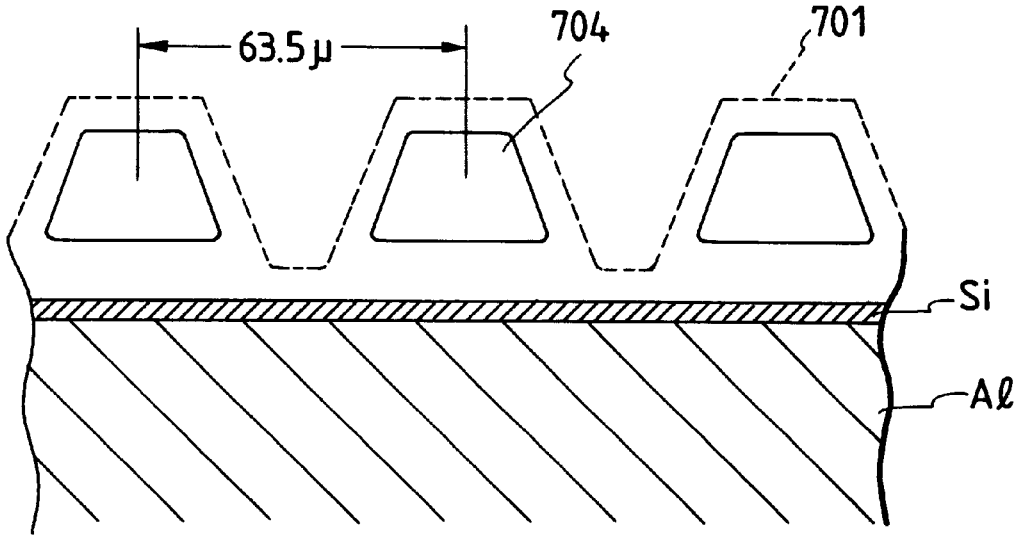

The effect of the pre-heat pulse in a recording head having a structure, as shown in, e.g., FIGS. 44A and 44B, will be described below. FIGS. 44A and 44B are respectively a schematic longitudinal sectional view taken along an ink channel 701 and a schematic front view showing an arrangement of a recording head to which the present invention can be applied. Referring to FIGS. 44A and 44B, each electro-thermal conversion element (ejection heater) 702 generates heat upon application of divisional pulses. The electro-thermal conversion element is arranged on a heater board together with an electrode wiring pattern for applying the divisional pulses thereto, and the like. The heater board consists of silicon, and is supported by an aluminum plate serving as a substrate of the recording head. A top plate 703 is formed with grooves for defining ink channels 701 and the like, and when the top plate is joined to the heater board (aluminum plate), the ink channels and a common ink chamber for supplying an ink to these channels are defined. The top plate is formed with ejection orifices 704 (hole area: 20$\mu$ diameter or equivalent), which communicate with the corresponding ink channels.

Figure 45:
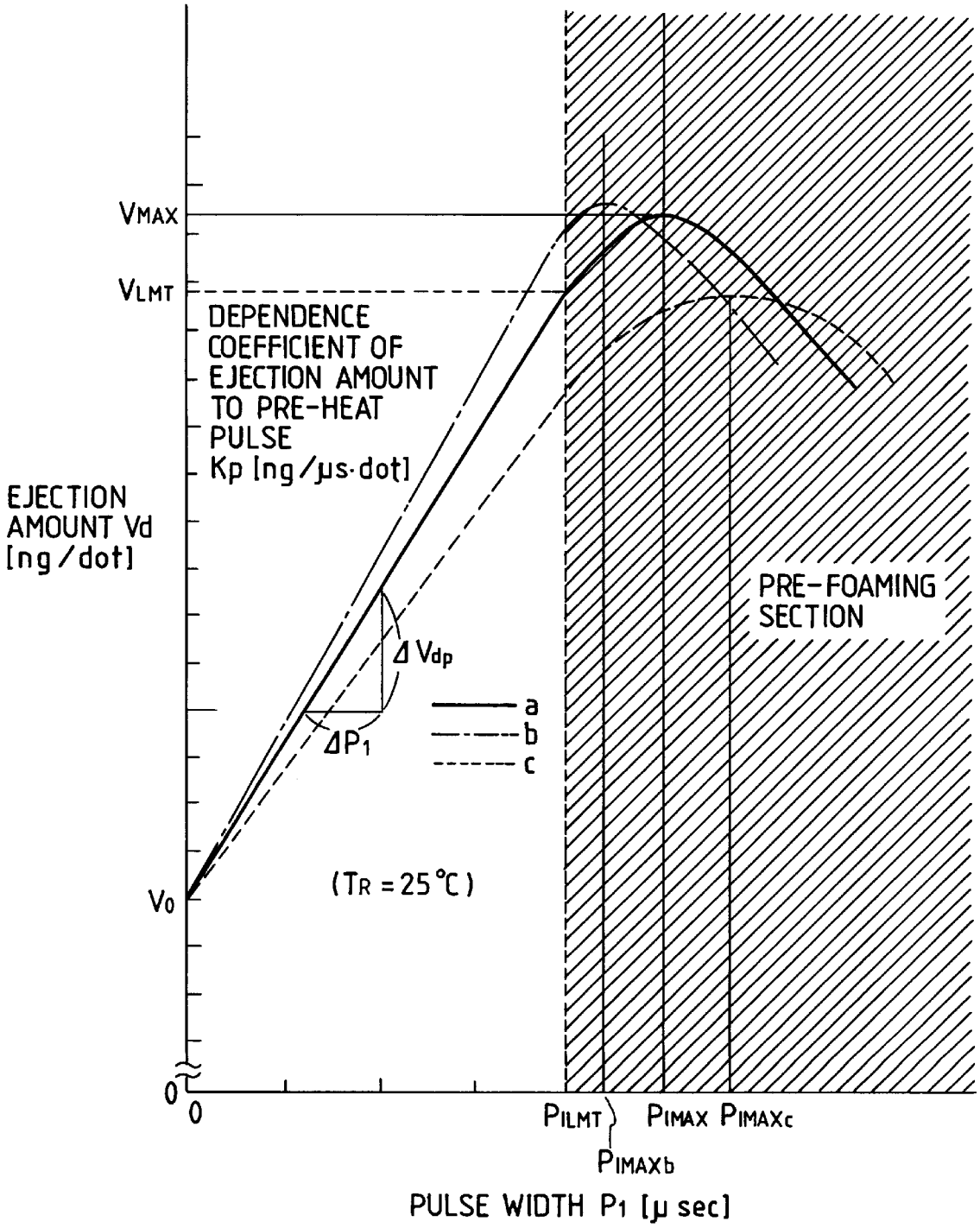
FIG. 45 is a graph showing the pre-heat pulse dependence of the ejection amount.

In the recording head shown in FIGS. 44A and 44B, when the drive voltage Vop=18.0 (V) and the main heat pulse width P3=4.114 [$\mu$sec] are set, and the pre-heat pulse width P1 is changed within a range from 0 to 3.000 [$\mu$sec], the relationship between an ejection amount Vd [ng/dot] and the pre-heat pulse width P1 [$\mu$sec], as shown in FIG. 45, is obtained.

FIG. 45 is a graph showing the pre-heat pulse dependence of the ejection amount. In FIG. 45, $V_0$ represents the ejection amount obtained when P1=0 [$\mu$sec], and this value is determined by the head structure shown in FIGS. 44A and 44B. For example, $V_0$ in this embodiment was $V_0$=18.0 [ng/dot] when the ambient temperature $T_R$=25° C. As indicated by a curve a in FIG. 45, as the pre-heat pulse width P1 increases, the ejection amount Vd increases linearly with a range of the pulse width P1 from 0 to $P1_{LMT}$, and the change in ejection amount Vd loses linearity in a range satisfying the pulse width $P1>P1_{LMT}$. The ejection amount Vd is saturated and maximized when the pulse width $P1=P1_{MAX}$.

In this manner, the range up to the pulse width $P1_{LMT}$ in which the change in ejection amount Vd with respect to the change in pulse width P1 shows linearity is effective as a range allowing easy ejection amount control based on the change in pulse width P1. For example, in this embodiment represented by the curve a, $P1_{LMT}$=1.87 [$\mu$sec], and the ejection amount at that time was $V_{LMT}$=24.0 [ng/dot]. The pulse width $P1_{MAX}$ corresponding to the saturated state of the ejection amount Vd was $P1_{MAX}$=2.1 [$\mu$sec], and the ejection amount $V_{MAX}$ at that time was $V_{MAX}$=25.5 [ng/dot].

When the pulse width is larger than $P1_{MAX}$, the ejection amount Vd becomes smaller than $V_{MAX}$. This phenomenon occurs for the following reason. That is, when a pre-heat pulse having a pulse width in the above-mentioned range is applied, a very small bubble (in a state immediately before film boiling) is formed on the electro-thermal conversion element, and the subsequent main heat pulse is applied before this bubble disappears. Thus, since the very small bubble disturbs foaming to be caused by the main heat pulse, the ejection amount decreases. This region is called a pre-foaming region, and in this region, it is difficult to execute ejection amount control using the pre-heat pulse as a medium.

If the inclination of a straight line representing the relationship between the ejection amount and the pulse width within the range of P1=0 to $P1_{LMT}$ [$\mu$sec] is defined as a pre-heat pulse dependence coefficient, the pre-heat pulse dependence coefficient $K_P$ is given by:

$$K_P=\Delta VdP/\Delta VP1 \text{ [ng/}\mu\text{sec·dot]}$$

This coefficient $K_P$ is determined by the head structure, drive condition, ink physical properties, and the like independently of the temperature. More specifically, curves b and c in FIG. 45 represent the above-mentioned relationships of other recording heads, and as can be seen from these curves, the ejection characteristics change depending on recording heads. In this manner, since the upper limit value $P1_{LMT}$ of the pre-heat pulse P1 varies depending on recording heads, ejection amount control is performed while determining the upper limit value $P1_{LMT}$ in units of recording heads, as will be described later. For example, in the recording head and ink represented by the curve a of this embodiment, $K_P$=3.209 [ng/$\mu$sec·dot].

Figure 46:
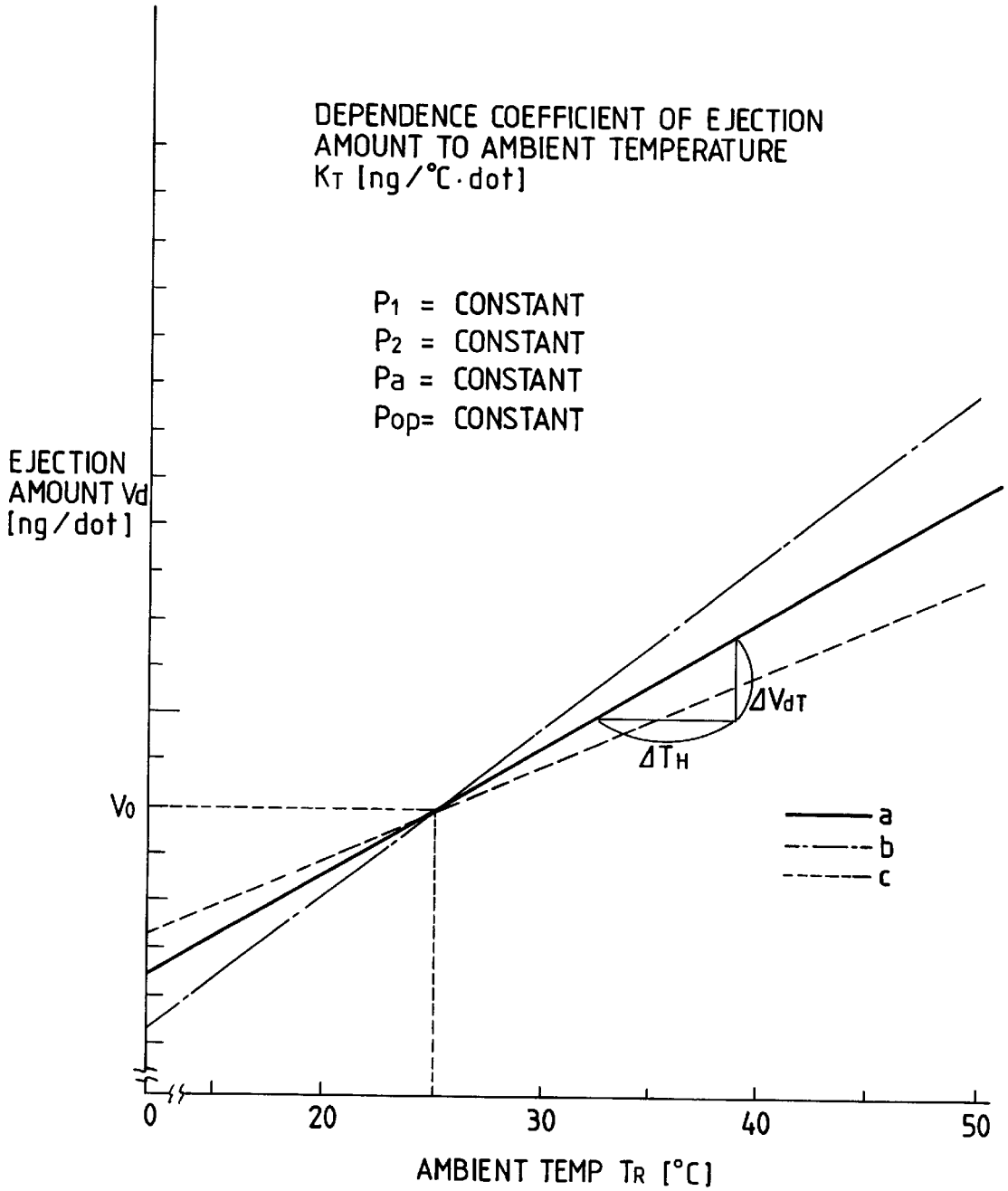
FIG. 46 is a graph showing the temperature dependence of the ejection amount.

Another factor for determining the ejection amount of the ink-jet recording head is the temperature (ink temperature) of the recording head. FIG. 46 is a graph showing the temperature dependence of the ejection amount. As indi cated by a curve a in FIG. 46, the ejection amount Vd linearly increases as the ambient temperature $T_R$ (head temperature $T_H$) of the recording head increases. If the inclination of this straight line is defined as a temperature dependence coefficient, the temperature dependence coefficient $K_T$ is given by:

$K_T = \Delta VdT/\Delta T_H$ [ng/°C.·dot]

The coefficient $K_T$ is determined by the head structure, ink physical properties, and the like independently of the drive condition. In FIG. 46 as well, curves b and c represent the characteristics of other recording heads. For example, in the recording head of this embodiment, $K_T$=0.3 [ng/°C.·dot].

The ejection amount control according to this embodiment can be realized using the above-mentioned relationships shown in FIGS. 45 and 46.

In this embodiment, double-pulse PWM drive control is performed. However, PWM drive control may be performed using multi-pulses, i.e., three or more pulses, or a main pulse PWM drive method for changing the main pulse width using a single pulse may be adopted.

This embodiment executes control to uniquely set a PWM value from a temperature difference (ΔT) between the target temperature and the head temperature. FIG. 47 shows the relationship between ΔT and the PWM value. In FIG. 47, "~" indicates—ranges up to the value of the next column—, and "temperature difference" represents ΔT, "pre-heat" represents P1, "interval" represents P2, and "main" represents P3. Also, "set-up time" represents a time required from when a recording instruction is input until the pulse P1 actually rises. The set-up time is mainly a margin time until the driver rises, and is not an essential element of the present invention. In addition, "weighting" represents a weighting coefficient to be multiplied with the number of print dots which are detected for calculating the head temperature. Even when the number of dots to be printed remains the same, the raised temperature of the head obtained when dots are printed at a pulse width of 7 μsec becomes different from that obtained when dots are printed at a pulse width of 4.5 μsec. As a means for correcting the temperature difference caused by pulse-width modulation depending on a selected PWM table, "weighting" is used.

(Sub-heater Drive Control)

When the actual ejection amount is below the reference ejection amount even after the PWM drive control, sub-heater drive control is executed immediately before a print operation so as to adjust the ejection amount to the reference ejection amount. The sub-heater drive time is set from a sub-heater table in accordance with a difference (Δt) between the target temperature and the actual head temperature. Two sub-heater tables, i.e., a "quick heating sub-heater table" and a "normal sub-heater table", are prepared, and are selectively used depending on the following conditions (see FIG. 48).

[When printing is re-started from non-print state]

Figure 48:
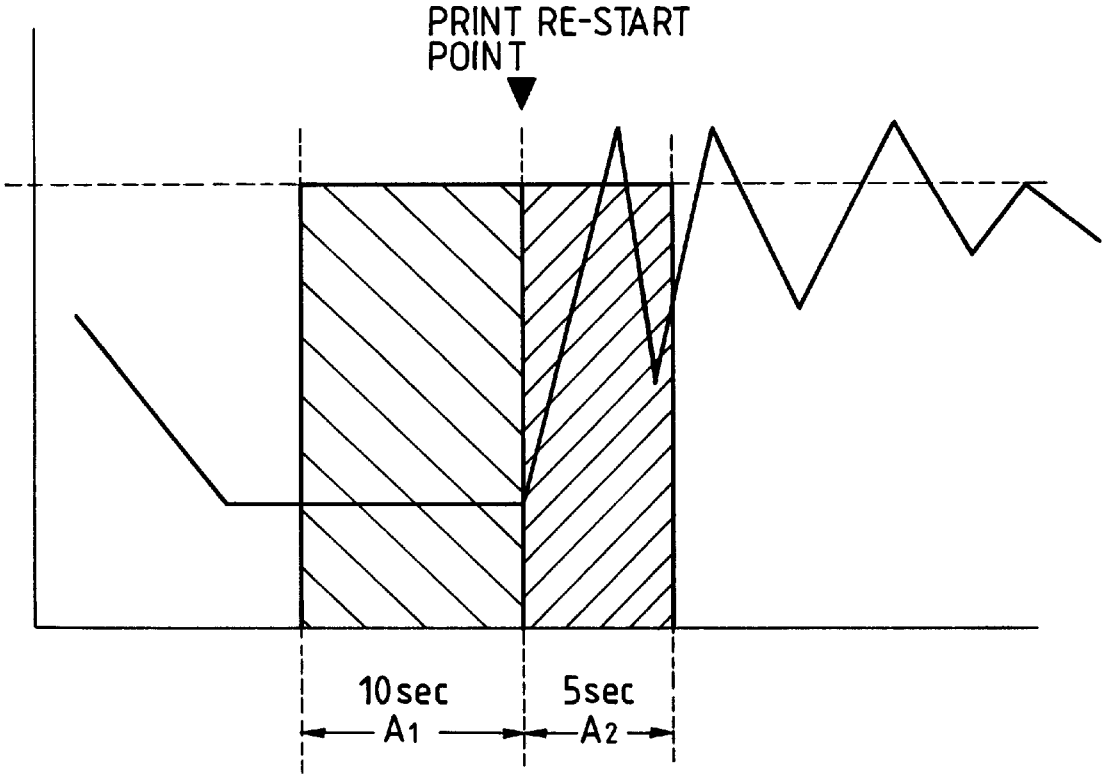
FIG. 48 is a graph for explaining sub-heater drive control.

When 10 sec or more have elapsed from the end of the previous print operation, the "quick heating sub-heater table" is used. A1 in FIG. 48 represents an area for determining whether or not the quick heating table is used at the beginning of printing. When the elapsed time is less than 10 sec, the "normal sub-heater table" is used.

[When continuous printing is executed]

After 5 sec or more have elapsed from when printing was re-started from the non-print state, the "normal sub-heater table" is used. When the elapsed time is less than 5 sec, the table used at the beginning of printing is successively used. More specifically, when the quick heating sub-heater table was used, the "quick heating sub-heater table" is successively used; when the normal sub-heater table was used, the "normal sub-heater table" is successively used. A2 in FIG. 48 represents an area with a possibility of use of the quick heating table.

The reason why the two tables are selectively used, and the quick heating sub-heater table is used is as follows. That is, since the ejection amount limit means using sub-heaters is a technique for controlling the ejection amount by increasing the head temperature, it requires a certain time for raising the temperature. For this reason, when a desired raised temperature cannot be obtained within a ramp-up time of the carriage, the print start timing must be delayed to assure an extra time for raising the temperature, resulting in a decrease in throughput.

FIG. 49 shows the details of sub-heater drive conditions. In FIG. 49, "temperature difference" represents a difference (Δt) between the target temperature and the actual head temperature, "LONG" represents the quick heating sub-heater table, and "SHORT" represents the normal sub-heater table.

(Overall Flow Control)

The overall flow of the head control system will be described below with reference to FIGS. 50 and 51.

Figure 50:
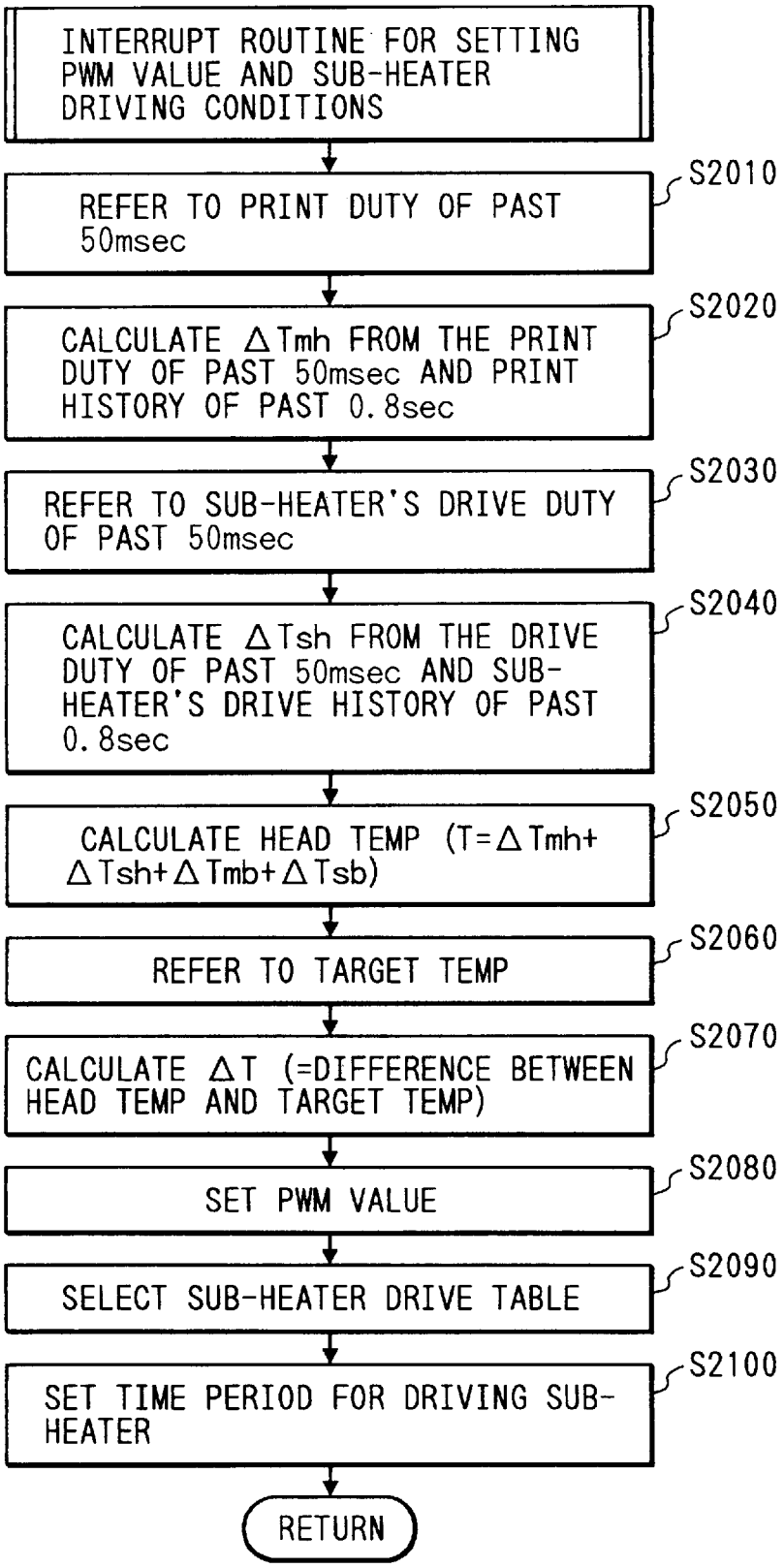
FIG. 50 is a flow chart showing an interrupt routine for setting a PWM drive value and a sub-heater drive time.

FIG. 50 shows an interrupt routine for setting a PWM drive value for ejection, and a sub-heater drive time. This interrupt routine is generated every 50 msec. Therefore, the PWM value and the sub-heater drive time are always updated at 50-msec intervals independently of the print or non-print state, and whether or not the environment requires sub-heater drive control.

When an interrupt is generated at the 50-msec interval, the print duty for the past 50 msec is referred to (S2010). In this case, the print duty to be referred to at this time is a product of the number of actually ejected dots with weighting coefficients in units of PWM values, as has been described above in the paragraph of (PWM Control). The raised temperature (ΔTmh) when the heat source is the ejection heater and the time constant is that of the short-range member group is calculated from the duty for the past 50 msec, and a print history for the past 0.8 sec (S2020). Then, the drive duty of the sub-heater for the past 50 msec is similarly referred to (S2030), and the raised temperature (ΔTsh) obtained when the heat source is the sub-heater, and the time constant is that of the short-range member group is calculated from the sub-heater drive duty for the past 50 msec, and a sub-heater drive history for the past 0.8 sec (S2040). Then, the raised temperature (ΔTmb) obtained when the heat source is the ejection heater, and the time constant is that of the long-range member group, and the raised temperature (ΔTsb) obtained when the heat source is the sub-heater, and the time constant is that of the long-range member group, which temperatures are calculated in a main routine (to be described later), are referred to, and these temperatures are added to each other (=ΔTmh+ΔTsh+ΔTmb+ΔTsb), thereby calculating the head temperature (S2050).

Then, a target temperature is set from the target temperature table (S2060), and the temperature difference (ΔT) between the head temperature and the target temperature is calculated (S2070). The PWM value as the optimal head drive condition according to ΔT is set based on the temperature difference ΔT, the PWM table, and the sub-heater table (S2080). The sub-heater drive time as the optimal head drive condition according to the temperature difference ΔT is set (S2100) on the basis of the selected sub-heater table (S2090). Thus, the interrupt routine ends.

Figure 51:
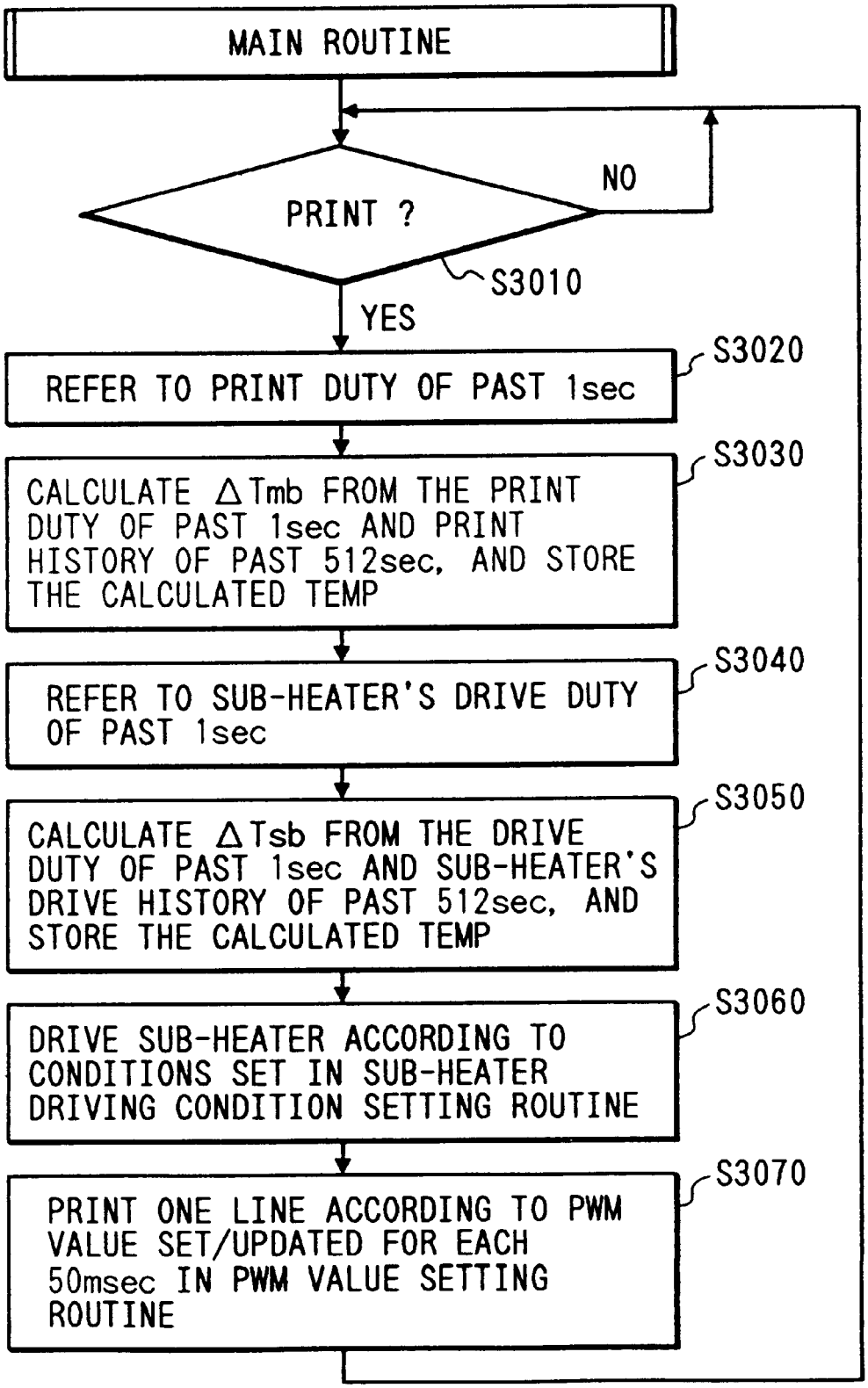
FIG. 51 is a flow chart showing a main routine.

FIG. 51 shows the main routine. When a print instruction is input in step S3010, the print duty for the past 1 sec is referred to (S3020). In this case, the print duty to be referred to at this time is a product of the number of actually ejected dots with weighting coefficients in units of PWM values, as has been described above in the paragraph of (PWM Control). The raised temperature (ΔTmb) obtained when the heat source is the ejection heater, and the time constant is that of the long-range member group is calculated from the duty for the past 1 sec. and a print history for the past 512 sec, and is stored and updated at the predetermined memory position so as to be easily referred to in the interrupt routine generated every 50 msec (S3030). Then, the sub-heater drive duty for the past 1 sec is referred to (S3040), and the raised temperature (ΔTsb) obtained when the heat source is the sub-heater, and the time constant is that of the long-range member group is calculated from the sub-heater drive duty for the past 1 sec, and a sub-heater drive history for the past 512 sec. As in the case wherein ΔTmb is stored and updated, the temperature ΔTsb is stored and updated at the predetermined memory position so as to be easily referred to in the interrupt routine generated every 50 msec (S3050).

Sub-heater drive control is executed according to the PWM value and the sub-heater drive time, which are updated every time an interrupt is generated every 50 msec (S3060), and thereafter, a print operation for one line is performed (S3070).

In this embodiment, double-pulse and single-pulse PWM control modes are used for controlling the ejection amount and the head temperature. However, PWM control using three or more pulses may be used. When the head chip temperature is higher than a print target temperature, and cannot be decreased even by small-energy PWM control, the scanning speed of the carriage may be controlled, or the scanning start timing of the carriage may be controlled.

In this embodiment, since the future head temperature can be predicted without using a temperature sensor, various head control operations can be performed before an actual print operation, and more proper recording can be realized. Since models are simplified, and the calculation algorithm is achieved by an accumulation of simple calculations, prediction control can be facilitated. The constants such as temperature prediction cycles (50-msec intervals and 1-sec intervals) used in this embodiment are merely examples, and do not restrict the present invention.

This embodiment has three print modes, i.e., HQ, SHQ, and HS modes. The ejection mode is changed according to the print mode, and drive control according to the print mode is executed. As described above, in order to execute the drive control, the difference (Δt) between the target temperature of the head determined based on the ambient temperature and the actual head chip temperature is calculated. After Δt is calculated, Δt is corrected according to the print mode. Since the PWM value and the sub-heater drive time as the direct control parameters of the ejection amount are determined based on Δt, when Δt is corrected according to the print mode, the ejection amount can be controlled.

The print modes will be described below.

(Print Mode)

In this embodiment, the HQ (High Quality) mode is normally set. The HQ mode is a mode for realizing a high-speed operation and high image quality at the same time. The SHQ (Super High Quality) mode is a super high image quality mode, which pursues higher image quality than the HQ mode. The HS (High Speed) mode is a draft high-speed mode for high-speed printing. The features of these three modes will be described below.

(1) HQ Mode

In the HQ mode, high-speed printing can be performed at a drive frequency of 6.25 kHz and a print speed of 173 cps (10 cpi). This drive frequency is achieved by a segment-shift effect in one drive block (common), and cannot be realized by a conventional drive method, which drives eight segments simultaneously.

Figure 52:
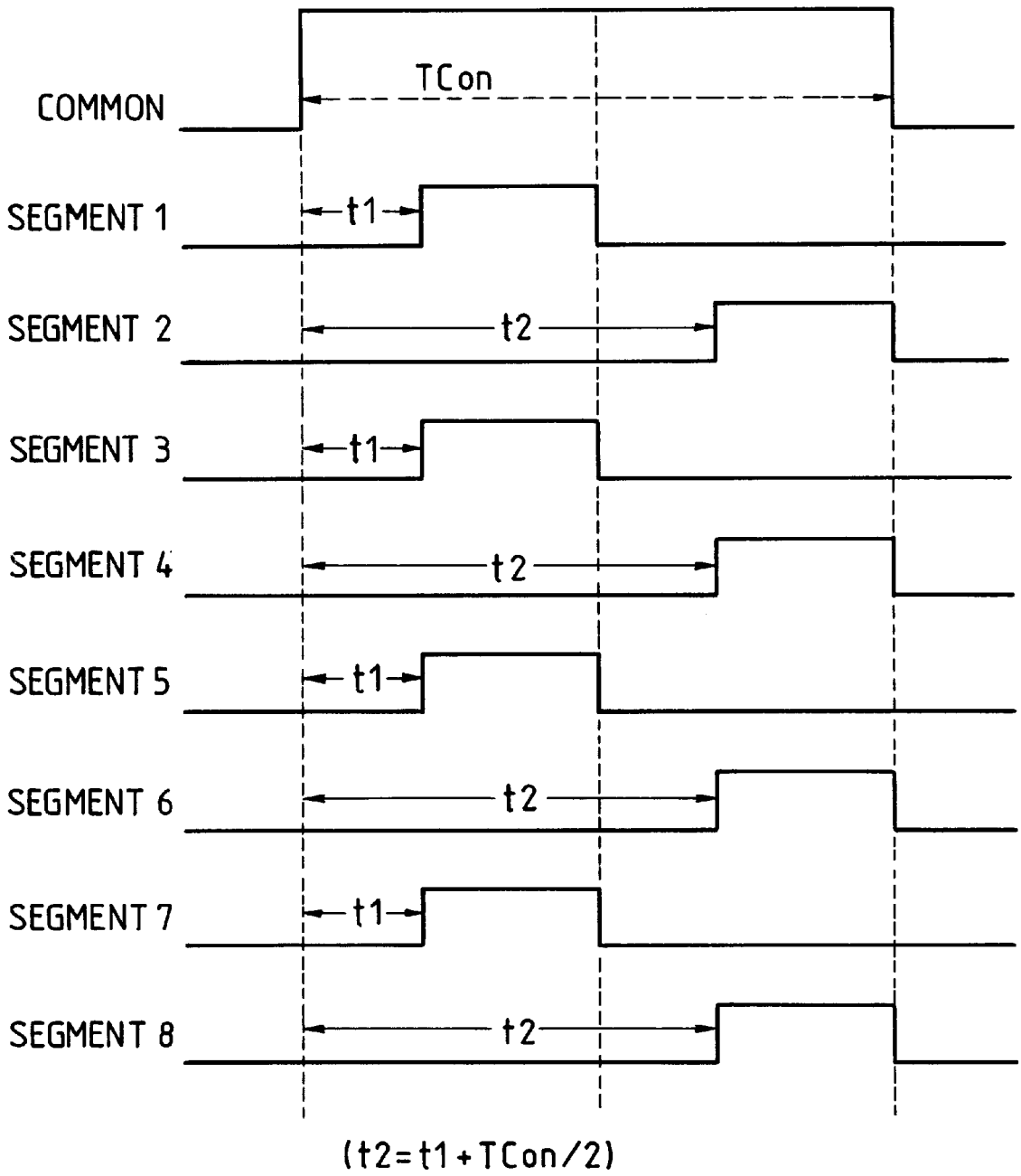
FIG. 52 is an explanatory view of segment-shift drive control.

The segment-shift drive method is proposed in U.S. application Ser. No. 872,924 (filed on Apr. 23, 1992) by the present applicant, and is a drive method for delaying the ON timings of eight segments, which are turned on within one block, so that even nozzles and odd nozzles are divisionally driven, as shown in FIG. 52. In this method, the ink refill peak timing is shifted to prevent a delay of the refill timing upon execution of continuous ejection. Also, the refill operation of nozzles is assisted by utilizing foaming energy of adjacent ejection nozzles. In a conventional simultaneous segment drive method, the ink refill operation cannot catch up with the high-frequency drive operation, and ejection is performed in a state wherein an ink is not sufficiently filled in the nozzle, resulting in an ejection error. When such ejection is continuously performed, bubbles which have not vanished are accumulated in the common ink chamber, thus causing an ink omission state. The segment-shift drive method can solve such a problem. In FIG. 52, t1 and t2 indicate the times from when a common signal is enabled until odd and even nozzles are respectively turned on. Also, TCon indicates the ON time of the common signal, and is 15.57 μsec in this mode.

In this mode, since the drive frequency is as high as 6.25 kHz, electric power input per unit time is high, and is highest of the print modes of this embodiment. When the head is driven with high electric power, the temperature is easily increased by the head drive operation, and density nonuniformity easily occurs. In this embodiment, since the drive conditions of, e.g., multi-pulse PWM control are updated every 50 msec, intra-line and inter-line density nonuniformities can be prevented. Since the head is driven under the optical drive condition without inputting unnecessary energy by executing optimal multi-pulse PWM control according to the temperature difference between the ambient temperature and the head chip temperature, the temperature rise can be prevented as much as possible. Thus, the temperature rise itself is prevented, thereby minimizing density nonuniformity.

(2) SHQ Mode

The SHQ mode is a super high image quality mode capable of performing printing at a drive frequency of 4.46 kHz and at a print speed of 124 cps (10 cpi).

In this embodiment, although multi-pulse PWM control is executed based on the difference between the ambient temperature and the head chip temperature as in the HQ mode, a table larger by several stages than a table selected according to the temperature difference is selected. For example, if the temperature difference is "1.5° C.~" (i.e. difference between 1.5° C. and 4.5° C.) in FIG. 47, three tables are skipped, and a table of "10.5° C.~" (i.e. difference between 10.5° C. and 13.5° C.) is set in place of the table corresponding to the temperature difference. To obtain a constant ink ejection amount, a table which can obtain a larger ejection amount than that of an optimal table is selected. Therefore, in the SHQ mode, the ejection amount can be increased, and a high-density image can be provided independently of the kinds of paper. However, for a recording medium with an extremely low fixing characteristic such as an OHP sheet, the HQ mode is used more preferably than this mode. In a high-temperature environment, the ejection amount is decreased to prevent the ejection amount from being increased too much. Thus, the temperature range, in which this mode as a high-density, high image quality mode can be used, can be widened.

Since this mode places an importance on image quality, the main body can be controlled with higher precision although the speed is slightly lowered. For example, when the head mounting angle is a nominal value, a ruled-line shift between lines is 5.1 μm in the HQ mode, while it is 4.2 μm in this mode. Furthermore, the noise level in the HQ mode is 42 dB, while it is 40 dB in this mode, thus providing excellent low-noise characteristics.

In this embodiment, the segment-shift drive control is executed as in the HQ mode so as to maintain ejection stability. Although fluctuations of the ink in the recording head are eliminated by the segment-shift drive control, the segment-shift drive control is not used in a region in which the frequency is unstable. Therefore, the drive frequency of this mode is as low as 4.46 kHz as compared to the HQ mode, fluctuations of the ink are very small, and ejection stability is very good in this region. In particular, since an increase in ejection amount is effective in a low-temperature environment, and ejection stability is good, an ejection error caused by an insufficiently refilled ink, which tends to occur in a low-temperature environment, can be prevented. In a low-temperature environment, super high image quality is maintained, and this mode has higher image quality level than the HQ mode.

(3) HS Mode

The HS mode is a high-speed mode capable of performing printing at a drive frequency of 8.93 kHz and a print speed of 248 cps (10 cpi).

This mode has a print speed twice that of the SHQ mode, and draft printing based on divisional pulse control is executed, thus achieving high-speed printing. Since this mode places an importance on the speed rather than image quality, fluctuations and the like are not seriously considered. Since draft printing is performed, the ejection amount is small, and this mode is advantageous in terms of cost.

As described above, print operations having unique features can be performed in these print modes. These print modes are set in correspondence with user's needs, and can be selected by a user.

The present invention brings about excellent effects particularly in a recording head and a recording apparatus of the ink jet system using heat energy among the ink jet recording systems.

As to its representative construction and principle, for example, one practiced by use of the basic principle disclosed in, for instance, U.S. Pat. Nos. 4,723,129 and 4,740,796 is preferred. The above system is applicable to either one of the so-called on-demand type and the continuous type. Particularly, the case of the on-demand type is effective because, by applying at least one driving signal which gives rapid temperature elevation exceeding nucleate boiling corresponding to the recording information on electro-thermal conversion elements arranged in a range corresponding to the sheet or liquid channels holding liquid (ink), heat energy is generated by the electro-thermal conversion elements to effect film boiling on the heat acting surface of the recording head, and consequently the bubbles within the liquid (ink) can be formed in correspondence to the driving signals one by one. By ejecting the liquid (ink) through an ejection orifice by growth and shrinkage of the bubble, at least one droplet is formed. By making the driving signals into pulse shapes, growth and shrinkage of the bubble can be effected instantly and adequately to accomplish more preferably ejection of the liquid (ink) particularly excellent in accordance with characteristics. As the driving signals of such pulse shapes, the signals as disclosed in U.S. Pat. Nos. 4,463,359 and 4,345,262 are suitable. Further excellent recording can be performed by using the conditions described in U.S. Pat. No. 4,313,124 of the invention concerning the temperature elevation rate of the above-mentioned heat acting surface.

As a construction of the recording head, in addition to the combined construction of an ejection orifice, a liquid channel, and an electro-thermal conversion element (linear liquid channel or right angle liquid channel) as disclosed in the above specifications, the construction by use of U.S. Pat. Nos. 4,558,333 and 4,459,600 disclosing the construction having the heat acting portion arranged in the flexed region is also included in the invention. The present invention can be also effectively constructed as disclosed in Japanese Laid-Open Patent Application No. 59-123670 which discloses the construction using a slit common to a plurality of electro-thermal conversion elements as an ejection portion of the electro-thermal conversion element or Japanese Laid-Open Patent Application No. 59-138461 which discloses the construction having the opening for absorbing a pressure wave of heat energy corresponding to the ejection portion.

Furthermore, the first to seventh embodiments of the present invention can independently provide the excellent operations and effects, as described above. When the two or more embodiments are combined, further excellent operations and effects can be obtained very effectively.

According to the present invention, in a recording apparatus having a plurality of recording modes, recording can be performed under proper recording conditions in correspondence with the recording modes.

Since sheet feed control, carriage control, wiping control, ejection amount control, and head drive control can be performed in correspondence with the recording modes, recording can be performed under proper conditions in terms of the recording speed, recording precision, recording quality, recording noise, and the like.

What is claimed is:

1. A recording apparatus for recording an image on a recording medium by a predetermined amount using a recording head in accordance with record data sent from a host apparatus, said recording apparatus being able to record an image on the recording medium in a plurality of recording modes, with recording speeds in the plurality of recording modes being different from each other, said host apparatus being able to send out a recording mode setting command being different from the record data and different from a conveyance amount data by which the recording medium is moved, said recording apparatus comprising:

moving means for moving the recording medium relative to said recording head after the predetermined amount of image is recorded;

designating means for designating one of the plurality of recording modes in accordance with a record mode selecting signal from an operation panel or the command from said host apparatus that is different from the record data and different from the conveyance amount data by which the recording medium is moved by said moving means;

selecting means for selecting one of a plurality of patterns of driving said moving means in accordance with a recording mode designated by said designating means; and control means for controlling a moving speed of said moving means in accordance with a pattern of driving the moving means selected by said selecting means.

2. An apparatus according to claim 1, wherein the plurality of recording modes include a high-speed recording mode, and when the high-speed recording mode is selected, said control means controls the operation of said moving means in accordance with a drive curve for shortening a moving time as compared to a case wherein another recording mode is selected.

3. An apparatus according to claim 2, wherein when the high-speed recording mode is selected, said control means controls the operation of said moving means in accordance with a curve for increasing the moving speed to a predetermined moving speed, and thereafter, rapidly decreasing the moving speed.

4. An apparatus according to claim 1, wherein the plurality of recording modes include a low-noise recording mode, and when the low-noise recording mode is selected, said control means controls the operation of said moving means in accordance with a drive curve which has a highest speed allowing a low-noise operation as compared to a case wherein another recording mode is selected.

5. An apparatus according to claim 1, wherein the plurality of recording modes include a high-quality recording mode, and when the high-quality recording mode is selected, said control means controls the operation of said moving means in accordance with a drive curve which allows higher moving precision as compared to a case wherein another recording mode is selected.

6. An apparatus according to claim 5, wherein when the high-quality recording mode is selected, said control means controls the operation of said moving means in accordance with a drive curve for suppressing a highest speed to a small value, and setting a constant speed from the middle of the moving operation.

7. An apparatus according to any one of claims 1 and 2 to 6, wherein said recording head comprises ejection orifices for ejecting an ink, and records an image by ejecting ink droplets from the ejection orifices.

8. An apparatus according to claim 7, wherein said recording head ejects ink droplets from the ejection orifices by causing a change in state in the ink using heat energy.

9. A recording apparatus for recording an image on a recording medium by a predetermined amount using a recording head in accordance with record data sent from a host apparatus, said recording apparatus being able to record an image on the recording medium in a plurality of recording modes, with recording speeds in the plurality of recording modes being different from each other, the recording mode being selected in accordance with a record mode selecting signal from an operation panel of said recording apparatus or a recording mode setting command, different from the record data and different from a conveyance amount data by which the recording medium is moved, from said host apparatus, said recording apparatus comprising:

moving means for moving the recording medium relative to said recording head after the predetermined amount of image is recorded; and control means for controlling an operation of said moving means, wherein said control means has first and second patterns of driving said moving means and operates said moving means in accordance with one of the first and second patterns to achieve movement, when a moving amount of said moving means is not less than a predetermined amount, said control means operates said moving means in accordance with the first pattern, when the moving amount is less than the predetermined amount, said control means operates said moving means using a portion of the second pattern in correspondence with the moving amount, and said control means controls a moving speed in correspondence with the recording mode selected.

10. An apparatus according to claim 9, wherein when the moving amount is not less than the predetermined amount, said control means controls the moving speed in correspondence with the recording mode.

11. An apparatus according to claim 10, wherein when the recording mode is a high-quality recording mode, said control means controls said moving means to achieve the movement by not less than the predetermined amount at a lower speed than another recording mode.

12. An apparatus according to claim 9, wherein when the moving amount is less than the predetermined amount, said control means operates said moving means using a portion up to a middle of a rising pattern and a portion from a middle of a falling pattern of the second pattern in correspondence with the moving amount so as to achieve movement by less than the predetermined amount.

13. An apparatus according to any one of claims 9 to 12, wherein said recording head comprises ejection orifices for ejecting an ink, and records an image by ejecting ink droplets from the ejection orifices.

14. An apparatus according to claim 13, wherein said recording head ejects ink droplets from the ejection orifices by causing a change in state in the ink using heat energy.

15. A recording apparatus for recording an image on a recording medium using a recording head having ejection orifices for ejecting an ink, in accordance with record data sent from a host apparatus, said recording apparatus being able to record an image in a plurality of recording modes, with recording speeds in the plurality of recording modes being different from each other, said host apparatus being able to send out a recording mode setting command being different from the record data and different from a conveyance amount data by which the recording medium is moved, said recording apparatus comprising:

moving means for moving the recording medium relative to said recording head;

selecting means for selecting one recording mode of the plurality of recording modes in accordance with a record mode selecting signal from an operation panel or the command from said host apparatus that is different from the record data and different from the conveyance amount data by which the recording medium is moved by said moving means;

control means for controlling a moving speed of said moving means in correspondence with the one recording mode selected by said selecting means; and changing means for changing an ejection amount of the ink ejected from the ejection orifices of said recording head in correspondence with the recording mode selected by said selecting means.

16. An apparatus according to claim 15, wherein said changing means further controls the ejection amount of the ink in correspondence with a temperature of the recording head.

17. An apparatus according to claim 15, wherein said moving means conveys the recording medium, and said control means controls a conveyance speed of the recording medium in correspondence with the recording mode selected by said selecting means.

18. An apparatus according to claim 15, wherein said moving means moves said recording head to achieve recording scanning, and said control means controls the moving speed of said recording head in correspondence with the recording mode selected by said selecting means.

19. An apparatus according to any one of claims 15 to 18, wherein said recording head ejects ink droplets from the ejection orifices by causing a change in state in the ink using heat energy.

20. A recording apparatus having a recording head for recording record data sent from a host apparatus, said host apparatus being able to send out a recording mode setting command being different from the record data and different from a conveyance amount data by which the recording medium is moved, said recording apparatus comprising:

first moving means for moving the recording head relative to a recording medium in a first scan direction;

second moving means for moving the recording medium relative to the recording head in a second scan direction different from the first scan direction after a predetermined amount of image has been recorded; and control means for controlling operation of the recording head and said first and second moving means in a plurality of different selectable modes of operation in which a recording speed is variable in accordance with a selected mode, the recording mode being selected in accordance with a record mode selecting signal from an operation panel or the command from said host apparatus that is different from the record data and different from the conveyance amount data by which the recording medium is moved by said second moving means, said control means controlling a speed at which the recording medium is moved by said second moving means in accordance with a selected mode of operation.

21. An apparatus according to claim 20, wherein the plurality of modes of operation include a high-speed recording mode, and when the high-speed recording mode is selected, said control means controls said second moving means in accordance with a drive curve for shortening a moving time in the second scan direction as compared to a case wherein another mode of operation has been selected.

22. An apparatus according to claim 21, wherein when the high-speed recording mode is selected, said control means controls said second moving means in accordance with a curve for increasing a moving speed at which the recording medium is moved to a predetermined moving speed and thereafter rapidly decreasing the moving speed.

23. An apparatus according to any one of claims 20 to 22, wherein the plurality of modes of operation include a low-noise recording mode, and when the low-noise recording mode is selected, said control means controls said second moving means in accordance with a drive curve which has a highest speed allowing a low-noise operation as compared to a case wherein another mode of operation has been selected.

24. An apparatus according to claim 23, wherein the recording head comprises an ink jet recording head and said apparatus further comprises second control means for controlling an ejection amount of the ink ejected from ejection orifices of said recording head in correspondence with a selected mode of operation.

25. An apparatus according to claim 24, wherein said recording head ejects ink droplets from the ejection orifices by causing a change in state of the ink using heat energy.

26. An apparatus according to claim 24, wherein said second control means further controls the ejection amount of the ink in correspondence with a temperature of said recording head.

27. An apparatus according to claim 26, wherein said recording head ejects ink droplets from the ejection orifices by causing a change in state of the ink using heat energy.

28. An apparatus according to claim 23, wherein the plurality of modes of operation include a high-quality recording mode, and when the high-quality recording mode is selected, said control means controls said second moving means in accordance with a drive curve which allows higher moving precision as compared to a case wherein another mode of operation is selected.

29. An apparatus according to claim 28, wherein when the high-quality recording mode is selected, said control means controls said second moving means in accordance with a drive curve for suppressing a highest speed to a small value, and setting a constant speed from a middle of a moving operation.

30. An apparatus according to claim 29, wherein the recording head comprises an ink jet recording head and said apparatus further comprises second control means for controlling an ejection amount of the ink ejected from ejection orifices of said recording head in correspondence with a selected mode of operation.

31. An apparatus according to claim 30, wherein said recording head ejects ink droplets from the ejection orifices by causing a change in state of the ink using heat energy.

32. An apparatus according to claim 30, wherein said second control means further controls the ejection amount of the ink in correspondence with a temperature of said recording head.

33. An apparatus according to claim 32, wherein said recording head ejects ink droplets from the ejection orifices by causing a change in state of the ink using heat energy.

34. An apparatus according to claim 28, wherein the recording head comprises an ink jet recording head and said apparatus further comprises second control means for controlling an ejection amount of the ink ejected from ejection orifices of said recording head in correspondence with a selected mode of operation.

35. An apparatus according to claim 34, wherein said second control means further controls the ejection amount of the ink in correspondence with a temperature of said recording head.

36. An apparatus according to claim 35, wherein said recording head ejects ink droplets from the ejection orifices by causing a change in state of the ink using heat energy.

37. An apparatus according to claim 34, wherein said recording head ejects ink droplets from the ejection orifices by causing a change in state of the ink using heat energy.

38. An apparatus according to any one of claims 20 to 22, wherein the plurality of modes of operation include a high-quality recording mode, and when the high-quality recording mode is selected, said control means controls said second moving means in accordance with a drive curve which allows higher moving precision as compared to a case wherein another mode of operation is selected.

39. An apparatus according to claim 38, wherein when the high-quality recording mode is selected, said control means controls said moving means in accordance with a drive curve for suppressing a highest speed to a small value, and setting a constant speed from a middle of a moving operation.

40. An apparatus according to claim 39, wherein the recording head comprises an ink jet recording head and said apparatus further comprises second control means for controlling an ejection amount of the ink ejected from ejection orifices of said recording head in correspondence with a selected mode of operation.

41. An apparatus according to claim 40, wherein said second control means further controls the ejection amount of the ink in correspondence with a temperature of said recording head.

42. An apparatus according to claim 41, wherein said recording head ejects ink droplets from the ejection orifices by causing a change in state of the ink using heat energy.

43. An apparatus according to claim 40, wherein said recording head ejects ink droplets from the ejection orifices by causing a change in state of the ink using heat energy.

44. An apparatus according to claim 38, wherein the recording head comprises an ink jet recording head and said apparatus further comprises second control means for controlling an ejection amount of the ink ejected from ejection orifices of said recording head in correspondence with a selected mode of operation.

45. An apparatus according to claim 44, wherein said second control means further controls the ejection amount of the ink in correspondence with a temperature of said recording head.

46. An apparatus according to claim 45, wherein said recording head ejects ink droplets from the ejection orifices by causing a change in state of the ink using heat energy.

47. An apparatus according to claim 44, wherein said recording head ejects ink droplets from the ejection orifices by causing a change in state of the ink using heat energy.

48. An apparatus according to claim 20, wherein said control means controls a moving speed of said second moving means in the different selectable modes of operation in correspondence with an amount the recording medium is moved relative to the recording head.

49. An apparatus according to claim 48, wherein said control means controls said second moving means in accordance with different drive curves in correspondence with the different modes of operation.

50. An apparatus according to claim 49, wherein when the amount is not less than a predetermined value, said control means controls said second moving means in accordance with a drive curve having predetermined rising and falling patterns, and when the moving amount is less than the predetermined amount, said control means controls said moving means using a portion of a drive curve having symmetrical rising and falling patterns according to the amount.

51. An apparatus according to claim 48, wherein said control means comprises first and second drive curves for controlling said second moving means and controls said second moving means in accordance with the drive curves so that when an amount of movement of said second moving means is not less than the predetermined amount, said control means controls said second moving means in accordance with the first drive curve, and when the amount of movement is less than the predetermined amount, said control means controls said moving means using a portion of the second drive curve in correspondence with the amount.

52. An apparatus according to claim 51, wherein when the amount of movement is not less than the predetermined amount, said control means controls the moving speed at which the recording medium is moved in correspondence with the selected mode of operation.

53. An apparatus according to claim 52, wherein when the selected mode of operation is a high-quality recording mode, said control means controls said second means to move the recording medium relative to the recording head by not less than the predetermined amount and at a lower moving speed than in other modes of operation.

54. An apparatus according to claim 51, wherein when the amount of movement is less than the predetermined amount, said control means controls said second moving means using a portion up to a middle of a rising pattern and a portion from a middle of a falling pattern of the second drive curve in correspondence with the amount of movement so as to achieve movement of less than the predetermined amount.

55. An apparatus according to any one of claims 20–22 and 48–54, wherein the recording head comprises an ink jet recording head and said apparatus further comprises second control means for controlling an ejection amount of the ink ejected from ejection orifices of said recording head in correspondence with a selected mode of operation.

56. An apparatus according to claim 55, wherein said recording head ejects ink droplets from the ejection orifices by causing a change in state of the ink using heat energy.

57. An apparatus according to claim 55, wherein said second control means further controls the ejection amount of the ink in correspondence with a temperature of said recording head.

58. An apparatus according to claim 57, wherein said recording head ejects ink droplets from the ejection orifices by causing a change in state of the ink using heat energy.

* * * * *

UNITED STATES PATENT AND TRADEMARK OFFICE

CERTIFICATE OF CORRECTION

PATENT NO. : 6,065,830
DATED : May 23, 2000
INVENTOR(S) : Hiramatsu et al.

It is certified that error appears in the above-identified patent and that said Letters Patent is hereby corrected as shown below:

In the Drawings:
Sheet 36, Figure 42B, "MEASURMENT" should read -- MEASUREMENT --.

Column 4:
Line 22, "modification" should read -- modification of --.

Column 13:
Line 18: "one" should read -- one as --.

Column 15:
Line 12, "result. ." should read -- result. --.

Column 27:
Line 18, "VOP" should read -- Vop --.
Line 22, "VOP" should read -- Vop --.

Column 28:
Line 67, "As indi" should read -- As indi --.

Column32:
Line 6, "1992)" should read -- 1992, now U.S. Patent No. 5,280,310) --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*